US011103046B2

(12) United States Patent
Ohba

(10) Patent No.: US 11,103,046 B2
(45) Date of Patent: Aug. 31, 2021

(54) CARTRIDGE, CARTRIDGE HOLDER, AND CARTRIDGE-TYPE COSMETIC CONTAINER

(71) Applicant: Suzuno Kasei Kabushiki Kaisha, Tokyo (JP)

(72) Inventor: Atsushi Ohba, Tokyo (JP)

(73) Assignee: SUZUNO KASEI KABUSHIKI KAISHA, Tokyo (JP)

( * ) Notice: Subject to any disclaimer, the term of this patent is extended or adjusted under 35 U.S.C. 154(b) by 117 days.

(21) Appl. No.: 16/486,584

(22) PCT Filed: Aug. 30, 2017

(86) PCT No.: PCT/JP2017/031255

§ 371 (c)(1),
(2) Date: Aug. 16, 2019

(87) PCT Pub. No.: WO2018/158984

PCT Pub. Date: Sep. 7, 2018

(65) Prior Publication Data

US 2020/0008559 A1 Jan. 9, 2020

(30) Foreign Application Priority Data

Feb. 28, 2017 (JP) ..... JP2017-037037

(51) Int. Cl.
*B43K 5/06* (2006.01)
*A45D 40/04* (2006.01)
(Continued)

(52) U.S. Cl.
CPC ..... *A45D 40/04* (2013.01); *A45D 40/02* (2013.01); *B43K 24/02* (2013.01);
(Continued)

(58) Field of Classification Search
CPC .. A45D 40/02; A45D 40/04; A45D 2040/204; A45D 2040/208; A45D 2040/0043; A45D 2040/0062
(Continued)

(56) References Cited

U.S. PATENT DOCUMENTS 3,358,699 A * 12/1967 Bau ..... A45D 40/04 401/70
4,997,299 A * 3/1991 Ohba ..... A45D 40/00 401/171
(Continued)

FOREIGN PATENT DOCUMENTS

JP H0349017 U 5/1991
JP 2014161637 A 9/2014

*Primary Examiner* — Jennifer C Chiang
(74) *Attorney, Agent, or Firm* — Rabin & Berdo, P.C.

(57) ABSTRACT

A cartridge is provided with a cartridge outer tube having a through hole and a support member that supports a cosmetic and that is received in the cartridge outer tube so as to be movable in the axial direction; the support member has a rod shaft portion that is linked to a tip end of a push rod at a base end thereof and a support tube that is provided on a tip end of the rod shaft portion and that supports the cosmetic; the through hole has a tip-end storing hole that stores the cosmetic and a base-end sliding hole that is provided so as to communicate with the tip-end storing hole, the base-end sliding hole being configured such that a linking portion formed of the tip end of the push rod and the base end of the support member slides therein in a linkage unreleasable state; and the linking portion is moved out from the base-end sliding hole by a feeding mechanism and is moved in a linkage releasable region in the tip-end storing hole.

12 Claims, 35 Drawing Sheets

(51) Int. Cl.

| | |
|---|---|
| ***B43K 24/02*** | (2006.01) |
| ***A45D 40/02*** | (2006.01) |
| *A45D 40/00* | (2006.01) |
| *A45D 40/20* | (2006.01) |

(52) U.S. Cl.
CPC ..... *A45D 2040/0043* (2013.01); *A45D 2040/0062* (2013.01); *A45D 2040/204* (2013.01); *A45D 2040/208* (2013.01)

(58) Field of Classification Search
USPC ..... 401/172, 174, 175
See application file for complete search history.

(56) References Cited

U.S. PATENT DOCUMENTS

| | | | | |
|---|---|---|---|---|
| 5,018,892 | A * | 5/1991 | Krueckel | A45D 40/04 401/64 |
| 7,052,198 | B2 * | 5/2006 | Sasaki | A45D 40/20 401/75 |
| 7,455,467 | B2 * | 11/2008 | Sasaki | A45D 40/04 401/68 |
| 9,549,603 | B2 * | 1/2017 | Ohba | A45D 40/00 |
| 10,542,813 | B2 * | 1/2020 | Ohba | A45D 40/10 |

* cited by examiner

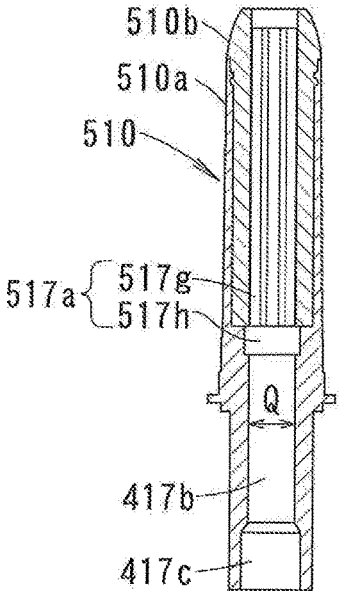
FIG. 31A
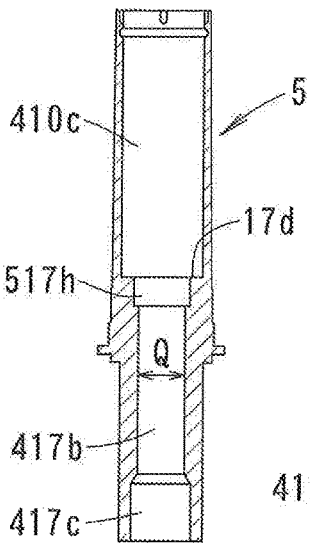
FIG. 31B
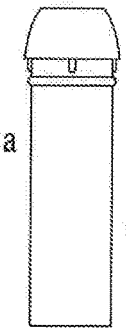
FIG. 31C
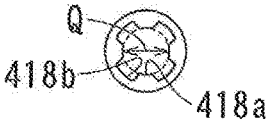
FIG. 31D
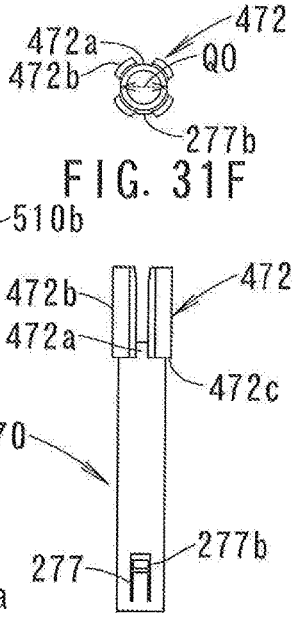
FIG. 31F
FIG. 31E

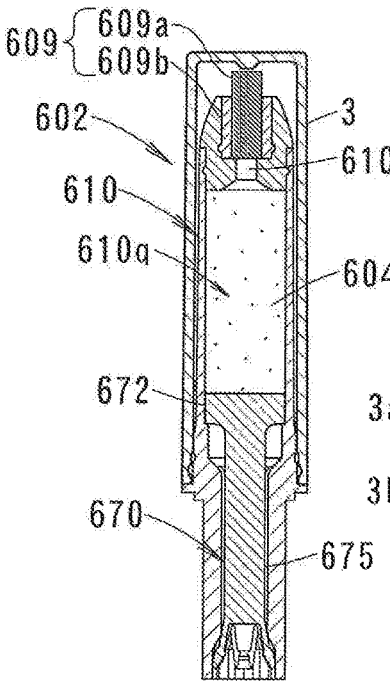
FIG. 33A
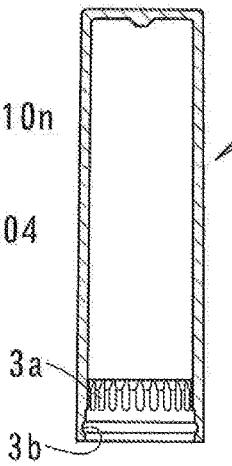
FIG. 33B
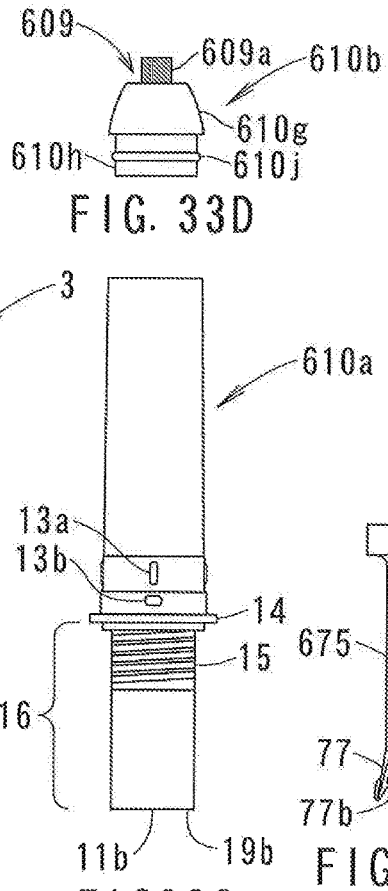
FIG. 33D
FIG33C
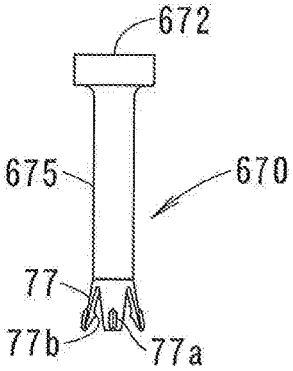
FIG. 33E

CARTRIDGE, CARTRIDGE HOLDER, AND CARTRIDGE-TYPE COSMETIC CONTAINER

TECHNICAL FIELD

The present invention relates to a cartridge, a cartridge holder, and a cartridge-type cosmetic container.

BACKGROUND ART

There is a known cartridge-type cosmetic container in which a cosmetic stored in a cartridge is moved in and out of the cartridge through a tip end thereof (see JP1991-049017U). The cartridge-type cosmetic container disclosed in JP1991-049017U is provided with an outer tube, a feeding mechanism that has a sliding shaft that moves rearward and forward by a feeding operation, a cartridge into which the cosmetic is filled, a core chuck that holds the cosmetic in the cartridge and that moves the cosmetic in and out of the cartridge through the tip end thereof, and a thread chuck that engages with the sliding shaft by attaching the cartridge.

In the cartridge-type cosmetic container disclosed in JP1991-049017U, when the cartridge (131) is replaced, as a screw (132) of the cartridge is removed, chuck claws (119) of the thread chuck (117) are opened and expanded, and thereby, the engagement between a thread (118) on an inner surface of the chuck and a thread (128) of the sliding shaft (127) is released. Thereby, the sliding shaft (127) is automatically moved rearward by tension exerted by a spring (116) to release engagement between the core chuck (134) and a presser (129) of the sliding shaft (127).

SUMMARY OF INVENTION

With the cartridge-type cosmetic container disclosed in JP1991-049017U, when a finished cartridge that has been used-up is replaced with a new unused cartridge, at a stage in which the screw (132) of the finished cartridge is removed, the engagement between the core chuck (134) and the presser (129) of the sliding shaft (127) is not released. Subsequent to the removal of the screw (132) of the finished cartridge, the engagement between the core chuck (134) and the presser (129) of the sliding shaft (127) is released once the sliding shaft (127) is moved rearward to a rearward limit position together with the core chuck (134) and an engaging projection of an elastic block (137) is positioned in a recessed groove (133). Thus, even if the screw (132) of the finished cartridge is removed, the finished cartridge cannot be detached immediately. In other words, with the cartridge-type cosmetic container disclosed in JP1991-049017U, there is a problem in that it takes some time to replace the cartridge.

An object of the present invention is to enable replacement of the finished cartridge with an unused cartridge with ease.

According to a first aspect of the present invention, a cartridge configured such that a feeding mechanism is operated as the cartridge is used by being attached to a cartridge holder having a built-in push rod and a cosmetic stored in the cartridge is moved rearward and forward in conjunction with rearward and forward movement of the push rod, includes a cartridge outer tube having a through hole through which a tip end side opening is communicated with a base end side opening, and a support member received in the cartridge outer tube so as to be movable in an axial direction, the support member being configured to support the cosmetic. The support member has: a rod shaft portion configured to be linked at a base end to a tip end of the push rod; and a support portion provided on a tip end of the rod shaft portion, the support portion being configured to support the cosmetic. The through hole has: a tip-end storing hole provided on the tip end side of the cartridge outer tube, the tip-end storing hole being configured to store the cosmetic; and a base-end sliding hole provided on the base end side of the cartridge outer tube so as to communicate with the tip-end storing hole, the base-end sliding hole is configured such that a linking portion of the tip end of the push rod and a base end of the support member slides in a linkage unreleasable state. The linking portion is configured to move out from the base-end sliding hole by the feeding mechanism and to move to a linkage releasable region in the tip-end storing hole.

According to a second aspect of the present invention, a cartridge-type cosmetic container includes the cartridge, and the cartridge holder. The cartridge holder is provided with: a body tube configured such that the cartridge outer tube is detachably attached to a front-end portion of the body tube; and a driving body provided on a rear-end portion of the body tube so as to be relatively rotatable with respect to the body tube. The feeding mechanism has: an internal thread member provided in the body tube, the internal thread member being formed with an internal thread on an inner circumference of the internal thread member; and the push rod provided on the driving body, the push rod being formed with an external thread on an outer circumference of the push rod so as to be threaded with the internal thread of the internal thread member, and the push rod being configured to be moved rearward and forward by relative rotation between the body tube and the driving body.

According to a third aspect of the present invention, a cartridge holder used by being attached to the cartridge includes a body tube configured such that the cartridge outer tube is detachably attached to a front-end portion of the body tube, and a driving body provided on a rear-end portion of the body tube so as to be relatively rotatable with respect to the body tube. The feeding mechanism has: an internal thread member provided in the body tube, the internal thread member being formed with an internal thread on an inner circumference of the internal thread member; and the push rod provided on the driving body, the push rod being formed with an external thread on an outer circumference of the push rod so as to be threaded with the internal thread of the internal thread member, and the push rod being configured to be moved rearward and forward by relative rotation between the body tube and the driving body. The linking portion is formed of an opening and closing portion provided on the tip end of the push rod and a clamp-fitted portion provided on the base end of the support member, the opening and closing portion being configured to be capable of being opened and closed through the elastic deformation. The base end of the support member and the tip end of the push rod are configured to be linked as the opening and closing portion is shifted to a closed state and the opening and closing portion is clamp fitted to the clamp-fitted portion, and the support member and the push rod are configured such that the linkage between the base end of the support member and the tip end of the push rod becomes releasable as the opening and closing portion is shifted to an opened state. The opening and closing portion is configured such that the closed state of the opening and closing portion is maintained as the opening and closing portion is constrained by an inner circumferential surface of the base-end sliding hole when the linking portion is placed in the base-end sliding hole. The opening and closing portion is configured so as to be released from the constraint when the linking portion is moved out from the base-end sliding hole and the linking portion is positioned in the linkage releasable region.

According to a fourth aspect of the present invention, a cartridge holder used by being attached to the cartridge includes a body tube configured such that the cartridge outer tube is detachably attached to a front-end portion of the body tube, and a driving body provided on a rear-end portion of the body tube so as to be relatively rotatable with respect to the body tube. The feeding mechanism has: an internal thread member provided in the body tube, the internal thread member being formed with an internal thread on an inner circumference of the internal thread member; and the push rod provided on the driving body, the push rod being formed with an external thread on an outer circumference of the push rod so as to be threaded with the internal thread of the internal thread member, and the push rod being configured to be moved rearward and forward by relative rotation between the body tube and the driving body. The linking portion is formed of an opening and closing portion provided on the base end of the support member and a clamp-fitted portion provided on the tip end of the push rod, the opening and closing portion being configured to be capable of being opened and closed through the elastic deformation. The base end of the support member and the tip end of the push rod are configured to be linked as the opening and closing portion is shifted to a closed state and the opening and closing portion is clamp fitted to the clamp-fitted portion, and the support member and the push rod are configured such that the linkage between the base end of the support member and the tip end of the push rod becomes releasable as the opening and closing portion is shifted to an opened state. The opening and closing portion is configured such that the closed state of the opening and closing portion is maintained as the opening and closing portion is constrained by an inner circumferential surface of the base-end sliding hole when the linking portion is placed in the base-end sliding hole. The opening and closing portion is configured so as to be released from the constraint when the linking portion is moved out from the base-end sliding hole and the linking portion is positioned in the linkage releasable region.

BRIEF DESCRIPTION OF DRAWINGS

FIG. 31A is a front sectional view of the cartridge outer tube according to a modification of the fourth embodiment of the present invention.

FIG. 31B is a front sectional view of the outer tube body.

FIG. 31C is a front view of the cosmetic storing tube.

FIG. 31D is a bottom view of the cosmetic storing tube.

FIG. 31E is a front view of the support member.

FIG. 31F is a plan view of the support member viewed from the front side.

FIG. 33A is a front sectional view of the cartridge according to a first modification of the present invention.

FIG. 33B is a front sectional view of the cap.

FIG. 33C is a front view of the outer tube body of the cartridge outer tube.

FIG. 33D is a front view of a tip end tube of the cartridge outer tube.

FIG. 33E is a front view of the support member.

DESCRIPTION OF EMBODIMENTS

Figure 1A:
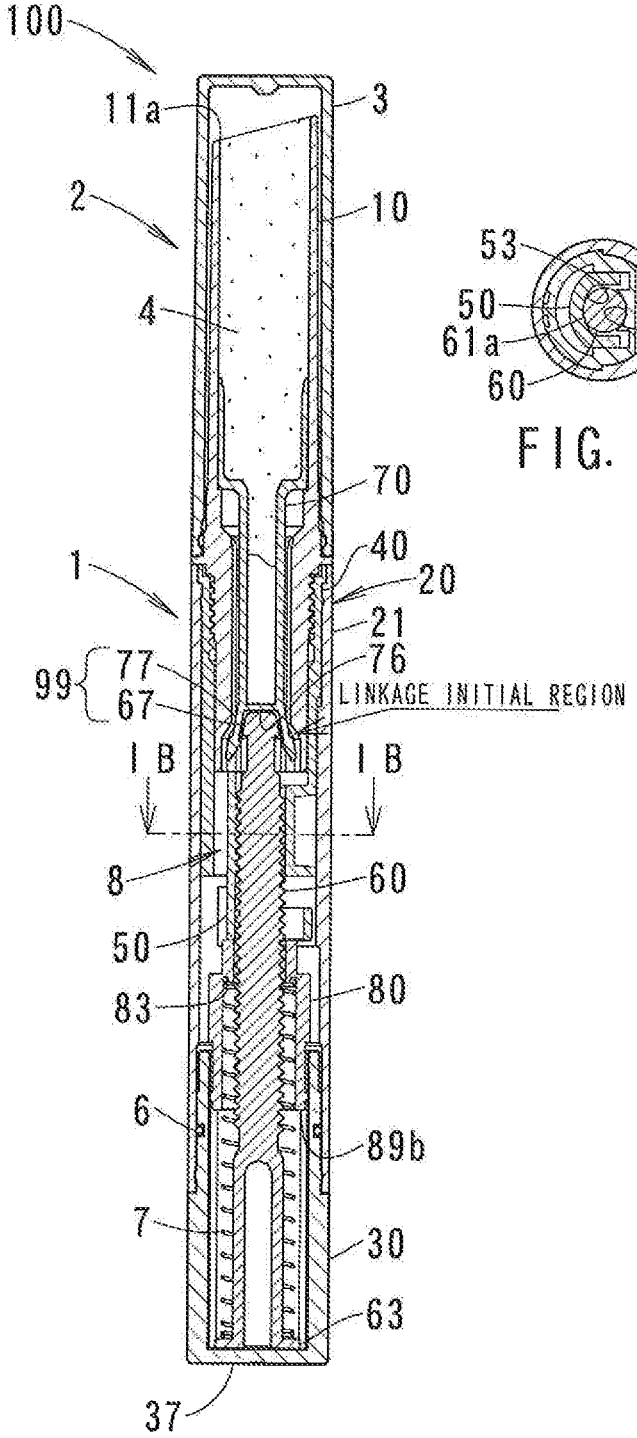
FIG. 1A is a front sectional view showing a state in which a push rod of a cartridge-type cosmetic container according to a first embodiment of the present invention is positioned at a rearward limit position.

Embodiments of the present invention will be described below with reference to the drawings.

First Embodiment

A cartridge-type cosmetic container 100 according to a first embodiment of the present invention will be described with reference to the drawings. The cartridge-type cosmetic container 100 is provided with a cartridge holder 1 and a cartridge 2. For the sake of simplifying the explanation, the tip end side of the cartridge 2 at which a cosmetic 4 is moved in and out of the cartridge 2 is referred to as the front side of the cartridge-type cosmetic container 100, and a bottom portion 37 side of a driving body 30 of the cartridge holder 1 is referred to as the rear side of the cartridge-type cosmetic container 100. Thereby, the forward and rearward directions of the cartridge-type cosmetic container 100 are defined. For the cartridge 2, the tip end side of the cartridge 2 at which the cosmetic 4 is moved in and out of the cartridge 2 is referred to as the front side of the cartridge 2, and the side of the cartridge 2 at which the cartridge 2 is attached to the cartridge holder 1 is referred to as the rear side of the cartridge 2. For the cartridge holder 1, the opening side of a body tube 20 to which the cartridge 2 is attached is referred to as the front side of the cartridge holder 1, and the bottom portion 37 side of the driving body 30 is referred to as the rear side of the cartridge holder 1.

An overview of an overall configuration of the cartridge-type cosmetic container 100 will be described with reference to FIGS. 1A to 3. The cartridge-type cosmetic container 100 is used by attaching the cartridge 2 storing the cosmetic 4 to the cartridge holder 1. The cartridge 2 includes a cartridge outer tube 10, the cosmetic 4 that is stored in the cartridge outer tube 10, a support member 70 that is received in the cartridge outer tube 10 to support the cosmetic 4, and a cap 3 attached to the cartridge outer tube 10.

The cartridge holder 1 is provided with the body tube 20 to a front-end portion of which the cartridge outer tube 10 is detachably attached, the driving body 30 that is provided on a rear-end portion of the body tube 20 so as to be rotatable coaxially and relatively with respect to the body tube 20, an internal thread member 50 that is provided in the body tube 20 and that is formed with an internal thread 53 in an inner circumference thereof, a push rod 60 that is provided in the driving body 30 and that is formed with, in an outer circumference thereof, an external thread 61*a*, which is threaded to the internal thread 53 of the internal thread member 50, a cushion member 80 that is provided coaxially with respect to the body tube 20, and a coil spring 7 serving as a biasing member.

The push rod 60 is a shaft-like member that extends in the center axial direction (hereinafter, simply referred to as the axial direction) of the body tube 20. The push rod 60 is provided such that its base end portion is engaged with the driving body 30 so as to be rotatable integrally with the driving body 30 and such that its tip end portion is movable in the axial direction in the body tube 20.

The cosmetic 4 in the cartridge 2 is fed out and back through a tip end of the cartridge 2 as the push rod 60 is moved rearward and forward by a feeding mechanism 8 provided in the cartridge holder 1. The feeding mechanism 8 is configured so as to have the internal thread member 50 formed with the internal thread 53 and the push rod 60 formed with the external thread 61*a* and to move the push rod 60 in the axial direction as the internal thread 53 threads with the external thread 61*a*.

The push rod 60 is moved rearward and forward by the relative rotation between the body tube 20 and the driving body 30, thereby causing the cosmetic 4 stored in the cartridge outer tube 10 to be moved in and out, via the support member 70, through a front end opening 11*a* on the tip end side of the cartridge outer tube 10.

When a user rotates the driving body 30 in a first direction (in the normal direction) with respect to the body tube 20, the push rod 60 is moved forward in the axial direction (in other words, advanced), and the cosmetic 4 is pushed out from the front end opening 11*a* of the cartridge 2 via the support member 70 linked to the push rod 60. When the user rotates the driving body 30 in a second direction (in the reversed direction) with respect to the body tube 20, the push rod 60 is moved rearward in the axial direction (in other words, reversed), and the cosmetic 4 that has been pushed out from the front end opening 11*a* of the cartridge 2 is pulled back from the front end opening 11*a* of the cartridge 2 via the support member 70 linked to the push rod 60.

When all of the cosmetic 4 in the cartridge 2 is used up, the user can replace the cartridge 2 that has been used-up with a new cartridge 2, and thereby, it is possible to reuse the cartridge-type cosmetic container 100 again. In addition, the user can also replace the half-finished cartridge 2 with another half-finished cartridge 2.

A detail of the cartridge 2 will be described with reference to FIGS. 1A, 1B, and 4A to 6D. The cartridge 2 is configured such that the cosmetic 4 stored in the cartridge 2 is moved rearward and forward in conjunction with the rearward and forward movement of the push rod 60 as the cartridge 2 is used by being attached to the cartridge holder 1 having the built-in push rod 60 and the feeding mechanism 8 is operated.

Figure 1B:
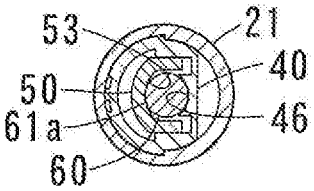
FIG. 1B is a sectional view taken along IB-IB in FIG. 1A.

As shown in FIGS. 1A and 1B, a rear-end portion of the cartridge 2 is attached to the front-end portion of the body tube 20 of the cartridge holder 1. As shown in FIGS. 4A to 4D, the cartridge 2 is provided with the cartridge outer tube 10 that is formed to have a substantially cylindrical shape, the support member 70 that is received in the cartridge outer tube 10 so as to be slidable in the axial direction in the cartridge outer tube 10, and the cap 3 that is attached to the cartridge outer tube 10.

Figure 4A:
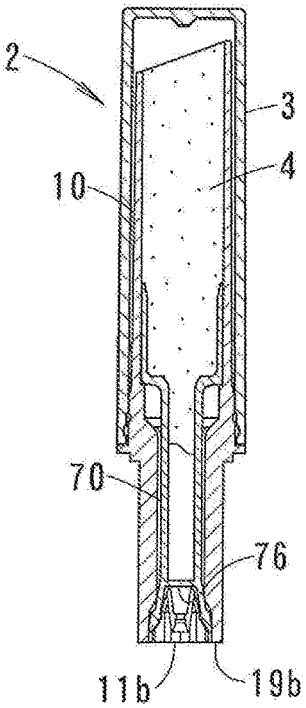
FIG. 4A is a front sectional view of a cartridge according to the first embodiment of the present invention.
Figure 4B:
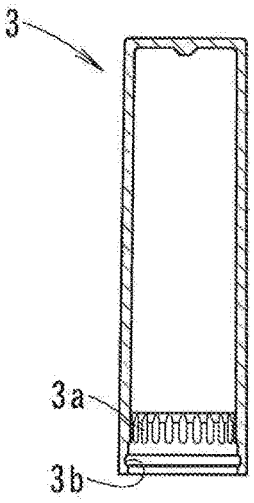
FIG. 4B is a front sectional view of a cap.
Figure 4C:
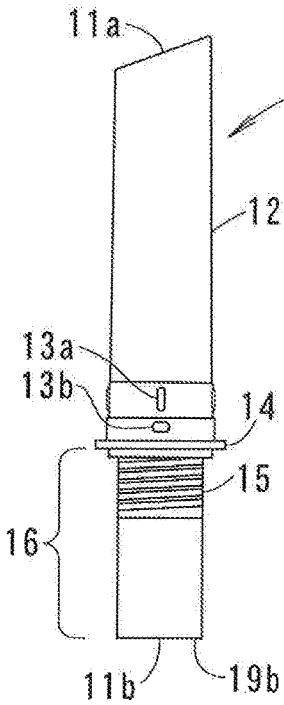
FIG. 4C is a front view of a cartridge outer tube.
Figure 4D:
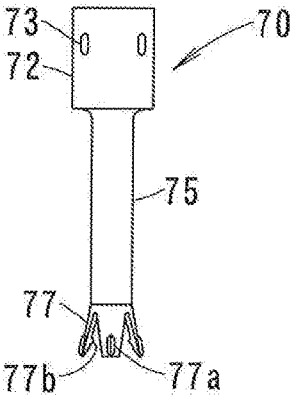
FIG. 4D is a front view of a support member.
Figure 5A:
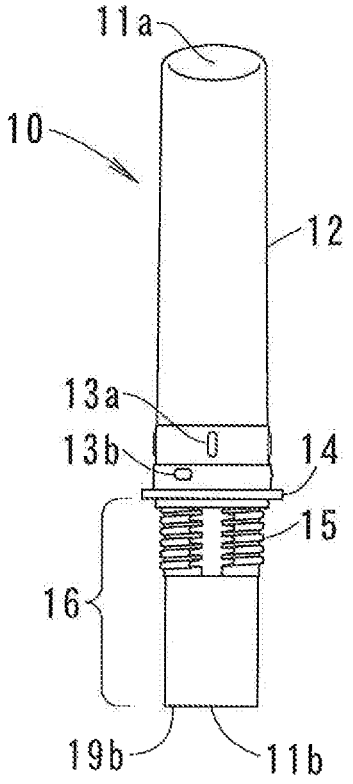
FIG. 5A is a side view of the cartridge outer tube.
Figure 5C:
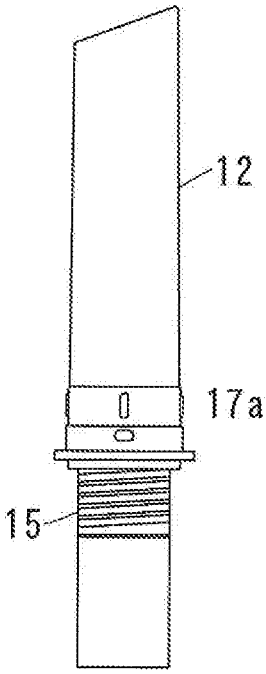
FIG. 5C is a front view of the cartridge outer tube.
Figure 5D:
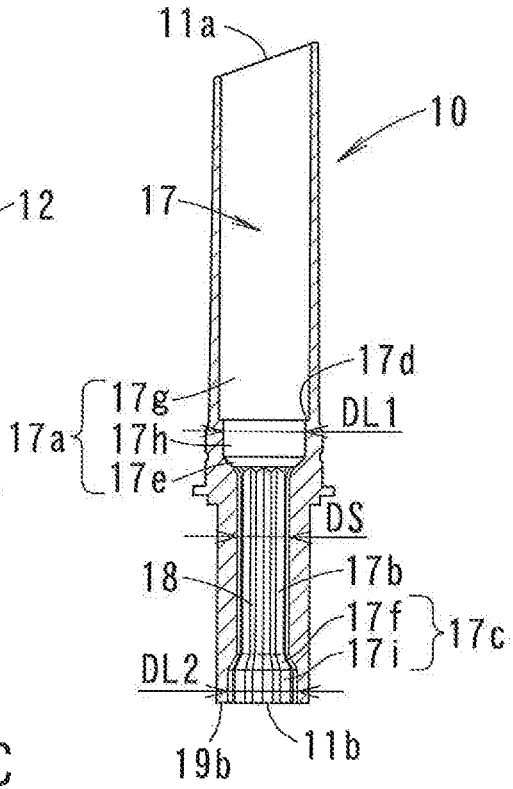
FIG. 5D is a front sectional view of the cartridge outer tube.

As shown in FIG. 5D, the cartridge outer tube 10 has a through hole 17 that penetrates through the cartridge outer tube 10 in the forward and rearward direction such that the front end opening 11*a* on the tip end side communicates with a rear end opening 11*b* on the base end side. As shown in FIG. 4A, the through hole 17 stores the cosmetic 4 and receives the support member 70 that supports the cosmetic 4. The configuration of the through hole 17 will be described in detail later.

As shown in FIGS. 5A to 5D, the cartridge outer tube 10 has an outer hull portion 12 that forms an outer hull of the front side of the cartridge-type cosmetic container 100 and a fitting portion 16 that is fitted into the body tube 20 of the cartridge holder 1. A flange 14 is provided on the rear end of the outer hull portion 12. The front end opening 11*a* of the through hole 17 is formed on a front end of the outer hull portion 12. The rear end opening 11*b* of the through hole 17 is formed on a rear end of the fitting portion 16.

The fitting portion 16 is formed to have a substantially cylindrical shape. An inner circumference of the fitting portion 16 is formed so as to be continuous with an inner circumference of the outer hull portion 12. In an outer circumference of the fitting portion 16, an external thread 15 is formed from the flange 14 in the axial direction. The external thread 15 of the cartridge 2 is threaded to an internal thread 43 of the body tube 20 of the cartridge holder 1 (see FIG. 7A).

As shown in FIGS. 4A to 4D, ribs 13*a* and fitting projections 13*b* are provided on an outer circumference of the outer hull portion 12. The ribs 13*a* engage with a knurled part 3*a* provided in an inner circumference of the cap 3 when the cap 3 is fitted to the cartridge outer tube 10 such that the cap 3 is locked in the circumferential direction. The fitting projections 13*b* fit to a fitting recess 3*b* provided in the inner circumference of the cap 3 when the cap 3 is fitted to the cartridge outer tube 10 such that the cap 3 is locked in the axial direction.

The flange 14 is an annular flange member that is provided so as to protrude radially outward. As shown in FIGS. 1A and 1B, the flange 14 defines the position of the cartridge outer tube 10 in the axial direction by coming into contact with an opening edge portion of a front end of the body tube 20 when the cartridge outer tube 10 is attached to the body tube 20. In addition, when the cap 3 is fitted to the cartridge outer tube 10, the flange 14 defines the position of the cap 3 in the axial direction by coming into contact with an opening edge portion of a rear end of the cap 3.

As shown in FIGS. 4A to 4D, the cap 3 is formed to have a bottomed cylindrical shape having an opening at one end thereof. The cap 3 is fitted to the outer hull portion 12 of the cartridge outer tube 10 to close the front end opening 11*a*. The cap 3 is provided with, on the inner circumference of its opening end, the knurled part 3*a* that engages with the ribs 13*a* of the cartridge outer tube 10 and the annular fitting recess 3*b* that is fitted to the fitting projections 13*b* of the cartridge outer tube 10.

The support member 70 is a member for supporting the cosmetic 4. The support member 70 is inserted into the through hole 17 penetrating the cartridge outer tube 10 in the axial direction and is moved in the through hole 17 in the axial direction in conjunction with the rearward and forward movement of the push rod 60.

As shown in FIGS. 6A to 6D, the support member 70 has a rod shaft portion 75 that has a cylindrical shape, a support tube 72 that is provided on a tip end (front end) of the rod shaft portion 75, and a plurality of bendable pieces 77 that are provided on a base end (rear end) of the rod shaft portion 75. The rod shaft portion 75 extends from the support tube 72 in the axial direction such that its front end is opened and its rear end is closed by an abutting part 76. The support tube 72 is formed to have a bottomed cylindrical shape that is coaxial with the rod shaft portion 75, and a bottom portion 74 is connected to the rod shaft portion 75. An outer diameter DT of the support tube 72 is larger than an outer diameter DR of the rod shaft portion 75 (DT>DR). The bottom portion 74 of the support tube 72 is formed with an opening portion that communicates with the inside of the rod shaft portion 75.

The cosmetic 4 is fixedly adhered to an inner circumferential surface of the support tube 72, and thereby, a state in which an outer circumferential surface of the cosmetic 4 is supported by the support tube 72 is held. In other words, the cosmetic 4 is held by the support tube 72. The abutting part 76 is a part that abuts against a tip end of the push rod 60. As described later, the cosmetic 4 supported by the support tube 72 is fed out from the front end opening 11*a* as the abutting part 76 is pushed by the push rod 60 and the support member 70 is advanced together with the push rod 60.

The plurality of bendable pieces 77 are connected to the rear end of the rod shaft portion 75 and extended from the rear end of the rod shaft portion 75 in the substantially axial direction. More specifically, the plurality of bendable pieces 77 respectively extend so as to spread out gradually from the base end side toward the tip end side thereof, in other words, the plurality of bendable pieces 77 respectively extend so as to move away from the center axis of the support member 70 toward the tip end side thereof.

The bendable pieces 77 are respectively provided with bendable-piece main body portions 77*c* that extend from the rear end of the rod shaft portion 75, ribs 77*a* that protrude outward from outer circumferential surfaces of tip end portions of the bendable-piece main body portions 77*c*, and protrusions 77*b* that protrude inward from inner circumferential surfaces of the tip end portions of the bendable-piece main body portions 77*c*.

In this embodiment, four bendable pieces 77 are provided with the intervals of 90 degrees in the circumferential direction centered at the center axis of the support member 70. A pair of bendable pieces 77 facing each other are inclined with respect to the center axis of the support member 70 such that the distance between the pair of bendable-piece main body portions 77*c* is increased toward the tip end.

The plurality of bendable pieces 77 are provided such that the outer circumferential surfaces thereof are positioned radially outward from an outer circumferential surface of the rod shaft portion 75. In this configuration, the distance between the tip ends of the pair of bendable-piece main body portions 77*c* facing each other, in other words, a maximum outer dimension between the pair of bendable-piece main body portions 77*c* is defined as an opening-and-closing-portion outer dimension DB (see FIG. 6A). The opening-and-closing-portion outer dimension DB is larger than the outer diameter DR of the rod shaft portion 75, but is smaller than the outer diameter DT of the support tube 72 (DR<DB<DT).

Figure 2A:
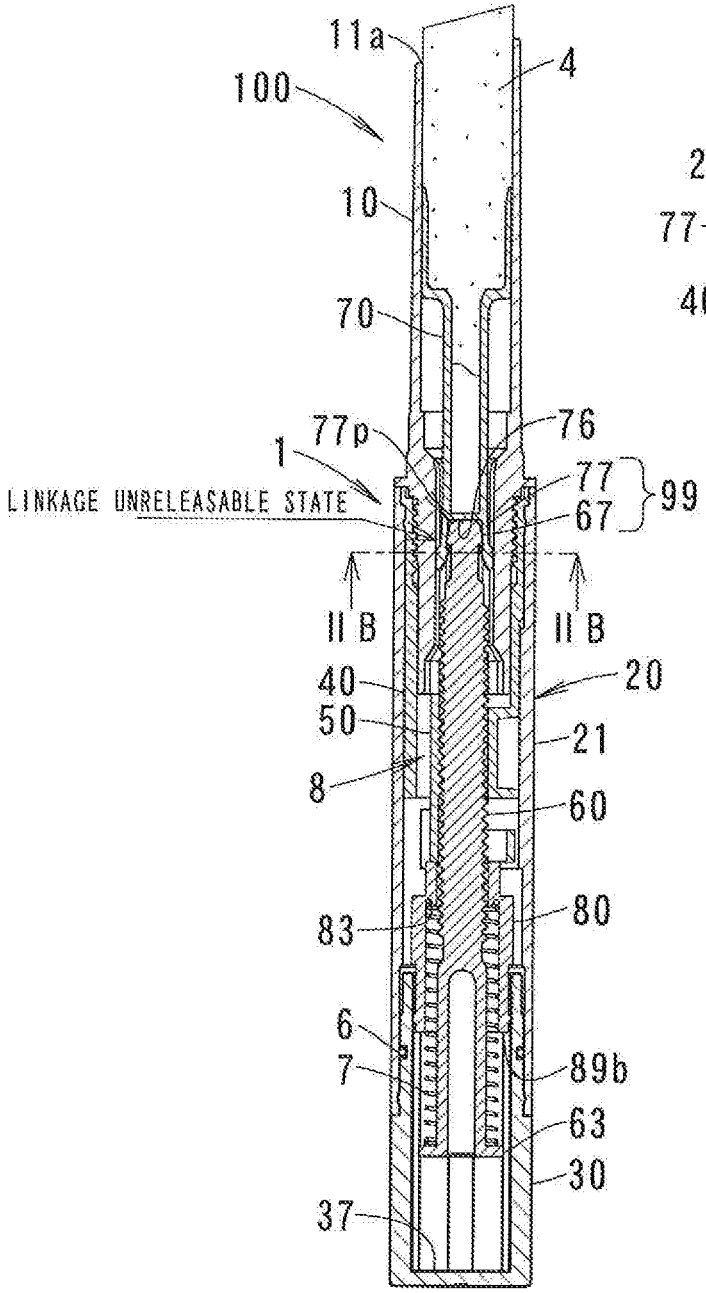
FIG. 2A is a front sectional view showing a state in which the push rod of the cartridge-type cosmetic container according to the first embodiment of the present invention is positioned between the rearward limit position and a forward limit position.
Figure 2B:
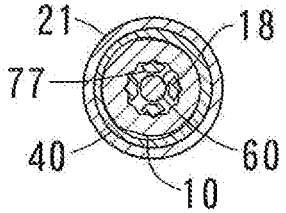
FIG. 2B is a sectional view taken along IIB-IIB in FIG. 2A.

The plurality of bendable pieces 77 are respectively formed of elastic members that are capable of being deformed elastically between an opened state in which the bendable pieces 77 are opened radially outward (see FIGS. 1A, 1B, and 3) and a closed state in which the bendable pieces 77 are closed radially inward (see FIGS. 2A and 2B). The plurality of bendable pieces 77 serve as an opening and closing portion that is capable of being opened and closed through elastic deformation and that forms a portion to be linked to the tip end of the push rod 60. Base ends of the respectively bendable pieces 77 are formed as fixed ends that are connected to the rod shaft portion 75, and tip ends of the respectively bendable pieces 77 are formed as free ends. The bendable pieces 77 are in the opened state when no external force is exerted.

The opened/closed state of the bendable pieces 77 is controlled by an inner circumferential surface of the through hole 17. The bendable pieces 77 are shifted to the closed state by being elastically deformed (distorted) by the inner circumferential surface of the through hole 17. As compared with a case in which the bendable pieces 77 are in the opened state, when the bendable pieces 77 are in the closed state, the tip ends thereof are positioned toward the center axis of the support member 70. A base end of the support member 70 is formed with a recessed portion 77*p* to which a clamp-fitted portion 67 of the tip end of the push rod 60, which will be described later, is clamp fitted (see FIGS. 12A to 12C). A rear end surface of the abutting part 76 corresponds to a bottom surface of the recessed portion 77*p*, and the inner circumferential surfaces of the plurality of bendable pieces 77 correspond to a side surface of the recessed portion 77*p*.

The through hole 17 in which the cosmetic 4 is stored and the support member 70 is received will be described in detail with reference to FIGS. 4A to 5D. As shown in FIG. 5D, the through hole 17 has a tip-end storing hole 17*a*, a base-end sliding hole 17*b*, and a base end hole 17*c* in this order from the tip end side (the front end side) to the base end side (the rear end side) of the cartridge outer tube 10.

The base-end sliding hole 17*b* is a through hole that allows linkage between the tip end of the push rod 60 and the base end of the support member 70 through a linking portion 99. In the base-end sliding hole 17*b*, the linking portion 99 slides in a state in which its linkage cannot be released. The tip-end storing hole 17*a* is a through hole in which the cosmetic 4 is stored. The tip-end storing hole 17*a* has, on its base end side, a base-end cavity portion 17*h* that is formed to have a size that allows release of the linkage between the tip end of the push rod 60 and the base end of the support member 70 through the linking portion 99. The base end hole 17*c* is a through hole that is formed to have a size that allows release of the linkage between the tip end of the push rod 60 and the base end of the support member 70 through the linking portion 99. The tip-end storing hole 17*a* communicates with the base-end sliding hole 17*b*, and the base-end sliding hole 17*b* communicates with the base end hole 17*c*.

The tip-end storing hole 17*a* is provided on the tip end side of the cartridge outer tube 10. The tip-end storing hole 17*a* has a sliding opening portion 17*g* in which the support tube 72 and the cosmetic 4 slide, the base-end cavity portion 17*h* that is provided on the rear side of the sliding opening portion 17*g*, and a tapered hole 17*e* that is provided between the base-end cavity portion 17*h* and the base-end sliding hole 17*b*. The base-end cavity portion 17*h* is an opening portion that allows the bendable pieces 77 to be shifted to the opened state, and is provided on the base end side in the tip-end storing hole 17*a*. Note that, when the bendable pieces 77 serving as the opening and closing portion are shifted to the opened state, a state in which the linkage between the tip end of the push rod 60 and the base end of the support member 70 is releasable is established.

The through hole 17 according to this embodiment has the base end hole 17*c* that allows a communication between the base-end sliding hole 17*b* and the rear end opening 11*b*. The base end hole 17*c* is provided between the rear end opening 11*b* and the base-end sliding hole 17*b*. The base end hole 17*c* has a base-end cavity portion 17*i* that is provided on the base end side in the base end hole 17*c* and a tapered hole 17*f* that is provided between the base-end cavity portion 17*i* and the base-end sliding hole 17*b*. The sliding opening portion 17*g*, the base-end cavity portion 17*h*, the tapered hole 17*e*, the base-end sliding hole 17*b*, the tapered hole 17*f*, and the base-end cavity portion 17*i* respectively have coaxial circular to substantially circular cross-sections.

The base-end sliding hole 17*b* is the through hole that is provided on the base end side of the cartridge outer tube 10 and in which the substantially cylindrical shaped opening and closing portion formed of the plurality of bendable pieces 77 slides in a reduced-diameter state. The base-end sliding hole 17*b* is the through hole that allows rearward and forward movement of the linking portion 99 of the base end of the support member 70 and the tip end of the push rod 60 in a linkage unreleasable state. The base-end sliding hole 17*b* is provided so as to communicate with each of the tip-end storing hole 17*a* and the base end hole 17*c*. The tip-end storing hole 17*a* is a region formed on the front side of the base-end sliding hole 17*b* and is a region in which the substantially cylindrical shaped opening and closing portion formed of the plurality of bendable pieces 77 can increase the diameter. The base end hole 17*c* is a region formed on the rear side of the base-end sliding hole 17*b* and is a region in which the substantially cylindrical shaped opening and closing portion formed of the plurality of bendable pieces 77 can increase the diameter.

As shown in FIGS. 4A to 5D, the sliding opening portion 17*g* receives the support tube 72 and stores the cosmetic 4 supported by the support tube 72. An inner diameter of the sliding opening portion 17*g* is slightly larger than the outer diameter DT of the support tube 72. Thus, a small gap is formed between an inner circumferential surface of the sliding opening portion 17*g* and an outer circumferential surface of the support tube 72. A plurality of protrusions 73 protruding radially outward are provided on the outer circumferential surface of the support tube 72 at equal intervals in the circumferential direction. The support tube 72 slides in the sliding opening portion 17*g* in the axial direction in a state in which the protrusions 73 come to contact with the inner circumferential surface of the sliding opening portion 17*g*.

An inner diameter DL1 of the base-end cavity portion 17*h* is smaller than the outer diameter DT of the support tube 72 (DL1<DT). In other words, the inner diameter DL1 of the base-end cavity portion 17*h* is smaller than the inner diameter of the sliding opening portion 17*g*. Because the inner diameter DL1 of the base-end cavity portion 17*h* is smaller than the inner diameter of the sliding opening portion 17*g*, a step portion 17*d* is formed between the sliding opening portion 17*g* and the base-end cavity portion 17*h*. The step portion 17*d*, which is an opening edge portion of the base-end cavity portion 17*h*, functions as a restricting portion that restricts movement of the support tube 72 toward the base end side of the cartridge outer tube 10.

The inner diameter DL1 of the base-end cavity portion 17*h* of the tip-end storing hole 17*a* is larger than an inner diameter DS of the base-end sliding hole 17*b* (DL1>DS). The inner diameter DS of the base-end sliding hole 17*b* is slightly larger than an outer diameter of the rod shaft portion 75 of the support member 70. The tapered hole 17*e*, the diameter of which is gradually increased from the base-end sliding hole 17*b* toward the base-end cavity portion 17*h*, is provided between the base-end sliding hole 17*b* and the base-end cavity portion 17*h*. At the front end, a tapered surface of the tapered hole 17*e* is continuous with an inner circumferential surface of the base-end cavity portion 17*h*, and at the rear end, the tapered surface of the tapered hole 17*e* is continuous with an inner circumferential surface of the base-end sliding hole 17*b*.

An inner diameter DL2 of the base-end cavity portion 17*i* of the base end hole 17*c* is larger than the inner diameter DS of the base-end sliding hole 17*b* (DL2>DS). The tapered hole 17*f*, the diameter of which is gradually reduced from the base-end cavity portion 17*i* toward the base-end sliding hole 17*b*, is provided between the base-end cavity portion 17*i* and the base-end sliding hole 17*b*. At the front end, a tapered surface of the tapered hole 17*f* is continuous with the inner circumferential surface of the base-end sliding hole 17*b*, and at the rear end, the tapered surface of the tapered hole 17*f* is continuous with an inner circumferential surface of the base-end cavity portion 17*i*.

Figure 5B:
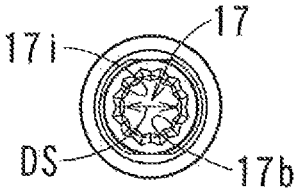
FIG. 5B is a bottom view of the cartridge outer tube.
Figure 6A:
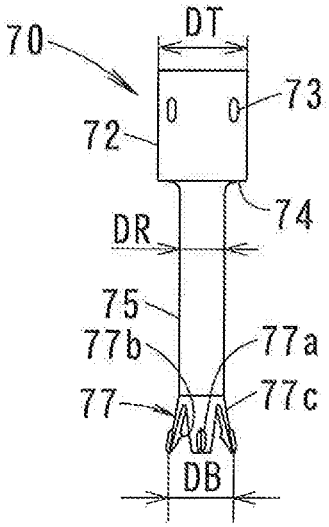
FIG. 6A is a front view of the support member.
Figure 6B:
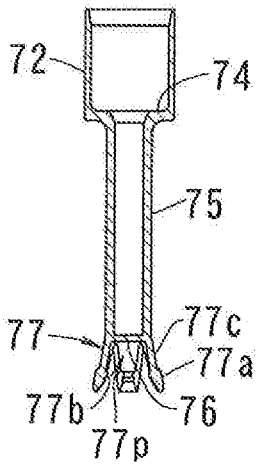
FIG. 6B is a front sectional view of the support member.
Figure 6C:
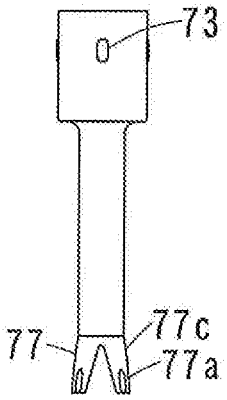
FIG. 6C is a side view of the support member rotated by 45 degrees from the state shown in FIG. 6A.
Figure 6D:
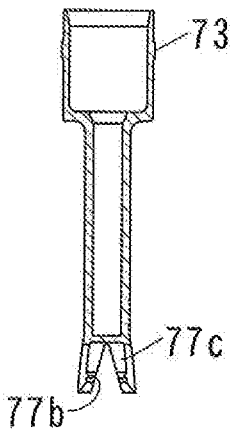
FIG. 6D is a side sectional view of the support member shown in FIG. 6C.

The inner circumferential surfaces of the base-end sliding hole 17*b* and the base end hole 17*c* are formed with a corrugated portion (straight knurl) 18 that extends in the axial direction by a knurling processing. As shown in FIGS. 5B and 5D, the corrugated portion 18 has an wave-shaped cross-section in which ridge portions and valley portions are arranged alternately in the circumferential direction, and the corrugated portion 18 is formed so as to extend continuously from the base-end cavity portion 17*i* to the base-end sliding hole 17*b*.

In this embodiment, the inner diameter DS of the base-end sliding hole 17*b* refers to the diameter of an imaginary circular cross-section that is drawn by connecting peaks of the plurality of ridge portions of the corrugated portion 18 in the base-end sliding hole 17*b*. In addition, the inner diameter DL2 of the base-end cavity portion 17*i* of the base end hole 17*c* refers to the diameter of an imaginary circular cross-section that is drawn by connecting the peaks of the plurality of ridge portions of the corrugated portion 18 in the base-end cavity portion 17*i*. The ribs 77*a* of the above-described bendable pieces 77 are fitted into the valley portions of the corrugated portion 18.

As described above, the through hole 17 controls the opened/closed state of the bendable pieces 77 with the inner circumferential surface thereof. As shown in FIG. 5D, according to this embodiment, the inner diameter DS of the base-end sliding hole 17*b* is smaller than the opening-and-closing-portion outer dimension DB (see FIG. 6A) (DS<DB). Therefore, in a state in which the bendable pieces 77 are positioned in the base-end sliding hole 17*b*, the bendable-piece main body portions 77*c* of the plurality of bendable pieces 77 are shifted to the closed state by being pushed toward inside by the peaks of the ridge portions of the corrugated portion 18 in the base-end sliding hole 17*b* (see FIG. 2B).

The inner diameter DL1 of the base-end cavity portion 17*h* of the tip-end storing hole 17*a* is larger than the opening-and-closing-portion outer dimension DB (see FIG. 6A) (DL1>DB). Similarly, the inner diameter DL2 of the base-end cavity portion 17*i* of the base end hole 17*c* is larger than the opening-and-closing-portion outer dimension DB (see FIG. 6A) (DL2>DB).

Note that, as the ribs 77*a* serving as engaging protrusions provided on the bendable pieces 77 engage with the valley portions of the corrugated portion 18 of the through hole 17, in other words, as the ribs 77*a* engage with groove portions, movement of the support member 70 in the circumferential direction with respect to the cartridge outer tube 10, in other words, the relative rotation therebetween is prohibited. With such a configuration, it is possible to prevent, the relative rotation of the support member 70 within the cartridge outer tube 10 by the engagement between the ribs 77*a* and the groove portions even when a top surface 62 of the push rod 60 is moved rearward and forward while being rotated with respect to the abutting part 76 of the support member 70 and the rotative force is transmitted through friction to the rod shaft portion 75.

An assembly procedure of the cartridge 2 will be described with reference to FIGS. 4A to 6D.

By using jigs, etc., the support member 70 is inserted into the through hole 17 through the front end opening 11*a* of the cartridge outer tube 10. The support member 70 is inserted until the bottom portion 74 of the support tube 72 comes to contact with the step portion 17*d* of the through hole 17. In other words, a rearward limit position of the support member 70 is defined by the bottom portion 74 of the support tube 72 and the step portion 17*d*.

Although the bendable pieces 77 are in the opened state when the bendable pieces 77 are positioned in the sliding opening portion 17*g* and the base-end cavity portion 17*h* in the through hole 17, as the bendable pieces 77 are inserted into the tapered hole 17*e* from the base-end cavity portion 17*h*, the bendable pieces 77 are gradually closed inwardly along the tapered surface of the tapered hole 17*e*, and once the bendable pieces 77 are inserted into the base-end sliding hole 17*b*, the bendable pieces 77 are shifted to the closed state. The ribs 77*a* of the bendable pieces 77 are fitted into the valley portions of the corrugated portion 18 of the base-end sliding hole 17*b*, and thereby, the rotation of the support member 70 is restricted. Although the bendable pieces 77 are in the closed state when the bendable pieces 77 are positioned in the base-end sliding hole 17*b*, as the bendable pieces 77 are inserted into the tapered hole 17*f* from the base-end sliding hole 17*b*, the bendable pieces 77 are gradually opened outwardly along the tapered surface of the tapered hole 17*f*, and once the bendable pieces 77 are inserted into the base-end cavity portion 17*i*, the bendable pieces 77 return to the opened state.

The bottom portion 74 of the support tube 72 comes to contact with the step portion 17*d* provided in the through hole 17, and thereby, the movement of the support tube 72 in the rearward direction is restricted by the step portion 17*d*. Therefore, even if an external force directed in the rearward direction is exerted to the support member 70, the support member 70 is prevented from being dismounted from the rear end opening 11*b* of the cartridge outer tube 10.

As described above, according to this embodiment, by making the outer diameter DT of the support tube 72 supporting the cosmetic 4 larger than the outer diameter DR of the rod shaft portion 75 provided so as to extend from the support tube 72, the bottom portion 74 of the support tube 72 comes to contact with the step portion 17*d*, and thereby, the support member 70 is prevented from being dismounted from the rear end opening 11*b* of the cartridge outer tube 10. In other words, according to this embodiment, the support tube 72 that is formed to have the diameter larger than that of the rod shaft portion 75 functions as means for the rear end opening 11*b* of the cartridge outer tube 10 to prevent the dismount of the support member 70. Note that, the position of the support member 70, at which the bottom portion 74 of the support tube 72 comes to contact with the step portion 17*d* and the position of the support tube 72 in the tip-end storing hole 17*a* is defined, is defined as the rearward limit position of the support member 70.

The plurality of protrusions 73 provided on the outer circumferential surface of the support tube 72 are pressed into contact with the inner circumferential surface of the sliding opening portion 17*g* of the cartridge outer tube 10. Therefore, the support member 70 is prevented from being dismounted from the front end opening 11*a* of the cartridge outer tube 10 by its own weight even when the front end opening 11*a* of the cartridge 2 is directed downward.

After the support member 70 is attached to the cartridge outer tube 10, the liquid cosmetic 4, which has been heated and melted is casted from the front end opening 11*a* of the cartridge outer tube 10 into the sliding opening portion 17*g*, and then, the cosmetic 4 is cooled and solidified. The cosmetic 4 is solidified to form a cosmetic core bar. The cosmetic 4 is fixedly adhered to the inner circumferential surface of the support tube 72 and an inner circumferential surface of the rod shaft portion 75. Because the cosmetic 4 is adhered not only to the support tube 72, but also to the inner circumferential surface of the rod shaft portion 75, an adhesion force of the cosmetic 4 to the support member 70 can be improved.

As described above, the small gap is formed between the outer circumferential surface of the support tube 72 and the inner circumferential surface of the sliding opening portion 17*g*. Therefore, when the cosmetic 4 is filled from the front end opening 11*a* into the sliding opening portion 17*g*, it is possible to allow the air to escape also in the rearward direction. As a result, the molten liquid cosmetic 4 can be casted into the sliding opening portion 17*g* smoothly, and it is possible to reduce a processing time. In addition, it is possible to prevent formation of cavities (blowholes) caused by residual air within the cosmetic.

The cosmetic 4 that is filled into the cartridge outer tube 10 with such a method tends to be of a soft type such as a gel material. Therefore, when the user uses the cartridge-type cosmetic container 100, there is a risk in that the cosmetic core is broken if the cosmetic 4 is extended out too much from the front end opening 11*a*. Thus, according to this embodiment, the pitch of the external thread 61*a* of the push rod 60 is set such that the movement of the push rod 60 can be finely adjusted, and thereby, the cosmetic 4 is prevented from being extended out too much from the front end opening 11*a* when the user uses the cartridge-type cosmetic container 100.

The cartridge 2 is sold as a unit of the cartridge 2 holding the cosmetic 4 in a state in which the cap 3 is attached to the cartridge outer tube 10 that receives the inserted support member 70 and stores the cosmetic 4 (see FIG. 4A). In addition, the cartridge-type cosmetic container 100 formed by attaching the cartridge 2 to the cartridge holder 1 may also be sold (see FIGS. 1A and 1B). Furthermore, the cartridge holder 1 may also be sold as a unit.

The cartridge holder 1 that is used by attaching the cartridge 2 will be described in detail with reference to FIGS. 7A to 14C. Here, as shown in FIGS. 7A to 7C, a position of the push rod 60 in a state before the cartridge 2 is attached to the body tube 20 of the cartridge holder 1 is referred to as "an initial position".

Figure 7A:
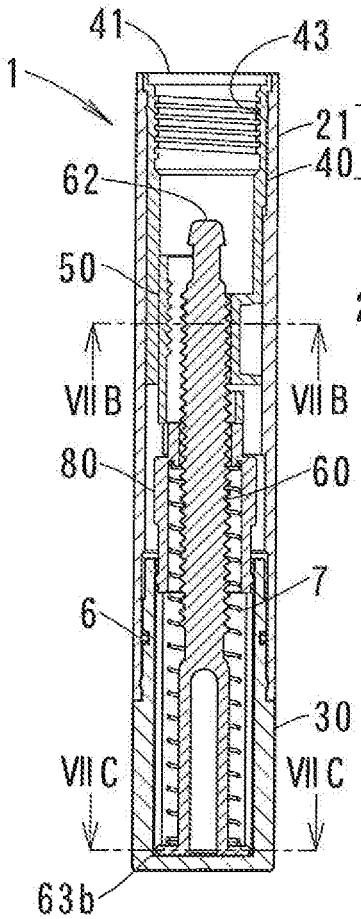
FIG. 7A is a front sectional view of a cartridge holder.
Figure 7B:
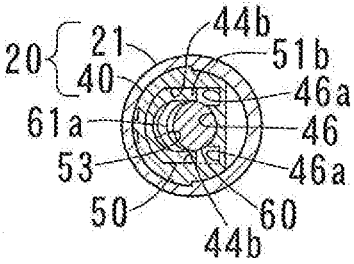
FIG. 7B is a sectional view taken along VIIB-VIIB in FIG. 7A.
Figure 7C:
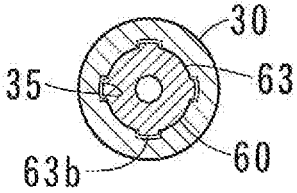
FIG. 7C is a sectional view taken along VIIC-VIIC in FIG. 7A.
Figure 8B:
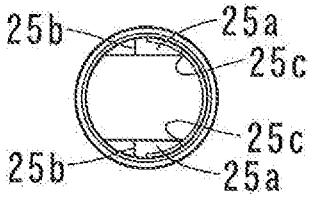
FIG. 8B is a plan view of the body outer tube shown in FIG. 8A viewed from the front side.
Figure 8D:
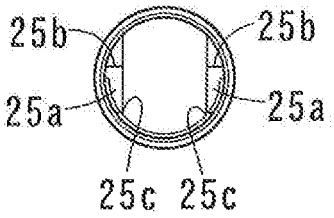
FIG. 8D is a plan view of the body outer tube shown in FIG. 8C viewed from the front side.
Figure 8A:
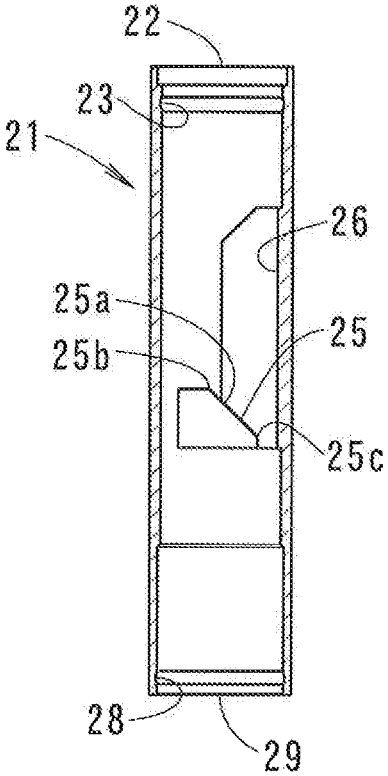
FIG. 8A is a front sectional view of a body outer tube.
Figure 8C:
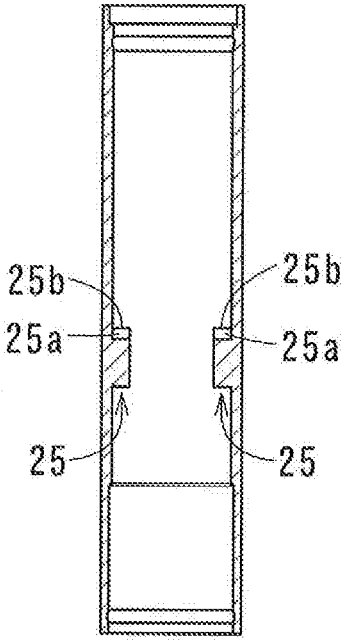
FIG. 8C is a side sectional view of the body outer tube.

As shown in FIGS. 7A to 7C, the body tube 20 is provided with a body outer tube 21 to which the driving body 30 is attached so as to be relatively rotatable and a body inner tube 40 that is inserted inside the body outer tube 21.

As shown in FIGS. 8A to 8D, the body outer tube 21 is formed to have a substantially cylindrical shape having a front end opening 22 and a rear end opening 29. The body inner tube 40 (see FIGS. 9A to 9G) is inserted inside the body outer tube 21 through the front end opening 22. The driving body 30 (see FIGS. 11A to 11C) is inserted inside the body outer tube 21 through the rear end opening 29.

The body outer tube 21 has an annular fitting recess 23 formed in an inner circumference in the vicinity of the front end opening 22. The annular fitting recess 23 is fitted to the body inner tube 40. The body outer tube 21 has an annular fitting recess 28 formed in the inner circumference in the vicinity of the rear end opening 29. The annular fitting recess 28 is fitted to the driving body 30 so as to be relatively rotatable.

The body outer tube 21 is provided with, in the inner circumference thereof, proximity guide portions (first guide portions) 25 and a guide wall portion 26. The proximity guide portions 25 are formed at substantially the center of the body outer tube 21 in the axial direction so as to protrude radially inward. The guide wall portion 26 is formed over a region from substantially the center between the front end opening 22 and the proximity guide portions 25 to the proximity guide portions 25 so as to protrude radially inward.

The guide wall portion 26 engages with a below-mentioned guide portion 45 that is provided in an outer circumference of the body inner tube 40 (see FIGS. 9A to 9G). A position of the body inner tube 40 in the circumferential direction with respect to the body outer tube 21 is defined by the guide wall portion 26 and the guide portion 45, and at this position, the relative rotation between the body outer tube 21 and the body inner tube 40 is prohibited. As described above, when the body inner tube 40 is inserted inside the body outer tube 21, the guide wall portion 26 guides the body inner tube 40 such that the rotation is prohibited.

A pair of proximity guide portions 25 are provided so as to face each other in the radial direction. The proximity guide portions 25 respectively have inclined surfaces 25*a* that are inclined with respect to the axial direction. When the cartridge outer tube 10 is attached to the body tube 20, the inclined surfaces 25*a* of the proximity guide portions 25 come to contact with rear end surfaces 55*b* of below-mentioned blade portions 55 of the internal thread member 50 (see FIGS. 10A to 10E). Because the inclined surfaces 25*a* are inclined with respect to the axial direction, the internal thread member 50 moves in the axial direction together with the cartridge outer tube 10, and at the same time, moves toward the center in the radial direction.

Figure 11B:
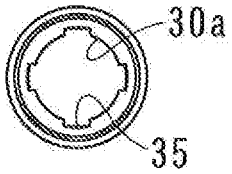
FIG. 11B is a plan view of the driving body viewed from the front side.
Figure 11A:
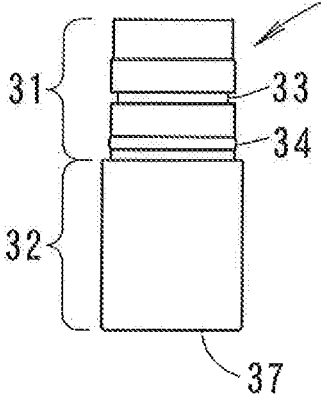
FIG. 11A is a front view of a driving body.
Figure 11C:
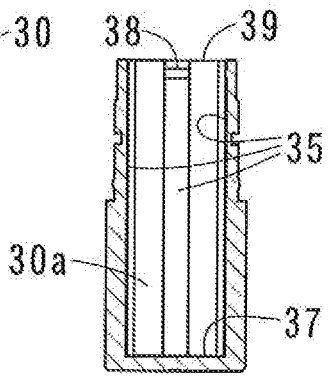
FIG. 11C is a front sectional view of the driving body.

As shown in FIGS. 11A to 11C, the driving body 30 is formed to have a bottomed substantially cylindrical shape having an open front end and a rear end closed with the bottom portion 37 so as to have a circular opening portion 30*a* that extends in the forward and rearward directions. The driving body 30 has a fitting portion 31 that is fitted into the body outer tube 21 and a knob portion 32 that is formed continuously from the fitting portion 31 and that is used by being pinched by the user.

The fitting portion 31 is formed to have a substantially cylindrical shape. In an outer circumference of the fitting portion 31 in the vicinity of a base end thereof (in the vicinity of the knob portion 32), a fitting projection 34 that fits into the fitting recess 28 of the body outer tube 21 (see FIGS. 8A to 8D) is formed so as to have an annular shape. In addition, an annular O-ring groove 33 is formed in the outer circumference of the fitting portion 31 on the front side of the fitting projection 34. By attaching an O-ring 6 into the O-ring groove 33 (see FIGS. 7A to 7C), it is possible to provide an adequate resistance to the relative rotation between the body outer tube 21 and the driving body 30, and thereby, it is possible to improve an operational feeling experienced by the user.

The knob portion 32 is formed have a larger diameter than the fitting portion 31. The knob portion 32 is formed to have the diameter substantially the same as the outer diameter of the body outer tube 21. With such a configuration, when the driving body 30 is assembled to the body outer tube 21, the outer circumferential surface of the body outer tube 21 becomes substantially flush with the outer circumferential surface of the knob portion 32 (see FIGS. 7A to 7C).

The driving body 30 is provided with a plurality of grooves 35 that engage with the push rod 60 so as to prohibit the relative rotation therebetween.

The grooves 35 are provided in an inner circumferential surface of the opening portion 30*a* so as to extend in the axial direction from the bottom portion 37 of the driving body 30 to a front end opening 39. As the grooves 35 engage with ribs 63*b* of a flange part 63 of the push rod 60, which will be described later (see FIGS. 12A to 12C), the relative rotation between the driving body 30 and the push rod 60 is prohibited. In this embodiment, four grooves 35 are provided.

Figure 12B:
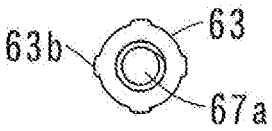
FIG. 12B is a plan view of the push rod viewed from the front side.
Figure 12A:
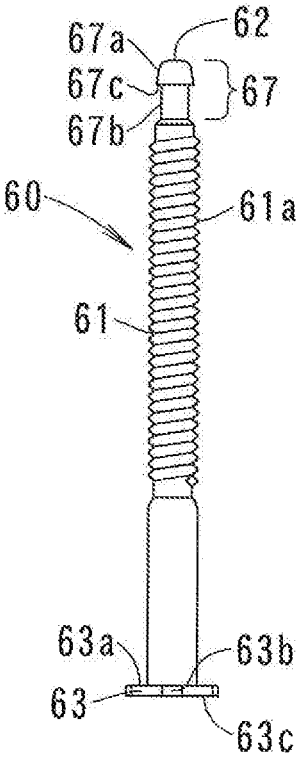
FIG. 12A is a front view of a push rod.
Figure 12C:
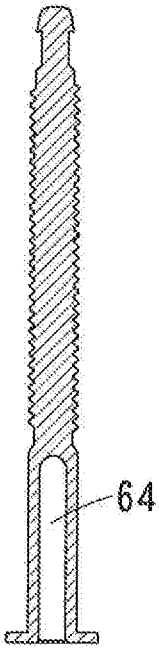
FIG. 12C is a front sectional view of the push rod.

As shown in FIGS. 12A to 12C, the push rod 60 is formed to have a substantially cylindrical column shape. The push rod 60 is received within the body tube 20 and the driving body 30 (see FIGS. 7A to 7C). The push rod 60 has a rod shaft 61 that is provided coaxially with respect to the body tube 20 and the driving body 30, the top surface 62 that is provided on the one end of the rod shaft 61, the flange part 63 that is provided on the other end of the rod shaft 61, and a cavity portion 64 that is provided so as to be depressed from the flange part 63 in the axial direction.

An outer circumference of the rod shaft 61 is formed with the external thread 61*a* with which the internal thread 53 of the internal thread member 50 is threaded (see FIGS. 10A to 10E). The cosmetic 4 stored in the cartridge 2 (see FIGS. 1A to 3) is use by being pushed out by small amounts. Thus, the pitch of the external thread 61*a* is set such that the movement of the push rod 60 can be finely adjusted.

As the push rod 60 is fed out in the forward direction by the relative rotation between the body tube 20 and the driving body 30, the top surface 62 of the push rod 60 pushes the support member 70 to cause the cosmetic 4 in the cartridge outer tube 10 to be pushed out from the front end opening 11*a*. The top surface 62 of the push rod 60 comes to contact with the abutting part 76 of the support member 70 of the cartridge 2 (see FIGS. 6A to 6D) between a state before starting usage (see FIGS. 1A, 1B) and a usage-limited state in which the push rod 60 is fed out to the maximum extent (see FIG. 3). Therefore, a stroke (moved distance) of the push rod 60 from the rearward limit position to a forward limit position becomes equal to the stroke (moved distance) of the support member 70 from the rearward limit position to the forward limit position. Note that, in a state before starting usage (see FIGS. 1A and 1B), there may be a small gap between the top surface 62 of the push rod 60 and the abutting part 76 of the support member 70. In this case, the stroke (moved distance) of the push rod 60 from the rearward limit position to the forward limit position becomes longer than the stroke (moved distance) of the support member 70 from the rearward limit position to the forward limit position.

The flange part 63 is formed to have a circular plate shape having a larger diameter than the rod shaft 61. The flange part 63 has a spring mounting surface 63*a* on which the coil spring 7 is mounted and a rear end surface 63*c* that is formed on the other side of the spring mounting surface 63*a*. The flange part 63 moves in the driving body 30 in the axial direction (see FIGS. 1A to 3).

An outer circumference of the flange part 63 is formed with the plurality of ribs 63*b* that slidably engage with the grooves 35 of the driving body 30 (see FIGS. 7C and 11A to 11C). As described above, as the ribs 63*b* engage with the grooves 35 of the driving body 30, the relative rotation between the push rod 60 and the driving body 30 is prohibited. Thus, when the user pinches and rotates the knob portion 32 of the driving body 30, the push rod 60 is rotated in synchronization with the driving body 30.

The tip end of the push rod 60 is provided with the clamp-fitted portion 67 that is linked to the bendable pieces 77 of the support member 70 of the cartridge 2 (see FIGS. 6A to 6D). In this embodiment, the linking portion 99 is formed of the bendable pieces 77 that are provided on the base end of the support member 70 and the clamp-fitted portion 67 that is provided on the tip end of the push rod 60 (see FIGS. 1A to 3).

The clamp-fitted portion 67 has a cylindrical column portion 67*b* having a cylindrical column shape and a head portion 67*a* having a truncated cone shape. A diameter of the cylindrical column portion 67*b* is smaller than a diameter of the rod shaft 61 and is also smaller than a diameter of a bottom surface of the head portion 67*a*. Because the diameter of the bottom surface of the head portion 67*a* is larger than the diameter of the cylindrical column portion 67*b*, the bottom surface of the head portion 67*a* is formed as a step portion 67*c*. A method of linking the tip end of the push rod 60 and the base end of the support member 70 and a method of releasing the link therebetween will be described below.

Figure 13:
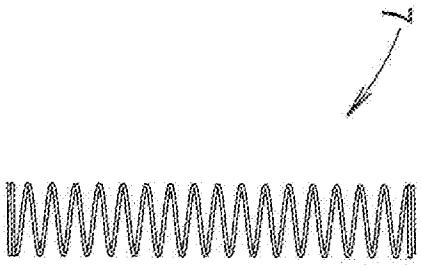
FIG. 13 is a front view of a coil spring.

As shown in FIGS. 7A to 7C, the coil spring 7 is arranged between the flange part 63 of the push rod 60 and the cushion member 80, and the push rod 60 is inserted inside the coil spring 7. As shown in FIG. 13, the coil spring 7 is a helically formed elastic member, and its equilibrium length is longer than a distance between the spring mounting surface 63*a* of the push rod 60 and a recessed spring bearing portion 83 of the cushion member 80 in an initial state shown in FIGS. 1A and 1B.

In a state in which the cartridge 2 is attached to the cartridge holder 1, the distance between the spring mounting surface 63*a* of the push rod 60 and the recessed spring bearing portion 83 of the cushion member 80 is the longest in the initial state shown in FIGS. 1A and 1B, and the distance becomes shorter as the push rod 60 is fed out in the forward direction. In other words, as shown in FIGS. 1A to 3, in a state in which the cartridge 2 is attached to the cartridge holder 1, the coil spring 7 is in a compressed state, and the push rod 60 and the cushion member 80 are biased by the coil spring 7 in the directions in which the flange part 63 and the cushion member 80 move away from each other. Note that, the equilibrium length (free length) of an elastic body means the length of the elastic body in a state in which no load is exerted on the elastic body.

Figure 14B:
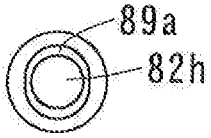
FIG. 14B is a plan view of the cushion member viewed from the front side.
Figure 14A:
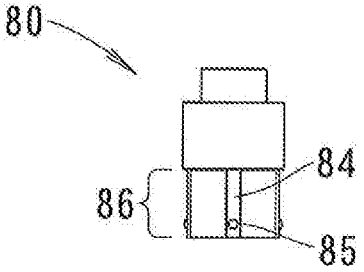
FIG. 14A is a front view of a cushion member.
Figure 14C:
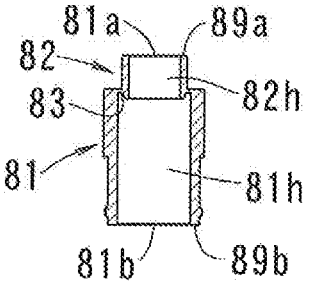
FIG. 14C is a front sectional view of the cushion member.

As shown in FIGS. 14A to 14C, the cushion member 80 has a first cylindrical portion 81 having a cylindrical shape and a second cylindrical portion 82 having a cylindrical shape with a diameter smaller than that of the first cylindrical portion 81. The first cylindrical portion 81 has a circular through hole 81*h* having a diameter substantially the same as the diameter of the coil spring 7, and a rear-end portion of the second cylindrical portion 82 is positioned at a front-end portion of the through hole 81*h*. The second cylindrical portion 82 has a circular through hole 82*h* having a diameter substantially the same as the outer diameter of the rod shaft 61 of the push rod 60. The through hole 82*h* of the second cylindrical portion 82 is communicated with the through hole 81*h* of the first cylindrical portion 81, and the push rod 60 is inserted into the through hole 81*h* and the through hole 82*h*.

The second cylindrical portion 82 is connected to a front end of the first cylindrical portion 81. The first cylindrical portion 81 is provided with, at a rear part thereof, a fitting portion 86 that is fitted to the driving body 30. A front part of the first cylindrical portion 81 is received within the body outer tube 21 (see FIGS. 8A to 8D) in a state in which the first cylindrical portion 81 is protruded out from the front end opening 39 of the driving body 30 (see FIGS. 11A to 11C).

The recessed spring bearing portion 83 is formed between an outer circumferential edge portion of a rear end of the second cylindrical portion 82 and an inner circumferential surface of a front end of the first cylindrical portion 81, and one end of the coil spring 7 is arranged in the recessed spring bearing portion 83. A biasing force exerted by the coil spring 7 is applied to the recessed spring bearing portion 83, and thereby, the cushion member 80 is biased in the direction in which the cushion member 80 moves away from the flange part 63 of the push rod 60 (in the direction toward a front end opening 41 of the body inner tube 40).

An outer circumference of the fitting portion 86 is provided with a plurality of ribs 84 that extend in the axial direction over the entire length of the fitting portion 86 in the axial direction and protrusions 85 that are formed so as to protrude radially outward from the ribs 84.

The ribs 84 slidably engage with the grooves 35 of the driving body 30 (see FIGS. 11A to 11C) and prohibit the relative rotation between the driving body 30 and the cushion member 80. Thus, when the user pinches and rotates the driving body 30, the cushion member 80 is rotated in synchronization with the rotation of the driving body 30. Because the ribs 84 engage with the grooves 35 that extend in the axial direction, a movement of the cushion member 80 in the axial direction with respect to the driving body 30 is not restricted.

As shown in FIGS. 11A to 11C, a protrusion 38 is formed on an inner surface of the grooves 35 in the vicinity of the front end opening 39 of the driving body 30. As the fitting portion 86 is inserted into the driving body 30, the protrusions 85 of the cushion member 80 move over the protrusion 38 of the grooves 35.

In a state in which the fitting portion 86 is inserted into the driving body 30, the protrusions 85 are positioned at opposite side of the front end opening 39 of the driving body 30 with respect to the protrusion 38 of the driving body 30. Therefore, as the cushion member 80 is moved in the direction in which the cushion member 80 is pulled out from the driving body 30, the protrusions 85 of the cushion member 80 are locked by the protrusion 38 of the driving body 30 such that the cushion member 80 is prevented from being pulled out from the driving body 30.

As shown in FIGS. 9A to 9G the body inner tube 40 is formed to have a substantially cylindrical shape having the front end opening 41 and a rear end opening 48. The fitting portion 16 of the cartridge outer tube 10 (see FIGS. 4A to 4D and FIGS. 5A to 5D) is inserted inside the body inner tube 40 from the front end opening 41. The internal thread member 50 (see FIGS. 10A to 10E) is inserted inside the body inner tube 40 from the rear end opening 48.

The body inner tube 40 has the internal thread 43 that is formed in the axial direction from the front end opening 41 in an inner circumference of the body inner tube 40, the guide portion 45 that is formed to have a recessed shape in the outer circumference of the body inner tube 40, and separation guide portions (second guide portions) 44 that are formed in the inner circumference in the vicinity of the rear end opening 48. The body inner tube 40 has an annular fitting projection 42 in the outer circumference in the vicinity of the front end opening 41, and this annular fitting projection 42 is fitted to the fitting recess 23 of the body outer tube 21 (see FIGS. 8A to 8D).

The internal thread 43 is formed so as to corresponds to the external thread 15 of the cartridge outer tube 10 (see FIGS. 4A to 4D and FIGS. 5A to 5D). As the internal thread 43 is threaded with the external thread 15, the cartridge outer tube 10 is fixed to the body inner tube 40 (see FIGS. 1A to 3).

The guide portion 45 is provided so as to extend in the axial direction from a rear end surface 47 of the body inner tube 40. The guide portion 45 is formed at a position corresponding to the guide wall portion 26 of the body outer tube 21 (see FIGS. 8A to 8D) and engages with the guide wall portion 26. With such a configuration, the relative rotation between the body outer tube 21 and the body inner tube 40 is prohibited.

A pair of separation guide portions 44 are formed in so as to correspond to the proximity guide portions 25 of the body outer tube 21 (see FIGS. 8A to 8D). The separation guide portions 44 are formed so as to be in parallel with the proximity guide portions 25. The separation guide portions 44 are positioned toward the front end opening 22 of the body outer tube 21 than the proximity guide portions 25 such that a predetermined gap is formed with the proximity guide portions 25. This gap is formed to have a size that allows insertion of the blade portions 55 of the internal thread member 50, which will be described later (see FIGS. 10A to 10E).

Each of the separation guide portions 44 is formed to have a projected shape projecting radially inward and has an inclined surface 44*a* that is inclined with respect to the axial direction and a side surface 44*b* that extends along the axial direction.

The inclined surfaces 44*a* of the separation guide portions 44 respectively come to contact with front end surfaces 55*a* of the blade portions 55 of the internal thread member 50 when the cartridge outer tube 10 is detached from the body tube 20 and the internal thread member 50 is moved in the axial direction by the biasing force exerted by the coil spring 7. Because the inclined surfaces 44*a* are inclined with respect to the axial direction, the internal thread member 50 is moved forward in the axial direction by the biasing force exerted by the coil spring 7, and at the same time, moved in the radial direction so as to move away from the center while.

The body inner tube 40 has a protruding wall portion 46 that protrudes out from an inner circumferential surface of the body inner tube 40 and step portions 49 that are provided in the inner circumference of the body inner tube 40. The protruding wall portion 46 is formed so as to protrude radially inward. Recessed portions 46*a* are formed on both sides of the protruding wall portion 46 in the circumferential direction. The step portions 49 are formed by the separation guide portions 44 and are positioned on opposite sides of the inclined surfaces 44*a*.

As shown in FIGS. 7A to 7C and FIGS. 10A to 10E, the internal thread member 50 has a main body portion 51 that is arranged so as to cover a part of an outer circumferential surface of the push rod 60 in the circumferential direction and an insertion portion 52 that has a hole 52*a* into which the push rod 60 is inserted. A part of the insertion portion 52 is formed so as to be continuous with the main body portion 51 in the axial direction.

As shown in FIGS. 7A to 7C, the above-described cushion member 80 is arranged between the internal thread member 50 and the coil spring 7 within the body outer tube 21. A front end surface (a front end surface of the second cylindrical portion 82) 89*a* of the cushion member 80 (see FIGS. 14A to 14C) comes to contact with a rear end surface (a rear end surface of the insertion portion 52) 50*b* of the internal thread member 50 (see FIGS. 10A to 10E), and the recessed spring bearing portion 83 of the cushion member 80 comes to contact with a front end of the coil spring 7. Therefore, the internal thread member 50 is biased forward in the axial direction by the coil spring 7 via the cushion member 80. As the biasing force exerted by the coil spring 7 is applied to the rear end surface 50*b* of the internal thread member 50 via the cushion member 80, the internal thread member 50 is biased together with the cushion member 80 in the direction in which the internal thread member 50 moves away from the flange part 63 of the push rod 60 (in the direction toward the front end opening 41 of the body inner tube 40).

As shown in FIGS. 1A and 1B, a front end surface (a front end surface of the main body portion 51) 50*a* of the internal thread member 50 (see FIGS. 10A to 10E) comes to contact with a rear end surface (a rear end surface of the fitting portion 16) 19*b* of the cartridge outer tube 10 (see FIGS. 4A to 4D and FIGS. 5A to 5D) in a state in which the cartridge outer tube 10 is attached to the body tube 20. In other words, when the cartridge outer tube 10 is attached to the body tube 20, the internal thread member 50 is pushed by the cartridge outer tube 10 and is moved rearward in the axial direction together with the cushion member 80 and the cartridge outer tube 10 while compressing the coil spring 7 via the cushion member 80.

The coil spring 7 biases the internal thread member 50 via the cushion member 80 forward in the axial direction, in other words, in the direction toward the front end opening 41 of the body inner tube 40 (in the opposite direction from the pushing direction by the cartridge outer tube 10). Thus, when the cartridge outer tube 10 is detached from the body tube 20 and pressure exerted by the cartridge outer tube 10 to the internal thread member 50 is released, the internal thread member 50 is moved forward together with the cushion member 80 by the biasing force exerted by the coil spring 7 in the forward direction.

As shown in FIGS. 10A to 10E, the main body portion 51 has a base portion 51*a* that is formed to have an arc-shaped cross-section and a pair of extended portions 51*b* that extend in parallel with each other from both ends of the base portion 51*a* in the circumferential direction. The extended portions 51*b* are respectively provided with opening end surfaces 56*a* and outer surfaces 56*b*.

The outer surfaces 56*b* of the extended portions 51*b* respectively face with the side surfaces 44*b* of the separation guide portions 44 of the body inner tube 40 (see FIG. 7B). With such a configuration, the relative rotation between the body inner tube 40 and the internal thread member 50 is prohibited.

End portions of the extended portions 51*b* are respectively inserted into the recessed portions 46*a* of the body inner tube 40 such that the opening end surfaces 56*a* face bottom surfaces of the recessed portions 46*a* of the body inner tube 40 (see FIG. 7B). Each of the extended portions 51*b* has a length that allows formation of a predetermined gap between the opening end surface 56*a* and the bottom surface of the recessed portion 46*a* in a state in which the base portion 51*a* is in contact with the inner circumferential surface of the body inner tube 40 (see FIG. 7B). In other words, in a state in which the push rod 60 is not inserted into the insertion portion 52, the internal thread member 50 can move in the radial direction with respect to the body inner tube 40 within a range set by this predetermined gap (see FIG. 7B).

The hole 52*a* of the insertion portion 52 is formed such that its cross-section has a substantially elliptical-shape and the major axis of the substantially elliptical shape extends along the outer surfaces 56*b* of the extended portions 51*b*. Therefore, even in a state in which the push rod 60 is inserted into the insertion portion 52, the internal thread member 50 can be moved in the radial direction.

The internal thread member 50 has protrusions 51*d* that are formed so as to respectively protrude out from outer circumferences of the extended portions 51*b*, the internal thread 53 that is formed in an inner circumference of the base portion 51*a*, and the blade portions 55 that are formed so as to respectively protrude out from outer circumferences of the extended portions 51*b*.

The protrusions 51*d* are formed in the vicinity of the front end surface 50*a*. In a state in which the biasing force exerted by the coil spring 7 is not applied to the internal thread member 50, the protrusions 51*d* are placed on the step portions 49 of the body inner tube 40 (see FIGS. 9A to 9G). With such a configuration, during an assembly process, it is possible to prevent the internal thread member 50 from being dismounted from the rear end opening 48 side of the body inner tube 40, and thereby, the assembly of the cartridge holder 1 is made easier.

The internal thread 53 is formed to have a lead that is equal to a lead of the external thread 61*a* of the push rod 60. As an inner circumferential surface of the base portion 51*a* comes to contact with the rod shaft 61 of the push rod 60, the internal thread 53 is threaded with the external thread 61*a*. As the push rod 60 and the internal thread member 50 are rotated relatively in a state in which the internal thread 53 is threaded with the external thread 61*a*, the push rod 60 is moved rearward and forward in the axial direction with respect to the internal thread member 50.

In the cartridge holder 1, because the main body portion 51 of the internal thread member 50 is formed to have a disconnected shape in the circumferential direction (a non-continuous shape in the circumferential direction), unlike the case in which the internal thread member is formed into a cylindrical shape, an opening is formed between both end portions of the main body portion 51 in the circumferential direction. In a case in which the internal thread is formed in the internal thread member having the cylindrical shape, unscrewing process needs to be performed by rotating a die.

In contrast, according to this embodiment, because the opening is formed between the both end portions of the main body portion 51 in the circumferential direction, when the internal thread member 50 is formed, the die for forming the internal thread 53 can be separated from the opening of the main body portion 51. In other words, according to this embodiment, when the internal thread 53 is formed in the internal thread member 50, it is not required to perform the unscrewing process by rotating the die. Therefore, it is possible to more easily form the internal thread member 50.

In the cartridge holder 1 according to this embodiment, because the main body portion 51 of the internal thread member 50 has the disconnected shape in the circumferential direction and the hole 52*a* of the insertion portion 52 has the substantially elliptical shaped cross-section, it is possible to insert the push rod 60 into the insertion portion 52 in a state in which the external thread 61*a* is separated away from the internal thread 53. In other words, it is possible to insert the push rod 60 into the insertion portion 52 without threading the external thread 61*a* with the internal thread 53. Therefore, when the internal thread member 50 is assembled to the rod shaft 61, it is not required to relatively rotate the push rod 60 and the internal thread member 50. Therefore, regardless of the size of the lead of the external thread 61*a*, it is possible to assemble the internal thread member 50 to the rod shaft 61 of the push rod 60 with ease even in a case in which the lead of the external thread 61*a* is small as described in the embodiment.

The blade portions 55 are inserted between the proximity guide portions 25 of the body outer tube 21 (see FIGS. 8A to 8D) and the separation guide portions 44 of the body inner tube 40 (see FIGS. 9A to 9G). In other words, in a state in which the cartridge holder 1 has been assembled, the blade portions 55 are provided with the front end surfaces 55*a* that face the inclined surfaces 44*a* of the separation guide portions 44 and the rear end surfaces 55*b* that face the inclined surfaces 25*a* of the proximity guide portions 25.

When the cartridge outer tube 10 is attached to the body tube 20, the internal thread member 50 is pushed by the cartridge outer tube 10 and is moved rearward together with the cushion member 80 while compressing the coil spring 7 via the cushion member 80 such that the coil spring 7 is contracted. At this time, the rear end surfaces 55*b* of the blade portions 55 come to contact with the inclined surfaces 25*a* of the proximity guide portions 25 of the body outer tube 21 in a freely slidable manner.

As shown in FIGS. 8A to 8D, in a state in which the cartridge holder 1 has been assembled, the inclined surfaces 25*a* of the proximity guide portions 25 are inclined with respect to the push rod 60 such that end portions 25*b* provided on the internal thread 53 side of the internal thread member 50 are positioned toward the front end opening 22 than end portions 25*c* provided on the opposite side from the internal thread 53. Therefore, when the cartridge outer tube 10 is attached to the body tube 20, the internal thread member 50 is moved rearward in the axial direction by being pushed by the cartridge outer tube 10 and is guided in the direction in which the internal thread 53 approaches the external thread 61*a*. As described above, when the cartridge outer tube 10 is attached to the body tube 20 and the internal thread member 50 is pushed by the cartridge outer tube 10, the proximity guide portions 25 guide the internal thread member 50 in the direction in which the internal thread 53 is threaded with the external thread 61*a*.

As the internal thread member 50 is moved in the direction in which the internal thread 53 is threaded with the external thread 61*a*, the inner circumferential surface of the base portion 51*a* of the internal thread member 50 comes to contact with the rod shaft 61 of the push rod 60 and the internal thread 53 is threaded with the external thread 61*a* (see FIGS. 1A and 1B). In other words, as the internal thread member 50 is pushed by the cartridge outer tube 10 when the cartridge outer tube 10 is attached to the body inner tube 40, the internal thread 53 is threaded with the external thread 61*a* of the rod shaft 61.

Figure 9B:
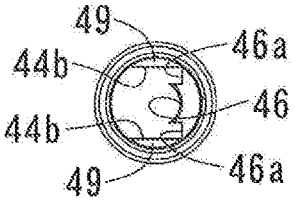
FIG. 9B is a plan view of the body inner tube shown in FIG. 9A viewed from the front side.
Figure 9F:
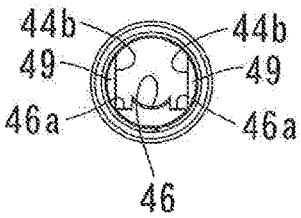
FIG. 9F is a plan view of the body inner tube shown in FIG. 9E viewed from the front side.
Figure 9A:
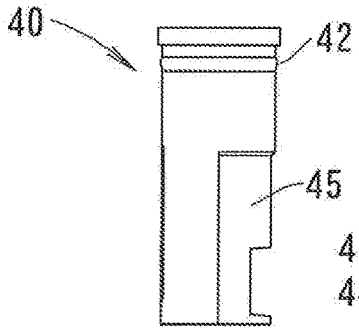
FIG. 9A is a front view of a body inner tube.
Figure 9D:
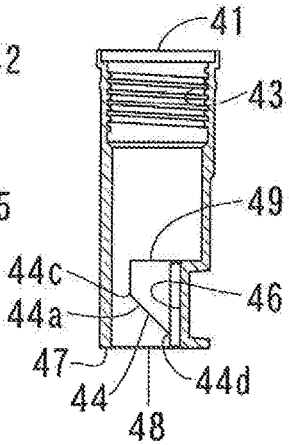
FIG. 9D is a front sectional view of the body inner tube.
Figure 9E:
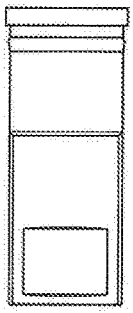
FIG. 9E is a side view of the body inner tube.
Figure 9G:
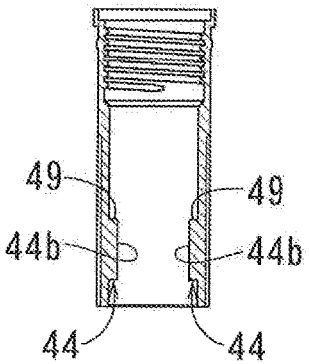
FIG. 9G is a side sectional view of the body inner tube.
Figure 9C:
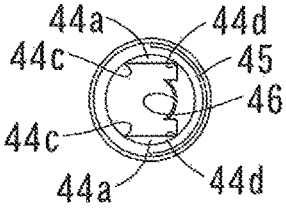
FIG. 9C is a bottom view of the body inner tube.
Figure 10B:
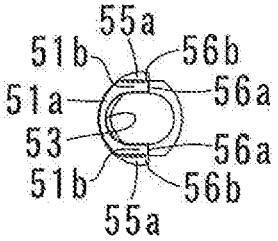
FIG. 10B is a plan view of the internal thread member viewed from the front side.
Figure 10A:
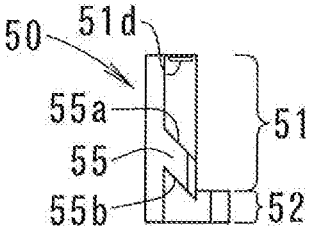
FIG. 10A is a front view of an internal thread member.
Figure 10D:
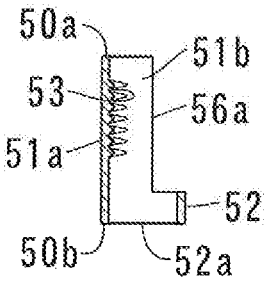
FIG. 10D is a front sectional view of the internal thread member.
Figure 10E:
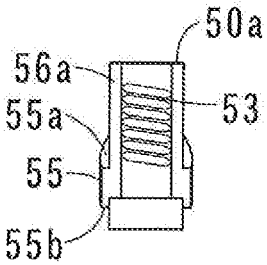
FIG. 10E is a side view of the internal thread member.
Figure 10C:
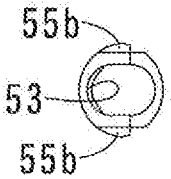
FIG. 10C is a bottom view of the internal thread member.

As shown in FIGS. 9A to 9Q the protruding wall portion 46 of the body inner tube 40 is provided in a region facing the internal thread 53. When the cartridge outer tube 10 is attached to the body tube 20 and the internal thread member 50 is guided by the proximity guide portions 25, the protruding wall portion 46 comes to contact with the rod shaft 61 on the opposite side from the internal thread 53 (see FIGS. 1A and 1B). Therefore, the protruding wall portion 46 restricts the movement of the push rod 60 in the direction in which the threaded state between the internal thread 53 of the internal thread member 50 and the external thread 61*a* of the push rod 60 is released (hereinafter, also referred to as "the threaded-state releasing direction"). In other words, the protruding wall portion 46 restricts the movement of the push rod 60 in the direction away from the internal thread 53.

Because the movement of the push rod 60 in the threaded-state releasing direction is restricted by the protruding wall portion 46, the rod shaft 61 tends not to be moved away from the main body portion 51 of the internal thread member 50, and the threaded state between the external thread 61*a* and the internal thread 53 tends not to be loosened. Therefore, the push rod 60 can more reliably be moved rearward and forward by the relative rotation between the body tube 20 and the driving body 30, and thereby, it is possible to feed the cosmetic 4 out of and back to the cartridge outer tube 10 more reliably.

Note that, it is not necessary to form the protruding wall portion 46 so as to be in contact with the rod shaft 61 all the time in a state in which the cartridge outer tube 10 is attached to the body tube 20, and a gap may be formed between the protruding wall portion 46 and the rod shaft 61 in a state in which the internal thread 53 and the external thread 61*a* are completely threaded. This gap is formed to have a sufficient size to prevent the threaded state between the internal thread 53 and the external thread 61*a* from being released even if the rod shaft 61 is moved in the threaded-state releasing direction.

Because the protruding wall portion 46 is provided in the region facing the internal thread 53, even if the push rod 60 is inclined with respect to the rotation center axis, the rod shaft 61 moves away from the main body portion 51 of the internal thread member 50 only by little amount. Therefore, it is possible to prevent the threaded state between the external thread 61*a* and the internal thread 53 from being released only with the protruding wall portion 46 of the body inner tube 40.

With the cartridge holder 1, because the body inner tube 40 of the body tube 20 has the protruding wall portion 46 that restricts the movement of the push rod 60 in the threaded-state releasing direction, there is no need to provide a plurality of internal thread members 50 when the internal thread 53 of the internal thread member 50 is threaded with the external thread 61*a* of the push rod 60. Because the coil spring 7 biases the single internal thread member 50, unlike the case in which the plurality of internal thread members are used (for example, as in the technique described in Japanese Unexamined Patent Application No. 2014-161637), the internal thread member is prevented from being subjected to the biasing force greater than the normal level. Therefore, even in a state in which peaks of thread ridges of the internal thread 53 of the internal thread member 50 are in contact with peaks of the thread ridges of the external thread 61*a* of the push rod 60, insertion of the cartridge outer tube 10 into the body tube 20 does not become difficult.

Therefore, it is possible to insert the cartridge outer tube 10 to a predetermined position in the body tube 20, and therefore, it is possible to restrict, by the protruding wall portion 46, the movement of the push rod 60 in the threaded-state releasing direction. As a result, the push rod 60 is reliably moved rearward and forward along with the relative rotation between the body tube 20 and the driving body 30, and it is possible to reliably feed the cosmetic 4 out of and back to the cartridge outer tube 10.

If a cartridge-type cosmetic container is provided with a plurality of internal thread members, there may be a case in which one of the internal thread members is deviated from other internal thread members and the internal thread members partially come to contact with each other. In such a case, because a contacting part is subjected to an abnormally large force, it becomes difficult to bring back the plurality of internal thread members to the correct positions simultaneously by the biasing force exerted by a coil spring.

The cartridge holder 1 according to this embodiment is provided with a single internal thread member 50, and thus, the internal thread member 50 is prevented from being subjected to an abnormally large force. Therefore, even if the internal thread member 50 is inclined with respect to the axial direction, it is possible to bring back the internal thread member 50 to the correct position by the biasing force exerted by the coil spring 7. Therefore, it is possible to insert the cartridge outer tube 10 to a predetermined position in the body tube 20, and it is possible to restrict, by the protruding wall portion 46, the movement of the push rod 60 in the threaded-state releasing direction.

When the cartridge outer tube 10 is to be detached from the body tube 20, the internal thread member 50 is moved forward in the axial direction together with the cushion member 80 by the biasing force exerted by the coil spring 7. At this time, the front end surfaces 55*a* of the blade portions 55 (see FIGS. 10A to 10E) come to contact with the inclined surfaces 44*a* of the separation guide portions 44 of the body inner tube 40 (see FIGS. 9A to 9G) in a freely slidable manner.

As shown in FIGS. 9A to 9G in a state in which the cartridge holder 1 has been assembled, the inclined surfaces 44*a* of the separation guide portions 44 are inclined with respect to the push rod 60 such that an end portion 44*c* on the side of the internal thread 53 of the internal thread member 50 is positioned toward the front end opening 41 than an end portion 44*d* on the opposite side of the internal thread 53. Therefore, when the cartridge outer tube 10 is to be detached from the body tube 20, the internal thread member 50 is moved forward in the axial direction by being biased by the coil spring 7 via the cushion member 80 and is guided in the direction in which the internal thread 53 separates away from the external thread 61*a*. As described above, the separation guide portions 44 guides the internal thread member 50 in the direction in which the threaded state between the internal thread 53 and the external thread 61*a* is released when the pushing force exerted to the internal thread member 50 by the cartridge outer tube 10 is released.

As the internal thread 53 moves away from the external thread 61*a* and the threaded state between the internal thread 53 and the external thread 61*a* is released, regardless of the relative rotation between the push rod 60 and the internal thread member 50, the push rod 60 is allowed to be moved in the axial direction with respect to the internal thread member 50 when a force is applied. Therefore, by detaching the cartridge outer tube 10 from the body tube 20, it is possible to move the push rod 60 to the initial position (see FIGS. 7A to 7C) with ease.

The coil spring 7 biases the push rod 60 in the direction in which the flange part 63 moves away from the internal thread member 50, in other words, the coil spring 7 biases the push rod 60 rearward in the axial direction. Therefore, for example, when the cosmetic 4 is used up (see FIG. 3) and the cartridge outer tube 10 is detached from the body tube 20, the threaded state between the internal thread 53 and the external thread 61*a* is released, and the push rod 60 is moved rearward in the axial direction by the biasing force exerted by the coil spring 7. Therefore, it is possible to reliably move the push rod 60 to the initial position (see FIGS. 7A to 7C).

Assembling procedures of the cartridge holder 1 will be described with reference to FIGS. 7A to 14C.

First of all, the front end surface 50*a* of the internal thread member 50 is inserted through the rear end opening 48 of the body inner tube 40, and thereby, the internal thread member 50 is inserted inside the body inner tube 40. At this time, the recessed portions 46*a* are engaged with the extended portions 51*b* of the internal thread member 50 such that the bottom surfaces of the recessed portions 46*a* of the body inner tube 40 face the opening end surfaces 56*a* of the internal thread member 50 (see FIG. 7B).

As the internal thread member 50 is further inserted inside the body inner tube 40, the protrusions 51*d* of the internal thread member 50 move over the step portions 49 of the body inner tube 40. By inserting the internal thread member 50 into the body inner tube 40 until the protrusions 51*d* move over the step portions 49, it is possible to prevent the internal thread member 50 from being dismounted from the rear end opening 48 of the body inner tube 40.

Next, the rear end surface 47 of the body inner tube 40 to which the internal thread member 50 has been assembled is inserted through the front end opening 22 of the body outer tube 21, and thereby, the body inner tube 40 and the internal thread member 50 are inserted inside the body outer tube 21. At this time, the guide portion 45 of the body inner tube 40 and the guide wall portion 26 of the body outer tube 21 are aligned. As the body inner tube 40 is further inserted inside the body outer tube 21, the fitting recess 23 of the body outer tube 21 is fitted to the fitting projection 42 of the body inner tube 40, and thereby, the body inner tube 40 is assembled to the body outer tube 21.

By inserting the body inner tube 40 into the body outer tube 21, the blade portions 55 of the internal thread member 50 are placed between the proximity guide portions 25 of the body outer tube 21 and the separation guide portions 44 of the body inner tube 40. As described above, because the body tube 20 has the body outer tube 21 and the body inner tube 40 that is received in the body outer tube 21 and that is rotated in synchronization with the body outer tube 21, it is possible to place the blade portions 55 of the internal thread member 50 between the proximity guide portions 25 of the body outer tube 21 and the separation guide portions 44 of the body inner tube 40 with ease.

Next, the push rod 60 is inserted inside the coil spring 7 from the top surface 62 side of the push rod 60, and thereby, the coil spring 7 is mounted on the spring mounting surface 63*a* of the push rod 60. Thereafter, the push rod 60 is inserted inside the driving body 30. At this time, the ribs 63*b* of the flange part 63 are engaged with the grooves 35 of the driving body 30 (see FIG. 7C).

Next, the top surface 62 of the push rod 60 is inserted through a rear end opening 81*b* and a front end opening 81*a* of the cushion member 80, in this order, and thereby, the push rod 60 is inserted into the cushion member 80. In a state in which the push rod 60 is inserted into the cushion member 80, a rear end surface 89*b* of the cushion member 80 is inserted through the front end opening 39 of the driving body 30, and the fitting portion 86 of the cushion member 80 is inserted into the opening portion 30*a* of the driving body 30.

By inserting the cushion member 80 into the driving body 30 until the protrusions 85 of the cushion member 80 move over the protrusion 38 of the driving body 30, the protrusions 85 and the protrusion 38 are locked, and thereby, the cushion member 80 tends not to be pulled out from the driving body 30. With such a configuration, the coil spring 7 is sandwiched between the spring mounting surface 63*a* of the push rod 60 and the recessed spring bearing portion 83 of the cushion member 80, and thereby, it is possible to prevent the coil spring 7 from flying out from the driving body 30.

The O-ring 6 is attached to the O-ring groove 33 of the driving body 30. Note that, the O-ring 6 may be attached to the O-ring groove 33 before the push rod 60 is inserted inside the driving body 30, or the O-ring 6 may be attached to the O-ring groove 33 after the push rod 60 is inserted inside the driving body 30.

Next, the top surface 62 of the push rod 60, the cushion member 80, and a tip end of the driving body 30 are inserted through the rear end opening 29 of the body outer tube 21, and then, the fitting portion 31 of the driving body 30 is inserted inside the body outer tube 21. As shown in FIGS. 7A to 7C, by fitting the fitting projection 34 of the driving body 30 to the fitting recess 28 of the body outer tube 21, the driving body 30 is assembled to the body outer tube 21.

At this time, because the cartridge 2 is not attached to the cartridge holder 1, the internal thread member 50 is separated away from the proximity guide portions 25 of the body outer tube 21 by the biasing force exerted by the coil spring 7 and is in contact with the separation guide portions 44 of the body inner tube 40. The internal thread member 50 is guided by the separation guide portions 44 in the direction in which the internal thread 53 moves away from the external thread 61*a*, and the internal thread 53 is not threaded with the external thread 61*a*. Therefore, regardless of the relative rotation between the push rod 60 and the internal thread member 50, the push rod 60 is moved in the axial direction with respect to the internal thread member 50 when a force is applied.

The push rod 60 is biased rearward in the axial direction (the feed-back direction) by the coil spring 7. Therefore, in a state in which the rear end surface 63*c* of the push rod 60 is in contact with an inner surface of the bottom portion 37 of the driving body 30, the push rod 60 is received inside the body tube 20 and the driving body 30.

By the above-described procedure, the cartridge holder 1 is finished.

A procedure of attaching the cartridge 2 to the cartridge holder 1 will be described with reference to FIGS. 1A, 1B, 4A to 4D, and 7A to 7C.

First of all, the rear end surface 19*b* of the cartridge outer tube 10 is inserted through the front end opening 41 of the body inner tube 40 of the cartridge holder 1, and thereby, the fitting portion 16 of the cartridge outer tube 10 is inserted inside the body inner tube 40. As the fitting portion 16 is inserted inside the body inner tube 40 while causing the external thread 15 of the cartridge outer tube 10 to be threaded with the internal thread 43 of the body inner tube 40, the rear end surface 19*b* of the cartridge outer tube 10 pushes the front end surface 50*a* of the internal thread member 50, and the rear end surface 50*b* of the internal thread member 50 pushes the front end surface 89*a* of the cushion member 80.

The cushion member 80 is moved in the axial direction while compressing the coil spring 7 such that the coil spring 7 is contracted. As a result, the internal thread member 50 is moved in the axial direction.

By the movement of the internal thread member 50, the front end surfaces 55*a* of the blade portions 55 of the internal thread member 50 are separated away from the inclined surfaces 44*a* of the separation guide portions 44 of the body inner tube 40, and at the same time, the rear end surfaces 55*b* of the blade portions 55 come to contact with the inclined surfaces 25*a* of the proximity guide portions 25 of the body outer tube 21. Because the proximity guide portions 25 guides the internal thread member 50 in the direction in which the internal thread 53 of the internal thread member 50 approaches the external thread 61*a*, the internal thread member 50 is reversed, and the internal thread 53 is threaded with the external thread 61*a*.

Because the protruding wall portion 46 restricts the movement of the push rod 60 in the threaded-state releasing direction, even if the internal thread member 50 approaches the push rod 60 by the proximity guide portions 25 of the body outer tube 21 and the push rod 60 is pushed by the internal thread member 50, the push rod 60 is not moved. Therefore, the threaded state between the external thread 61*a* and the internal thread 53 tends not to be loosened.

As described above, attachment of the cartridge 2 to the cartridge holder 1 is completed, and the cartridge-type cosmetic container 100 is finished (see FIGS. 1A and 1B).

Figure 3:
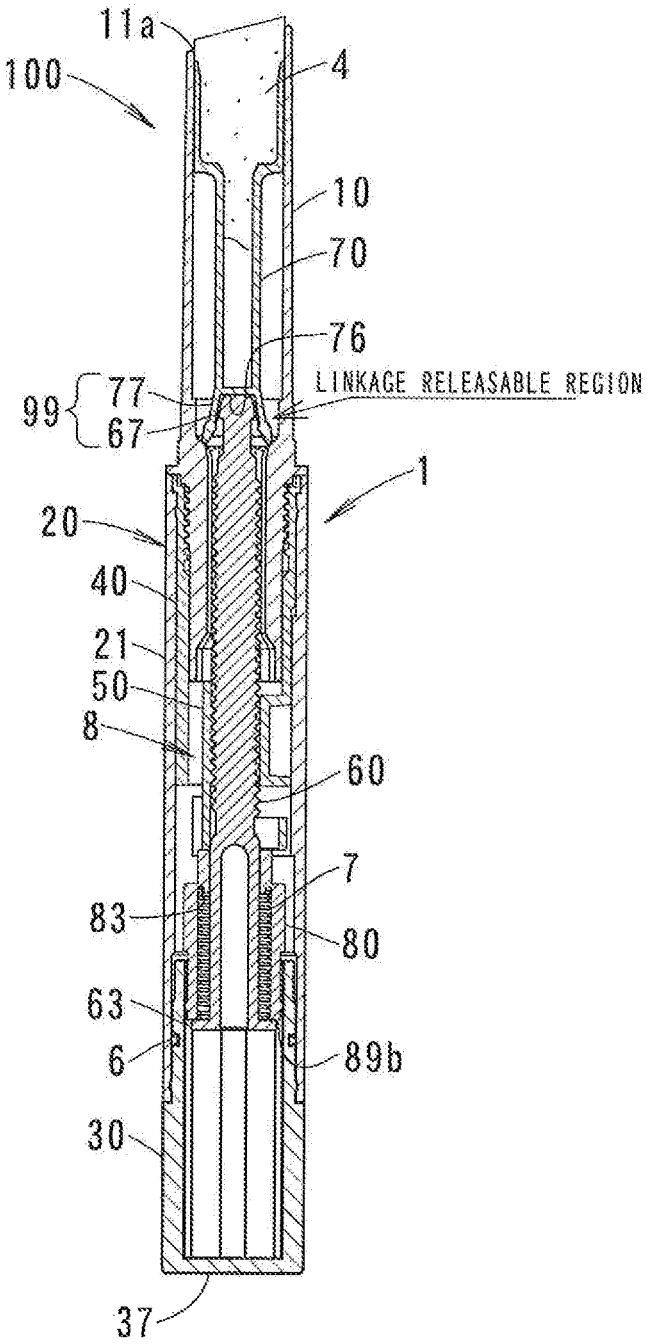
FIG. 3 is a front sectional view showing a state in which the push rod of the cartridge-type cosmetic container according to the first embodiment of the present invention is positioned at the forward limit position.

A method of using the cartridge-type cosmetic container 100 will be described with main reference to FIGS. 1A to 3. FIGS. 1A and 1B show a state before using the cartridge holder 1 and show the cartridge-type cosmetic container 100 in a state in which the push rod 60 is positioned at the rearward limit position. FIG. 3 shows the cartridge-type cosmetic container 100 in a state in which the push rod 60 is positioned at the forward limit position. FIGS. 2A and 2B show the cartridge-type cosmetic container 100 in a state in which the push rod 60 is positioned at a feed-out intermediate position.

As shown in FIGS. 1A and 1B, in a state in which the push rod 60 is positioned at the rearward limit position, the linking portion 99 of the tip end of the push rod 60 and the base end of the support member 70 is placed in a linkage initial region. The linkage initial region is a region in which the linkage between the tip end of the push rod 60 (the clamp-fitted portion 67 in this embodiment) and the base end of the support member 70 (the bendable pieces 77 in this embodiment) can be released.

When the linking portion 99 is positioned in the linkage initial region, the tip ends of the bendable pieces 77 are placed in the base end hole 17*c* of the through hole 17, and the bendable pieces 77 are in the opened state. Therefore, the clamp-fitted portion 67 of the push rod 60 is not linked to the bendable pieces 77 of the support member 70. As shown in FIGS. 1A and 1B, the position of the push rod 60 when the flange part 63 of the push rod 60 is in contact with the bottom portion 37 of the driving body 30 and when the reversing movement of the push rod 60 is restricted is defined as the rearward limit position of the push rod 60.

When the user rotates the driving body 30 in the first direction (in the normal direction) with respect to the body tube 20, the push rod 60 is rotated in the first direction with respect to the internal thread member 50 together with the driving body 30. Because the internal thread 53 is threaded with the external thread 61*a*, as the push rod 60 is rotated in the first direction with respect to the internal thread member 50, the push rod 60 is advanced with respect to the body tube 20.

As the push rod 60 is advanced, the abutting part 76 of the support member 70 of the cartridge 2 is pushed by the top surface 62 of the push rod 60, the support member 70 is advanced in the through hole 17 of the cartridge outer tube 10 together with the push rod 60, and then, the cosmetic 4 stored in the cartridge outer tube 10 is pushed out from the front end opening 11*a*. Note that, because the ribs 77*a* of the support member 70 are fitted to the groove portions of the corrugated portion 18 of the through hole 17, the support member 70 is advanced without being rotated with respect to the cartridge outer tube 10. In other words, the push rod 60 pushes the support member 70 in the forward direction while being rotated with respect to the support member 70.

As shown in FIGS. 2A and 2B, when the bendable pieces 77 are inserted in the base-end sliding hole 17*b* of the through hole 17 as the push rod 60 is advanced by the feeding mechanism 8 and the support member 70 is pushed by the push rod 60, the bendable pieces 77 are distorted by coming into contact with the inner circumferential surface of the base-end sliding hole 17*b*, and thereby, the bendable pieces 77 are shifted to the closed state. In other words, an inward pushing force from the inner circumferential surface of the base-end sliding hole 17*b* acts on the tip end sides of the bendable pieces 77 to make the bendable pieces 77 elastically deformed about the base end side as the fulcrums, and thereby, the bendable pieces 77 are shifted to the closed state.

With such a configuration, the bendable pieces 77 that are provided on the base end of the support member 70 and the clamp-fitted portion 67 that is provided on the tip end of the push rod 60 are linked in the base-end sliding hole 17*b*. In the closed state, the clamp-fitted portion 67 are clamped by the plurality of bendable pieces 77 as the bendable pieces 77 are elastically deformed until the protrusions 77*b* provided on the inner circumferential surfaces of the bendable pieces 77 come to contact with the outer circumferential surface of the clamp-fitted portion 67. The clamp-fitted portion 67 is clamp fitted to the recessed portion 77*p* that is formed by the plurality of bendable pieces 77 and the abutting part 76.

A state in which the bendable pieces 77 serving as the opening and closing portion are elastically deformed by coming into contact with the inner circumferential surface of the through hole 17 and shifted to the closed state, thereby causing the base end of the support member 70 and the tip end of the push rod 60 to be linked in the base-end sliding hole 17*b* is referred to as the linkage unreleasable state. The linkage unreleasable state is established when the linking portion 99 is placed in the base-end sliding hole 17*b* and the bendable pieces 77 are clamp fitted to the clamp-fitted portion 67 by being shifted to the closed state. When the linking portion 99 is placed in the base-end sliding hole 17*b*, the bendable pieces 77 are maintained in the closed state as the bendable pieces 77 are constrained by the inner circumferential surface of the base-end sliding hole 17*b*.

In the linkage unreleasable state, the support member 70 is moved rearward and forward in the through hole 17 of the cartridge outer tube 10 along with the rearward and forward movement of the push rod 60. Therefore, the linking portion 99 of the base end of the support member 70 and the tip end of the push rod 60 is moved rearward and forward in the linkage unreleasable state through the base-end sliding hole 17*b* in conjunction with the stroke of the push rod 60.

In the linkage unreleasable state, when the user rotates the driving body 30 in the second direction (in the reversed direction) with respect to the body tube 20, the push rod 60 is rotated in the second direction together with the driving body 30 with respect to the internal thread member 50. As the push rod 60 is rotated in the second direction with respect to the internal thread member 50, the push rod 60 is reversed with respect to the body tube 20. As the push rod 60 is reversed, the protrusions 77*b* of the bendable pieces 77 are pulled by the step portion 67*c* of the clamp-fitted portion 67 of the push rod 60, the support member 70 is reversed in the through hole 17 of the cartridge outer tube 10, and the cosmetic 4 that has been pushed out from the cartridge outer tube 10 is pulled back into the through hole 17.

After some uses, as shown in FIG. 3, the flange part 63 of the push rod 60 comes to contact with the rear end surface 89*b* of the cushion member 80 when the push rod 60 is advanced by rotating the driving body 30 in the normal direction, and the movement of the push rod 60 in the forward direction is restricted. As shown in FIG. 3, the position of the push rod 60 at which the advancement of the push rod 60 is restricted is defined as the forward limit position of the push rod 60.

From the state shown in FIGS. 2A and 2B, as the push rod 60 is advanced by rotating the driving body 30 in the normal direction, the support member 70 is pushed by the push rod 60 along with the advancement, and the bendable pieces 77 are inserted into the tip-end storing hole 17*a*. When the bendable pieces 77 are inserted into the tapered hole 17*e*, the bendable pieces 77 gradually open outward by their elastic force along with the advancement.

As shown in FIG. 3, when the push rod 60 is advanced to the forward limit position by the feeding mechanism 8, the linking portion 99 of the tip end of the push rod 60 and the base end of the support member 70 is positioned at a linkage releasable region. The linkage releasable region is a region in which the linking portion 99 is moved out from the base-end sliding hole 17*b* and moved into the tip-end storing hole 17*a*, and the linkage between the tip end of the push rod 60 (the clamp-fitted portion 67 in this embodiment) and the base end of the support member 70 (the bendable pieces 77 in this embodiment) can be released. When the bendable pieces 77 are placed in the base-end cavity portion 17*h* on the base end side of the tip-end storing hole 17*a* that forms the linkage releasable region, the bendable pieces 77 and the inner circumferential surface of the base-end sliding hole 17*b* are no longer in contact with each other.

Note that, in a state in which the push rod 60 is positioned at the forward limit position, a state in which the support member 70 is also positioned at the forward limit position is established. In other words, the forward limit position of the support member 70 corresponds to the position of the support member 70 when the linking portion 99 is moved out from the base-end sliding hole 17*b* and positioned in the linkage releasable region.

As described above, the linking portion 99 is moved out from the base-end sliding hole 17*b* by the feeding mechanism 8 and moved into the base-end cavity portion 17*h* that forms the linkage releasable region in the tip-end storing hole 17*a*. When the linking portion 99 is positioned inside the base-end cavity portion 17*h*, the bendable pieces 77 are released from the constraint by the inner circumferential surface of the base-end sliding hole 17*b* and are shifted to the opened state due to the elastic force, and therefore, it becomes possible to release the linkage between the base end of the support member 70 (the bendable pieces 77 in this embodiment) and the tip end of the push rod 60 (the clamp-fitted portion 67 in this embodiment).

Note that, according to this embodiment, at the state in which the bendable pieces 77 are positioned in the base-end cavity portion 17*h*, the bendable pieces 77 are spread outward such that the protrusions 77*b* of the bendable pieces 77 of the support member 70 are placed outer side of the step portion 67*c* of the clamp-fitted portion 67 of the push rod 60. Therefore, in a state in which the push rod 60 is positioned at the forward limit position, the clamp-fitted portion 67 and the bendable pieces 77 are in a state in which the clamp-fitted portion 67 and the bendable pieces 77 are not in contact with each other and can move in the axial direction relative to each other. Even if the push rod 60 is reversed from this state, the support member 70 is not reversed.

A procedure of detaching the finished cartridge 2 from the cartridge holder 1 will be described with reference to FIG. 3.

In a case in which the push rod 60 is positioned at the forward limit position and the cartridge 2 has reached the usage-limited state, the linkage between the support member 70 and the push rod 60 is released. As described above, in a linkage released state according to this embodiment, the bendable pieces 77 are in the opened state. Therefore, the user can readily separate the cartridge 2 from the body tube 20 by relatively rotating the cartridge outer tube 10 and the body tube 20 such that the threaded state between the external thread 15 of the cartridge outer tube 10 and the internal thread 43 of the body inner tube 40 is released. Note that, as the cartridge outer tube 10 and the body tube 20 are rotated relatively, the internal thread member 50 is moved forward in the axial direction together with the cartridge 2 by the biasing force exerted by the coil spring 7.

As the internal thread member 50 is moved forward in the axial direction by the biasing force exerted by the coil spring 7, the rear end surfaces 55*b* of the blade portions 55 of the internal thread member 50 are separated from the inclined surfaces 25*a* of the proximity guide portions 25 of the body outer tube 21, and the front end surfaces 55*a* of the blade portions 55 of the internal thread member 50 come to contact with the inclined surfaces 44*a* of the separation guide portions 44 of the body inner tube 40. Because the separation guide portions 44 guide the internal thread member 50 in the direction in which the internal thread 53 of the internal thread member 50 moves away from the external thread 61*a*, as the internal thread member 50 is advanced, the threaded state between the internal thread 53 and the external thread 61*a* is released.

Once the threaded state between the internal thread 53 and the external thread 61*a* is released, the push rod 60 is moved rearward in the axial direction by the biasing force exerted by the coil spring 7 and automatically returns to the initial position shown in FIGS. 7A to 7C.

As described above, the detachment of the finished cartridge 2 from the cartridge holder 1 is completed.

Note that, if the half-finished cartridge 2 shown in FIGS. 2A and 2B is required to be detached from the cartridge holder 1, the driving body 30 is rotated in the reversed direction with respect to the body tube 20, and the push rod 60 is reversed to the rearward limit position. When the push rod 60 is positioned at the rearward limit position, the linking portion 99 is positioned in the base end hole 17*c* of the through hole 17. Once the linking portion 99 is placed in the base end hole 17*c*, the constraint applied to the bendable pieces 77 by the inner circumferential surface of the through hole 17 is released, the bendable pieces 77 are shifted to the opened state by their elastic force, and it becomes possible to release the linkage between the bendable pieces 77 and the clamp-fitted portion 67 of the push rod 60. In this state, the user can detach the half-finished cartridge 2 from the cartridge holder 1 by releasing the threaded state between the external thread 15 of the cartridge 2 and the internal thread 43 of the cartridge holder 1.

According to the first embodiment described above, the following effects are achieved.

(1) The cartridge 2 of this embodiment is the cartridge that is configured such that the feeding mechanism 8 is operated as the cartridge 2 is used by being attached to the cartridge holder 1 having the built-in push rod 60 and the cosmetic 4 stored in the cartridge 2 is moved rearward and forward in conjunction with the rearward and forward movement of the push rod 60. The cartridge outer tube 10 has the through hole 17 through which the front end opening 11*a* on the tip end side is communicated with the rear end opening 11*b* on the base end side. The support member 70 is received in the cartridge outer tube 10 so as to be movable in the axial direction. The support member 70 has the rod shaft portion 75 that is configured to be linked at the base end thereof to the tip end of the push rod 60 and the support tube (support portion) 72 that is provided on the tip end of the rod shaft portion 75 and is configured to support the cosmetic 4. The through hole 17 has the tip-end storing hole 17*a* and the base-end sliding hole 17*b*. The tip-end storing hole 17*a* is provided in the tip end side of the cartridge outer tube 10 and is configured to store the cosmetic 4. The base-end sliding hole 17*b* is provided on the base end side of the cartridge outer tube 10 so as to communicate with the tip-end storing hole 17*a* and is configured such that the linking portion 99 of the tip end of the push rod 60 and the base end of the support member 70 slides in the base-end sliding hole 17*b* in the linkage unreleasable state. The linking portion 99 moves out from the base-end sliding hole 17*b* by the feeding mechanism 8 and moves to the linkage releasable region in the tip-end storing hole 17*a*.

With the cartridge-type cosmetic container disclosed in JP1991-049017U, when the finished cartridge is replaced with the new cartridge, at a stage in which the screw (132) of the finished cartridge is removed, the engagement between the core chuck (134) and the presser (129) of the sliding shaft (127) is not released. Subsequent to the removal of the screw (132) of the finished cartridge, the engagement between the core chuck (134) and the presser (129) of the sliding shaft (127) is released once the sliding shaft (127) is moved rearward to the rearward limit position together with the core chuck (134) and an engaging projection of an elastic block (137) is positioned in the recessed groove (133). Thus, even if the screw (132) of the finished cartridge is removed, the finished cartridge cannot be detached immediately. In other words, with the cartridge-type cosmetic container disclosed in JP1991-049017U, there is a problem in that it takes some time to replace the cartridge.

In contrast, according to this embodiment, when the push rod 60 is advanced by the operation of the feeding mechanism 8 and when the linking portion 99 has moved out from the base-end sliding hole 17*b* and is positioned in the linkage releasable region, as the user releases the threaded state between the external thread 15 of the cartridge 2 and the internal thread 43 of the cartridge holder 1, the cartridge 2 is readily separated from the cartridge holder 1. Thus, according to this embodiment, it is possible to easily perform replacement of the cartridge 2 because new cartridge 2 can readily be attached to the cartridge holder 1 after the finished cartridge 2 has been detached from the cartridge holder 1.

(2) With the cartridge-type cosmetic container disclosed in JP1991-049017U, if the elastic block (137) has been kept in an inwardly distorted state for a long period of time in the cartridge (131) and the elastic block (137) has become unable to open and expand, the engaging projection of the elastic block (137) cannot engage with the recessed groove (133), thus causing the core chuck (134) supporting the cosmetic to fall off from the cartridge (131). As a result, there is a problem in that the cartridge (131) cannot be used anymore even if the cartridge (131) is half-finished.

In contrast, according to this embodiment, the support member 70 has means to prevent it from being dismounted to the rear end opening 11*b* on the base end side. Therefore, even if the threaded state between the external thread 15 of the half-finished cartridge 2 and the internal thread 43 of the cartridge holder 1 is released, during the process of detaching the cartridge 2 from the cartridge holder 1, the linkage through the linking portion 99 can be released by moving the linking portion 99 out from the base-end sliding hole 17*b* and by moving the linking portion 99 to the linkage initial region in the base end hole 17*c*, and thereby, the support member 70 does not fall off from the rear end opening 11*b* on the base end side to the outside.

In other words, according to this embodiment, it is possible to detach, without dismounting the support member 70, the half-finished cartridge 2 from the cartridge holder 1 and replace it with, for example, the half-finished cartridge 2 of another color. Because the dismount of the support member 70 from the cartridge outer tube 10 is prevented, even after the half-finished cartridge 2 is detached from the cartridge holder 1, it is possible to use the same half-finished cartridge 2 again by attaching it to the cartridge holder 1.

Furthermore, according to this embodiment, even if, in the linkage unreleasable state, the cartridge outer tube 10 is unexpectedly taken off from the body tube 20 and the support member 70 is pulled in the rearward direction while being linked to the push rod 60 by a mis-operation of the user, the support member 70 is prevented from falling off from the cartridge outer tube 10 by the step portion 17*d*.

(3) The support member 70 has the ribs 77*a* serving as the engaging protrusions, and the cartridge outer tube 10 has the corrugated portion 18 that prohibits the relative rotation with the support member 70 by being engaged with the ribs 77*a*. Here, if the ribs 77*a* are not provided, the rotative force is transmitted to the support member 70 through friction with the push rod 60, and thereby, the support member 70 and the cosmetic 4 are rotated with respect to the cartridge outer tube 10. Because the cosmetic 4 is moved rearward and forward while being twisted in the cartridge outer tube 10, there is a risk in that the cosmetic 4 is fractured. In contrast, according to this embodiment, because the relative rotation of the cosmetic 4 with respect to the cartridge outer tube 10 is prevented by the ribs 77*a* and the corrugated portion 18, it is possible to prevent the fracture of the cosmetic 4.

(4) By making the outer diameter DT of the support tube 72 supporting the cosmetic 4 larger than the outer diameter DR of the rod shaft portion 75 provided so as to extend from the support tube 72, the position of the support member 70 at which the position of the support tube 72 is defined in the tip-end storing hole 17*a* is defined as the rearward limit position of the support member 70. The linking portion 99 is moved rearward and forward in the base-end sliding hole 17*b* in the linkage unreleasable state in conjunction with the stroke of the push rod 60. The position of the support member 70 at which the linking portion 99 is moved out from the base-end sliding hole 17*b* and positioned in the linkage releasable region is defined as the forward limit position of the support member 70. As described above, according to this embodiment, by forming the support tube 72 supporting the cosmetic 4 to have a larger diameter than the rod shaft portion 75, it is possible to prevent the support member 70 from being dismounted from the rear end opening 11*b*. Therefore, there is no need to provide a dedicated anti-dismounting means on the support member 70, and so, it is possible to simplify the configuration of the support member 70.

(5) The linking portion 99 is formed by the plurality of bendable pieces (opening and closing portions) 77 and the clamp-fitted portion 67. The plurality of bendable pieces (opening and closing portions) 77 are provided on the base end of the support member 70 and are capable of being opened and closed through the elastic deformation. The clamp-fitted portion 67 is provided on the tip end of the push rod 60. When the linking portion 99 is placed in the base-end sliding hole 17*b*, the linking portion 99 is shifted to the linkage unreleasable state as the bendable pieces 77 are shifted to the closed state and clamp fitted to the clamp-fitted portion 67. As the linking portion 99 is moved out from the base-end sliding hole 17*b* and positioned in the linkage releasable region, the bendable pieces 77 are shifted to the opened state, and the linkage between the push rod 60 and the support member 70 becomes releasable.

As described above, according to this embodiment, after some uses of the cartridge 2, when the linking portion 99 is moved out from the base-end sliding hole 17*b*, the linking portion 99 is shifted to a state in which the linkage can be released. When the linking portion 99 is moved out from the base-end sliding hole 17*b*, the frictional force between the linking portion 99 and the inner circumferential surface of the through hole 17 is reduced and the operation requires less effort, and so, the user can notice that the cartridge 2 is in a state close to the usage limit.

(6) The through hole 17 has the base end hole 17*c* through which the base-end sliding hole 17*b* is communicated with the rear end opening 11*b* on the base end side. The base end hole 17*c* is formed to have the inner diameter DL2 that is larger than the inner diameter DS of the base-end sliding hole 17*b*. When the linking portion 99 is placed in the base end hole 17*c*, the bendable pieces 77 are shifted to the opened state, and the linkage between the push rod 60 and the support member 70 becomes releasable.

If the base end hole 17*c* is not provided, the cartridge 2 would be sold as the unit in a state in which the bendable pieces 77 protrude outside from the rear end opening 11*b* of the cartridge 2. In this case, if an external force is applied to the rear end of the support member 70, there is a risk in that the cosmetic 4 is unexpectedly pushed out from the front end opening 11*a*. Therefore, in order to prevent the cosmetic 4 from being unexpectedly pushed out from the front end opening 11*a*, the cartridge 2 needs to be packed in such manner that the support member 70 including the bendable pieces 77 is fixed in the cartridge outer tube 10. In this embodiment, it is possible to sell the cartridge 2 as the unit in such manner that the bendable pieces 77 are received in the base end hole 17*c* of the cartridge outer tube 10. Therefore, the cosmetic 4 is prevented from being unexpectedly pushed out from the front end opening 11*a*, and it is possible to simplify a structure of a package.

(7) The linking portion 99 is configured so as to be positioned in the linkage releasable region when the push rod 60 is advanced to the forward limit position. With such a configuration, it is possible to reliably release the linkage in a state in which the cartridge 2 is used up.

(8) After some uses of the cartridge 2, the user stores the cartridge-type cosmetic container 100 by rotating the driving body 30 in the reversed direction with respect to the body tube 20 to reverse the support member 70 by a little amount, and by fitting the cap 3 to the cartridge outer tube 10. In this embodiment, the linkage through the linking portion 99 is released in a state in which the cartridge 2 is used up, in other words, in a state in which the support member 70 is positioned at the forward limit position, and therefore, even if the push rod 60 is reversed by rotating the driving body 30 in the reversed direction with respect to the body tube 20, the support member 70 is prevented from being reversed. With such a configuration, it is possible to acknowledge the user that the cartridge 2 has reached the usage-limited state and to encourage the user to replace the cartridge 2.

(9) The bendable pieces 77 serving as the opening and closing portion capable of being opened and closed through the elastic deformation are provided on the base end of the support member 70. Therefore, even in a case in which the cartridge-type cosmetic container 100 has been used over a long period of time and the bendable pieces 77 are deteriorated due to repetitive elastic deformation, it is required to replace only the cartridge 2.

(10) When the cartridge 2 is to be attached to the body tube 20, the internal thread 53 of the internal thread member 50 is threaded with the external thread 61*a* as the internal thread member 50 is pushed by the end portion of the cartridge 2 and is reversed against the biasing force exerted by the coil spring 7. On the other hand, when the cartridge 2 is to be detached from the body tube 20, the threaded state between the internal thread 53 of the internal thread member 50 and the external thread 61*a* of the push rod 60 is released as the internal thread member 50 is advanced by the biasing force exerted by the coil spring 7. Therefore, special operation is not required to establish or release the threaded state between the external thread 61*a* and the internal thread 53, and so, it is possible to easily attach and detach the cartridge 2 to and from the cartridge holder 1.

(11) The protruding wall portion 46 of the body tube 20 has a function as a limiting portion that limits the movement of the push rod 60 in the direction in which the threaded state between the internal thread 53 and the external thread 61*a* is released. Therefore, a plurality of internal thread members are not required to thread the internal thread 53 of the internal thread member 50 with the external thread 61*a* of the push rod 60.

Because the coil spring 7 biases the single internal thread member 50, unlike the case in which the plurality of internal thread members are used (for example, as in the technique described in Japanese Unexamined Patent Application No. 2014-161637), the internal thread member 50 is prevented from being subjected to the biasing force greater than the normal level. Therefore, even in a state in which the peaks of the thread ridges of the internal thread 53 of the internal thread member 50 are in contact with the peaks of the thread ridges of the external thread 61*a* of the push rod 60, insertion of the cartridge 2 into the body tube 20 does not become difficult.

Therefore, it is possible to insert the cartridge 2 to a predetermined position in the body tube 20, and therefore, it is possible to restrict, by the protruding wall portion 46, the movement of the push rod 60 in the threaded-state releasing direction. As a result, the push rod 60 is reliably moved rearward and forward along with the relative rotation between the body tube 20 and the driving body 30, and it is possible to reliably feed out the cosmetic 4 from the cartridge 2.

In addition, by providing the single internal thread member 50, as compared with a case in which a plurality of internal thread members are inserted into a body tube, it is possible to form the cartridge holder 1 to have a smaller diameter.

First Modification of First Embodiment

Figure 15A:
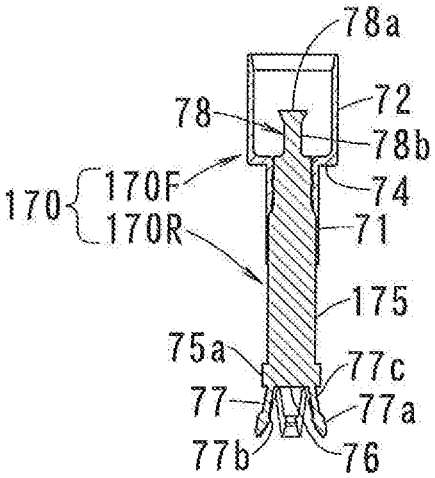
FIG. 15A is a front sectional view of the support member in the cartridge according to a modification of the first embodiment of the present invention.
Figure 15B:
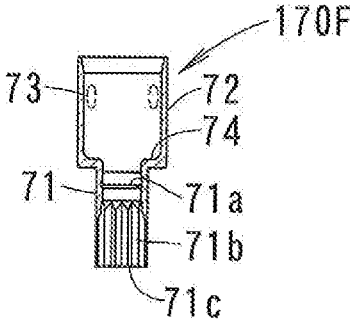
FIG. 15B is a front sectional view of a front-side support member.
Figure 15C:
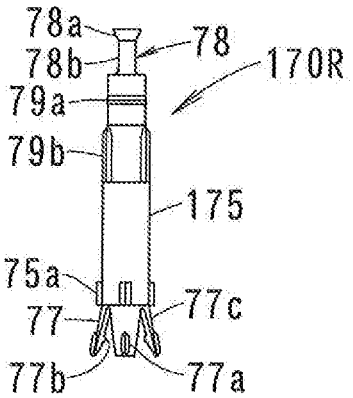
FIG. 15C is a front view of a rear-side support member.

In the above-mentioned embodiment, although a description is given of an example in which the support member 70 is configured of a single member, the present invention is not limited to this configuration. For example, as shown in FIGS. 15A to 15C, a support member 170 may be formed by linking two members. As shown in FIG. 15A, the support member 170 is provided with a front-side support member (a tip-end-side support member) 170F that forms a front side portion of the support member 170 and a rear-side support member (a base-end-side support member) 170R that forms a rear side portion of the support member 170.

As shown in FIG. 15B, the front-side support member 170F has the support tube 72 and a fitting tube portion 71 that is provided so as to extend toward the rearward direction from the bottom portion 74 of the support tube 72. The fitting tube portion 71 is formed to have a cylindrical shape, and the bottom portion 74 of the support tube 72 is formed with an opening portion that communicates with the inside of the fitting tube portion 71.

The fitting tube portion 71 has an annular fitting recess 71*a* in an inner circumference in the vicinity of the support tube 72. The inner circumference of the fitting tube portion 71 is formed with a knurled part 71*b* that extends in the axial direction from the center portion of the fitting tube portion 71 in the forward and rearward directions to a rear end opening 71*c*.

As shown in FIG. 15C, the rear-side support member 170R has a rod shaft portion 175, a shaft body portion 78 that is provided on the one end of the rod shaft portion 175 so as to extend in the axial direction, and the plurality of bendable pieces 77 that are provided on the other end of the rod shaft portion 175. A tip end portion of the rod shaft portion 175 is a portion that is to be fitted into the front-side support member 170F, and an annular fitting projection 79*a* is provided on an outer circumference of the rod shaft portion 175 in the vicinity of the tip end thereof. The outer circumference of the rod shaft portion 175 is formed with a plurality of ribs 79*b* that extend in the axial direction over a predetermined length from the rear side of the fitting projection 79*a*.

The outer circumference of the rod shaft portion 175 is formed with a plurality of ribs 75*a* that extend forward in the axial direction over a predetermined length from the base end (rear end) of the rod shaft portion 175. The ribs 75*a* of the rod shaft portion 175 are fitted into the valley portions of the corrugated portion 18 (the groove portions) of the through hole 17. In other words, in this modification, the ribs 77*a* of the bendable pieces 77 and the ribs 75*a* of the rod shaft portion 175 are provided as the engaging protrusions of the support member 170, and the relative rotation of the support member 170 with respect to the cartridge outer tube 10 is prohibited as the ribs 77*a* and the ribs 75*a* engage with the valley portions of the corrugated portion 18 of the through hole 17.

The shaft body portion 78 is provided so as to extend forward in the axial direction from the tip end of the rod shaft portion 175. The shaft body portion 78 has a cylindrical column portion 78*b* having a cylindrical column shape and a head portion 78*a* that is provided on the tip end of the cylindrical column portion 78*b*. The head portion 78*a* has a truncated cone shape in which a diameter is increased from the tip end of the cylindrical column portion 78*b* toward the tip end of the head portion 78*a*.

The cylindrical column portion 78*b* of the shaft body portion 78 is provided so as to protrude inward in the support tube 72 from the bottom portion 74 of the support tube 72, and therefore, the entire shaft body portion 78 is buried in the cosmetic 4. The head portion 78*a* provided on the tip end of the shaft body portion 78 has a larger diameter than the cylindrical column portion 78*b*. Thus, when the cosmetic 4 is fed back, the cosmetic 4 is caught by a tapered surface, that is an outer circumferential side surface of the shaft body portion 78, and therefore, the cosmetic 4 is prevented from been pulled out in the axial direction.

As the tip end portion of the rear-side support member 170R is inserted from the rear end opening 71*c* of the front-side support member 170F and the fitting projection 79*a* is fitted to the fitting recess 71*a*, as shown in FIG. 15A, the front-side support member 170F and the rear-side support member 170R are linked. Note that, because the ribs 79*b* engage with the knurled part 71*b*, the relative rotation between the front-side support member 170F and the rear-side support member 170R is restricted.

According to the first modification of the first embodiment as described above, following operational advantages are achieved in addition to the above-described operational advantages of the first embodiment.

(12) The support member 170 has a configuration in which the front-side support member 170F having the support tube 72 and the rear-side support member 170R having the plurality of bendable pieces 77 are linked. With such a configuration, it is possible to link the front-side support member 170F to the rear-side support member 170R by inserting the front-side support member 170F from the front end opening 11*a* of the cartridge outer tube 10 and by inserting the rear-side support member 170R from the rear end opening 11*b* of the cartridge outer tube 10 by using jigs, etc., for example.

Therefore, during the assembly of the cartridge 2, there is no need to pass the plurality of bendable pieces 77 through the base-end sliding hole 17*b* by inserting the bendable pieces 77 from the front end opening 11*a* of the cartridge outer tube 10. Therefore, it is possible to perform the assembly of the cartridge 2 with ease.

(13) The support member 170 is provided with the shaft body portion 78 that is provided inside the support tube 72. The shaft body portion 78 has the cylindrical column portion 78*b* that is provided so as to extend forward in the axial direction from the bottom portion 74 of the support tube 72 and the head portion 78*a* that is provided on the tip end of the cylindrical column portion 78*b*. Because the diameter of the head portion 78*a* is larger than the diameter of the cylindrical column portion 78*b*, it is possible to effectively prevent the cosmetic 4 from falling off from the support tube 72 when the cosmetic 4 is fed back.

(14) In a case in which only the ribs 77*a* are provided and the ribs 75*a* are not provided, there is a possibility that the support member 170 is rotated along with the rotation of the push rod 60 when the push rod 60 is positioned at the rearward limit position. In this embodiment, because not only the bendable pieces 77, but also the ribs 75*a* are provided on the rod shaft portion 175, it is possible to reliably prevent the rotation of the support member 170 over the entire moving range of the push rod 60.

Second Modification of First Embodiment

In the above-mentioned embodiment, in the base-end sliding hole 17*b*, the diameter DS of the imaginary circular cross-section that is drawn by connecting the peaks of the plurality of ridge portions is set to have a dimension that is smaller than the maximum outer dimension DB of the bendable pieces 77. Thus, in the above-mentioned embodiment, the peaks of the plurality of ridge portions of the corrugated portion 18 come to contact with the bendable-piece main body portions 77*c*, and thereby, the bendable pieces 77 are shifted to the closed state. However, the present invention is not limited to this configuration.

In the base-end sliding hole 17*b*, the diameter of the imaginary circular cross-section that is drawn by connecting the plurality of valley portions of the corrugated portion 18 may be set so as to be smaller than a dimension between the tip ends of the ribs 77*a* respectively protruding out from the pair of mutually opposing bendable-piece main body portions 77*c*, in other words, the maximum outer dimension of the pair of ribs 77*a*. In this case, the tip ends of the ribs 77*a* are pushed inward by bottom portions of the valley portions of the corrugated portion 18 in the base-end sliding hole 17*b*, and thereby, the bendable pieces 77 are shifted to the closed state. Various shapes and dimensions may be employed for the configuration of the corrugated portion 18 so long as the corrugated portion 18 has the configuration in which the bendable pieces 77 are elastically deformed inwardly by the inner circumference thereof.

Third Modification of First Embodiment

In the above-mentioned embodiment, although a description is given of an example in which the bendable pieces 77 are spread outward such that, when the bendable pieces 77 are positioned in the base-end cavity portion 17*h*, the protrusions 77*b* of the bendable pieces 77 of the support member 70 are placed outer side of the step portion 67*c* of the clamp-fitted portion 67 of the push rod 60, the present invention is not limited to this configuration. A degree of spreading out of the bendable pieces 77 may be smaller than that in the above-mentioned embodiment. For example, the protrusions 77*b* of the bendable pieces 77 of the support member 70 may be placed inner side of the step portion 67*c* of the clamp-fitted portion 67 of the push rod 60 when the bendable pieces 77 are positioned in the base-end cavity portion 17*h*. Because the push rod 60 is biased downward with a strong force by the coil spring 7, as long as a flexibility of the bendable pieces 77 is high, it is possible to release the linkage between the support member 70 and the push rod 60 by detaching the cartridge outer tube 10 from the body tube 20.

Second Embodiment

A cartridge-type cosmetic container 200 according to a second embodiment of the present invention will be described below. Note that, in the figures, components that are the same as or similar to those in the first embodiment are assigned the same reference numerals, and the differences are mainly described.

Figure 16:
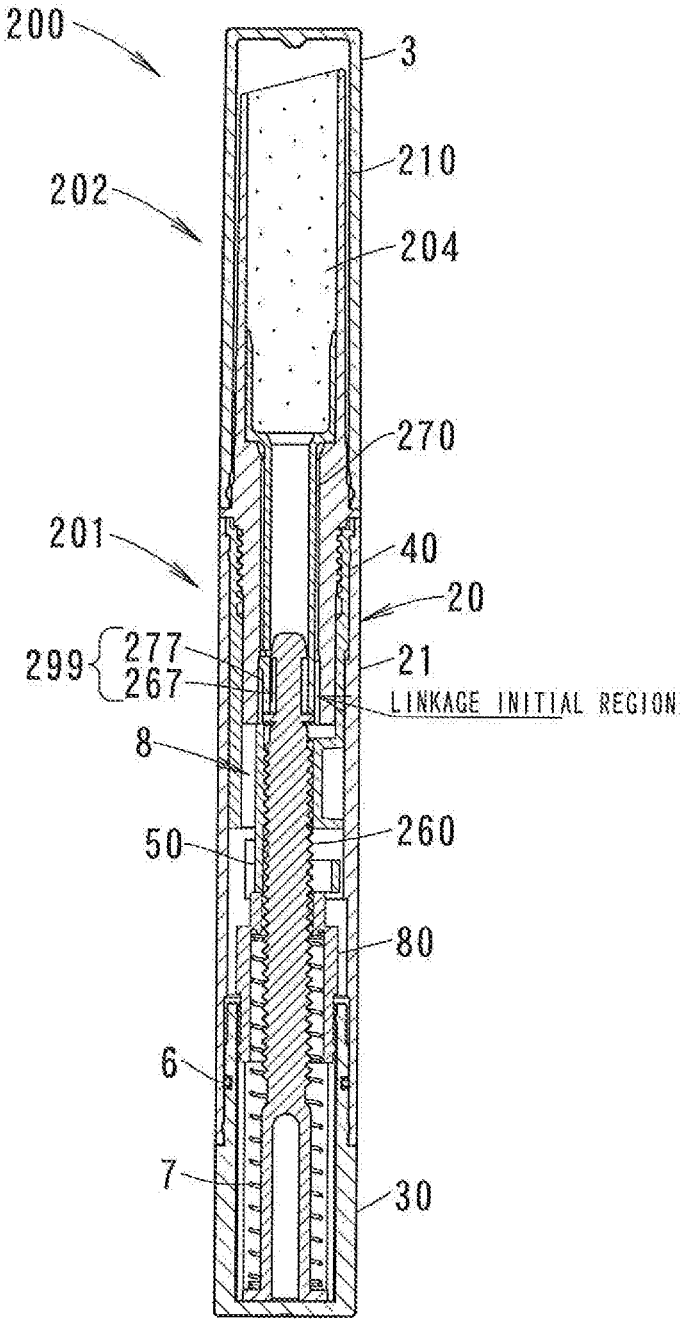
FIG. 16 is a front sectional view showing a state in which the push rod of the cartridge-type cosmetic container according to a second embodiment of the present invention is positioned at the rearward limit position.
Figure 17A:
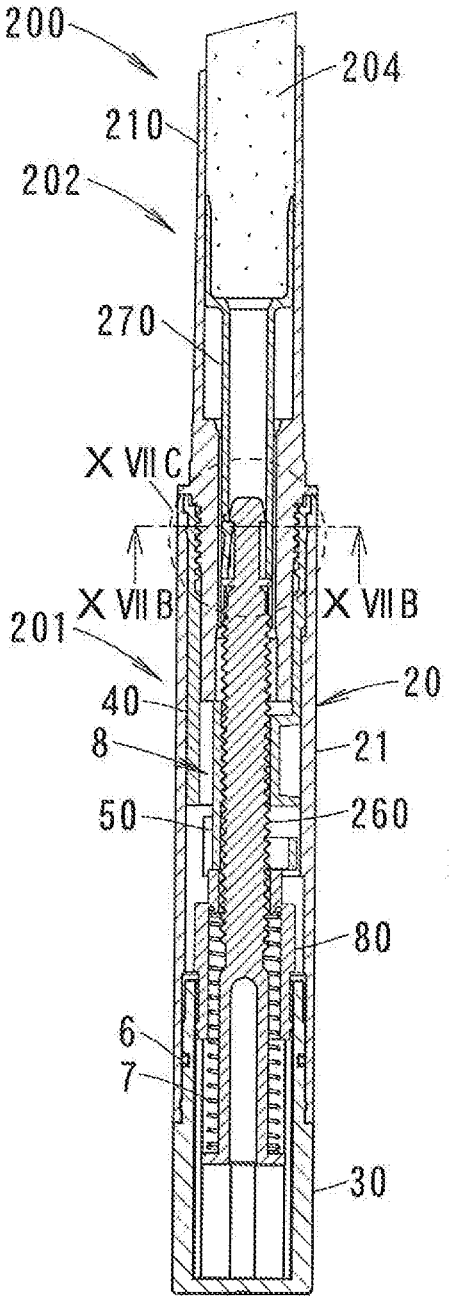
FIG. 17A is a front sectional view showing a state in which the push rod of the cartridge-type cosmetic container according to the second embodiment of the present invention is positioned between the rearward limit position and the forward limit position.
Figure 17B:
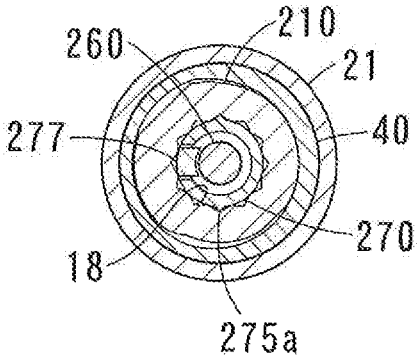
FIG. 17B is an enlarged sectional view taken along XVIIB-XVIIB in FIG. 17A.
Figure 17C:
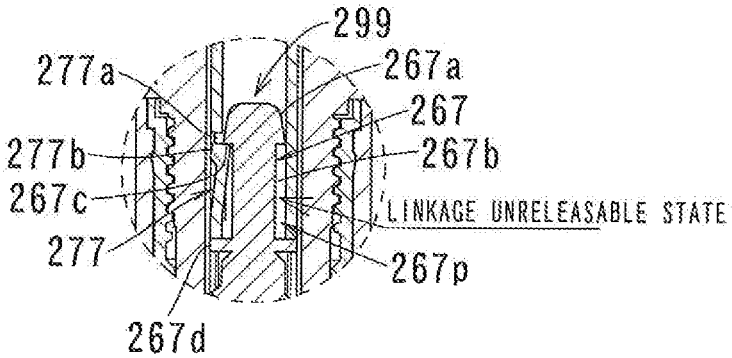
FIG. 17C is an enlarged view of a portion XVIIC in FIG. 17A.
Figure 18:
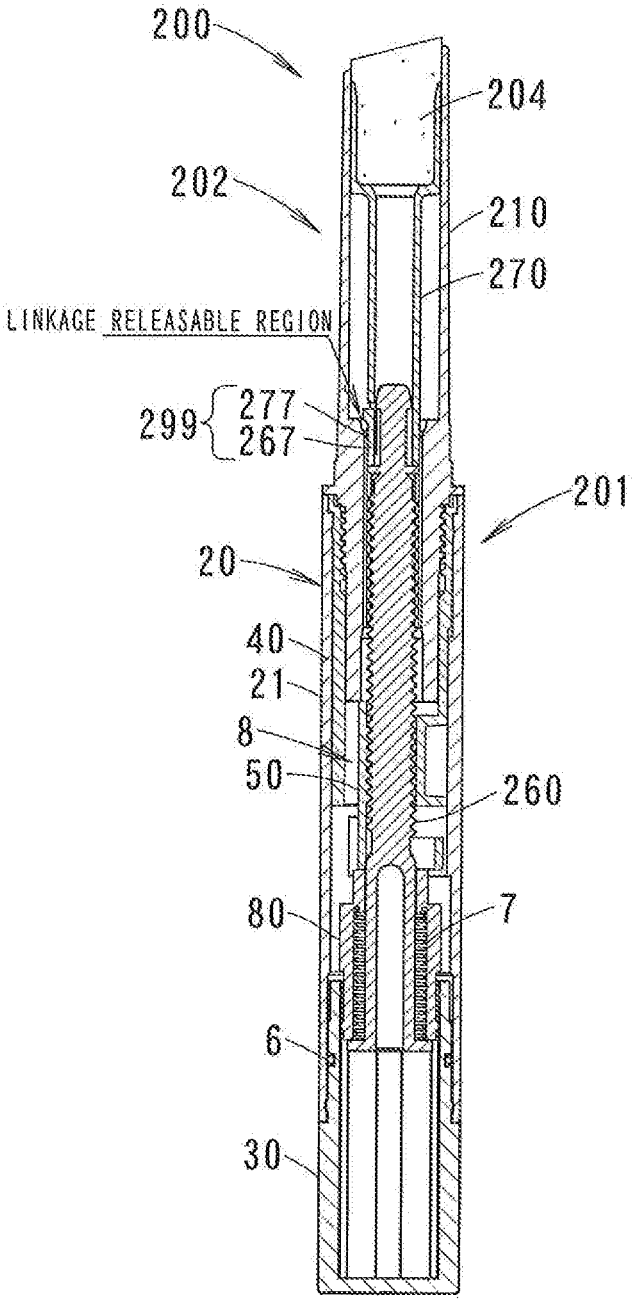
FIG. 18 is a front sectional view showing a state in which the push rod of the cartridge-type cosmetic container according to the second embodiment of the present invention is positioned at the forward limit position.

As shown in FIGS. 16 to 18, the cartridge-type cosmetic container 200 is provided with a cartridge holder 201 and a cartridge 202.

The cartridge 202 according to the second embodiment will be described. In the first embodiment, a description is given of an example in which a liquid cosmetic is casted into the cartridge outer tube 10 and solidified. In contrast, in the second embodiment, a cosmetic core is molded in advance by using a cosmetic mold (not shown), and thus molded solid cosmetic 204 is inserted into the support tube 72 under pressure.

Figure 19A:
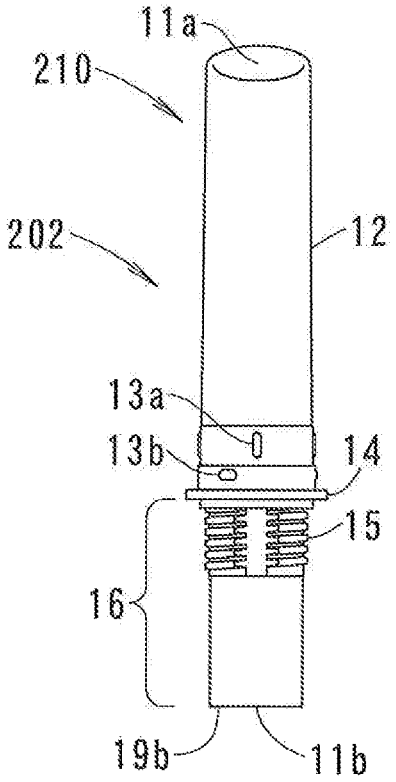
FIG. 19A is a side view of the cartridge outer tube.
Figure 19B:
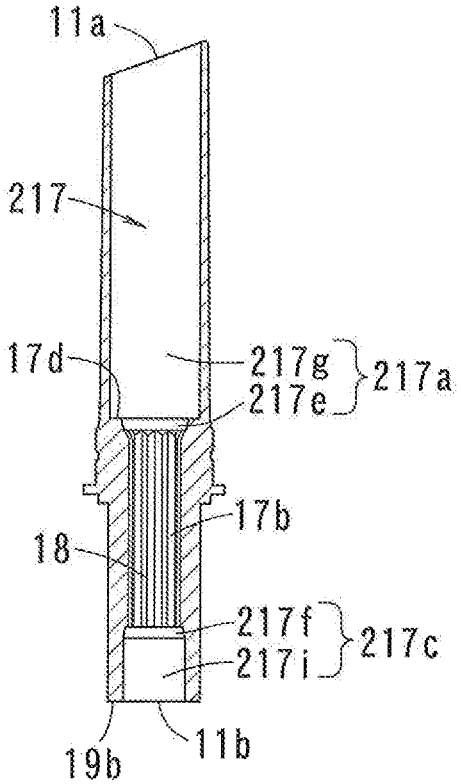
FIG. 19B is a front sectional view of the cartridge outer tube.

In the first embodiment, the base-end cavity portion 17*h* having the smaller diameter than the sliding opening portion 17*g* is provided in the tip-end storing hole 17*a* of the through hole 17 (see FIG. 5D). In contrast, in the second embodiment, as shown in FIGS. 19A and 19B, although a tip-end storing hole 217*a* of a through hole 217 has a sliding opening portion 217*g* and a tapered hole 217*e*, the tip-end storing hole 217*a* does not have the base-end cavity portion 17*h* described in the first embodiment. Therefore, although the opening edge portion of the base-end cavity portion 17*h* is formed as the step portion 17*d* in the first embodiment, in the second embodiment, the opening edge portion of the tapered hole 217*e* is formed as the step portion 17*d*.

In the first embodiment, the base end hole 17*c* of the through hole 17 is subjected to the knurling processing, and the corrugated portion 18 is formed (see FIG. 5D). In contrast, in the second embodiment, a base end hole 217*c* of the through hole 217 is not subjected to the knurling processing, and a base-end cavity portion 217*i* and a tapered hole 217*f* forming the base end hole 217*c* are formed to have a circular cross-sectional shape.

Figure 20A:
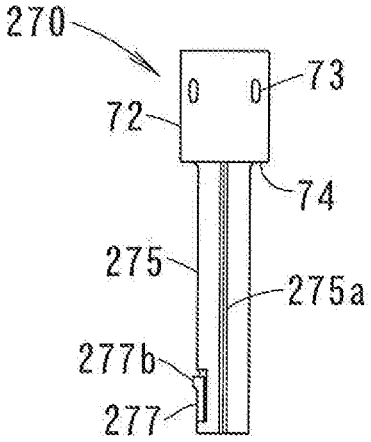
FIG. 20A is a front view of the support member.
Figure 20B:
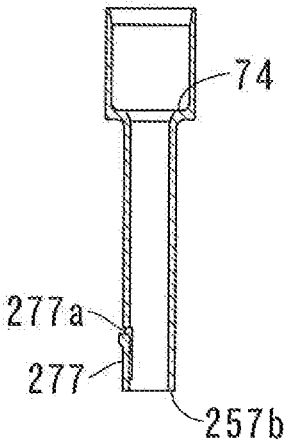
FIG. 20B is a front sectional view of the support member.
Figure 20C:
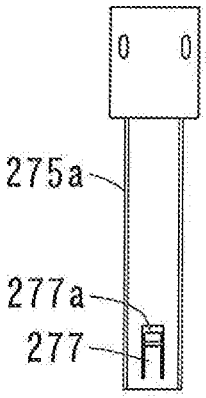
FIG. 20C is a side view of the support member.

In the first embodiment, the rear end of the support member 70 is provided with the plurality of bendable pieces 77 at equal intervals in the in the circumferential direction (see FIGS. 6A to 6D). In contrast, in the second embodiment, as shown in FIGS. 20A to 20C, a rear end of a support member 270 is provided with a single bendable piece 277.

The bendable piece 277 is formed of an inner portion of a substantially U-shaped slit 277*a* that is formed in a side surface of a rod shaft portion 275 having a cylindrical shape in the vicinity of a rear end thereof. The bendable piece 277 has a fixed end on the rear end side of the rod shaft portion 275, and a tip end of the bendable piece 277 is formed as a free end. The bendable piece 277 is an elastic member that elastically deforms between a closed state in which the bendable piece 277 is closed radially inward (see FIGS. 17A to 17C) and an opened state in which the bendable piece 277 is opened radially outward (see FIGS. 16 and 18). The bendable piece 277 functions as the opening and closing portion capable of being opened and closed through the elastic deformation and forms a portion that is linked to a tip end of a push rod 260.

An outer circumferential surface of the tip end of the bendable piece 277 is formed with a protrusion 277*b* that protrudes radially outward. When the bendable piece 277 is positioned inside the base-end sliding hole 17*b*, the protrusion 277*b* comes to contact with the inner circumferential surface of the base-end sliding hole 17*b*, and thereby, the bendable piece 277 is elastically deformed (distorted) radially inward and shifted to the closed state. When the bendable piece 277 is positioned in the tip-end storing hole 217*a*, the protrusion 277*b* is not in contact with an inner circumferential surface of the through hole 217, and thereby, the bendable piece 277 is shifted to the opened state in which the bendable piece 277 is opened radially outward as compared with the closed state.

In the first embodiment, the configuration in which the movement of the support member 70 in the circumferential direction with respect to the cartridge outer tube 10, in other words, the relative rotation of the support member 70 with respect to the cartridge outer tube 10 is prohibited by fitting the ribs 77*a* of the bendable pieces 77 into the valley portions of the corrugated portion 18 of the through hole 17 is employed. In contrast, in the second embodiment, a rib 275*a* is provided on an outer circumferential surface of the rod shaft portion 275 as an engaging protrusion so as to extend in the axial direction, and the movement of the support member 270 in the circumferential direction with respect to a cartridge outer tube 210, in other words the relative rotation of the support member 270 with respect to the cartridge outer tube 210 is prohibited by fitting the rib 275*a* into the valley portions of the corrugated portion 18 of the base-end sliding hole 17*b* (see FIG. 17B).

Figure 21A:
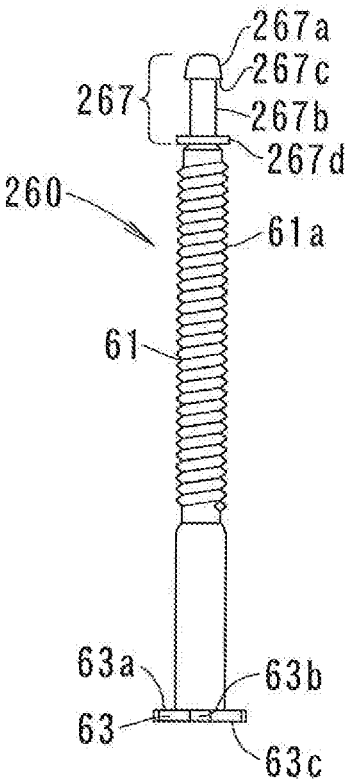
FIG. 21A is a front view of the push rod.
Figure 21B:
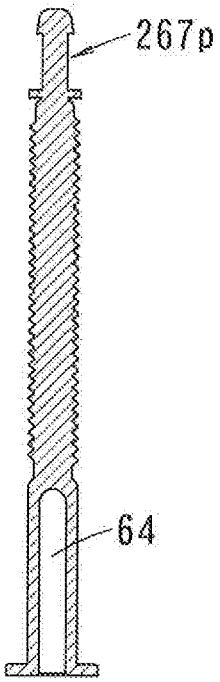
FIG. 21B is a front sectional view of the push rod.

The push rod 260 that is built in the cartridge holder 201 according to the second embodiment will be described. As shown in FIGS. 21A and 21B, a clamp-fitted portion 267 of the push rod 260 has a cylindrical column portion 267*b* having a cylindrical column shape, a head portion 267*a* that has a truncated cone shape and that is provided on a front end of the cylindrical column portion 267*b*, and an annular flange part 267*d* that is provided on a rear end of the cylindrical column portion 267*b*. A diameter of the cylindrical column portion 267*b* is smaller than a diameter of the rod shaft 61 and is smaller than a diameter of the head portion 267*a*. Because a diameter of a bottom surface of the head portion 267*a* is larger than the diameter of the cylindrical column portion 267*b*, the bottom surface of the head portion 267*a* is formed as a step portion 267*c*.

The flange part 267*d* is provided on the rear end of the cylindrical column portion 267*b* so as to protrude out radially outward from the cylindrical column portion 267*b*. The tip end of the push rod 260 is provided with a recessed portion 267*p* that is clamp fitted to the bendable piece 277. An outer circumferential surface of the cylindrical column portion 267*b* corresponds to a bottom surface of the recessed portion 267*p*. The step portion 267*c* and a front surface of the flange part 267*d* facing the step portion 267*c* correspond to a pair of side surfaces of the recessed portion 267*p*.

In the first embodiment, as the push rod 60 is advanced, the abutting part 76 of the support member 70 is pushed by the top surface 62 of the push rod 60, and the support member 70 is advanced. In contrast, in the second embodiment, as the push rod 260 is advanced, a rear end surface 257*b* of the support member 270 is pushed by the flange part 267*d* of the push rod 260, and the support member 270 is advanced.

In the first embodiment, as the push rod 60 is reversed, the protrusions 77*b* of the bendable pieces 77 is pulled by the step portion 67*c* of the push rod 60, and the support member 70 is reversed. In contrast, in the second embodiment, as the push rod 260 is reversed, the tip end portion of the bendable piece 277 is pulled by the step portion 267*c* of the push rod 260, and the support member 270 is reversed.

In other words, in the first and the second embodiments, an arrangement relationship between the portion that pushes the support member 70, 270 when the push rod 60, 260 is to be advanced and the portion that pulls the support member 70, 270 when the push rod 60, 260 is to be reversed is inverted in the forward and rearward direction.

A method of using the cartridge-type cosmetic container 200 will be described with main reference to FIGS. 16 to 18. FIG. 16 shows a state before using the cartridge holder 201 and shows the cartridge-type cosmetic container 200 in a state in which the push rod 260 is positioned at the rearward limit position. FIG. 18 shows the cartridge-type cosmetic container 200 in a state in which the push rod 260 is positioned at the forward limit position. FIGS. 17A to 17C show the cartridge-type cosmetic container 200 in a state in which the push rod 260 is at the feed-out intermediate position.

As shown in FIG. 16, in a state in which the push rod 260 is positioned at the rearward limit position, a linking portion 299 of the tip end of the push rod 260 and a base end of the support member 270 is placed in the linkage initial region. The linkage initial region is the region in which the linkage between the tip end of the push rod 260 (the clamp-fitted portion 267 in this embodiment) and the base end of the support member 270 (the bendable piece 277 in this embodiment) can be released.

When the linking portion 299 is positioned in the linkage initial region, the bendable piece 277 is placed in the base end hole 217*c* of the through hole 217, and the bendable piece 277 is in the opened state. Therefore, the clamp-fitted portion 267 of the push rod 260 is not linked to the bendable piece 277 of the support member 270.

When the user rotates the driving body 30 in the first direction (in the normal direction) with respect to the body tube 20, the push rod 260 is rotated in the first direction with respect to the internal thread member 50 together with the driving body 30. Because the internal thread 53 is threaded with the external thread 61*a*, as the push rod 260 is rotated in the first direction with respect to the internal thread member 50, the push rod 260 is advanced with respect to the body tube 20.

As the push rod 260 is advanced, the rear end surface 257*b* of the support member 270 of the cartridge 202 is pushed by the flange part 267*d* of the push rod 260, the support member 270 is advanced in the through hole 217 of the cartridge outer tube 210 together with the push rod 260, and then, the cosmetic 204 stored in the cartridge outer tube 210 is pushed out from the front end opening 11*a*.

As shown in FIGS. 17A to 17C, when the bendable piece 277 is inserted in the base-end sliding hole 17*b* of the through hole 217 as the push rod 260 is advanced by the feeding mechanism 8 and the support member 270 is pushed by the push rod 260, the bendable piece 277 is distorted by coming into contact with the inner circumferential surface of the base-end sliding hole 17*b*, and thereby, the bendable piece 277 is shifted to the closed state. In other words, the inward pushing force from the inner circumferential surface of the base-end sliding hole 17*b* acts on the tip end side of the bendable piece 277 to make the bendable piece 277 elastically deformed about the base end side as the fulcrums, and thereby, the bendable piece 277 is shifted to the closed state.

With such a configuration, the bendable piece 277 that is provided on the base end of the support member 270 and the clamp-fitted portion 267 that is provided on the tip end of the push rod 260 are linked in the base-end sliding hole 17*b*. In the closed state, the bendable piece 277 is elastically deformed inwardly such that a top surface of a tip end portion face the step portion 267*c*. The bendable piece 277 is clamp fitted to the recessed portion 267*p* formed by the cylindrical column portion 267*b*, the head portion 267*a*, and the flange part 267*d* of the clamp-fitted portion 267.

The linkage unreleasable state is established when the linking portion 299 is placed in the base-end sliding hole 17*b* and the bendable piece 277 is clamp fitted to the clamp-fitted portion 267 by being shifted to the closed state.

In the linkage unreleasable state, the support member 270 is moved rearward and forward in the through hole 217 of the cartridge outer tube 210 along with the rearward and forward movement of the push rod 260. Therefore, the linking portion 299 of the base end of the support member 270 and the tip end of the push rod 260 is moved rearward and forward in the linkage unreleasable state through the base-end sliding hole 17*b* in conjunction with the stroke of the push rod 260.

From the state shown in FIGS. 17A to 17C, as the push rod 260 is advanced by rotating the driving body 30 in the normal direction, the support member 270 is pushed by the push rod 260 along with the advancement, and the bendable piece 277 is inserted into the tip-end storing hole 217*a*. When the bendable piece 277 is inserted into the tapered hole 217*e*, the bendable piece 277 gradually opens outward by its elastic force along with the advancement.

As shown in FIG. 18, when the push rod 260 is advanced to the forward limit position by the feeding mechanism 8, the linking portion 299 of the tip end of the push rod 260 and the base end of the support member 270 is positioned in the linkage releasable region. The linkage releasable region is the region in which the linking portion 299 is moved out from the base-end sliding hole 17*b* and moved into the tip-end storing hole 217*a*, and the linkage between the tip end of the push rod 260 (the clamp-fitted portion 267 in this embodiment) and the base end of the support member 270 (the bendable piece 277 in this embodiment) can be released. When the bendable piece 277 is placed in the base-end cavity portion on the base end side of the tip-end storing hole 217*a* serving as the linkage releasable region, the protrusion 277*b* of the bendable piece 277 and the inner circumferential surface of the through hole 217 are no longer in contact with each other.

Note that, in a state in which the push rod 260 is positioned at the forward limit position, a state in which the support member 270 is also positioned at the forward limit position is established. In other words, the forward limit position of the support member 270 corresponds to the position of the support member 270 when the linking portion 299 is moved out from the base-end sliding hole 17*b* and positioned in the linkage releasable region.

As described above, the linking portion 299 is moved out from the base-end sliding hole 17*b* by the feeding mechanism 8 and moved into the base-end cavity portion that forms the linkage releasable region in the tip-end storing hole 217*a*. When the linking portion 299 is placed in the base-end cavity portion, the bendable piece 277 is shifted to the opened state, and therefore, it becomes possible to release the linkage between the base end of the support member 270 (the bendable piece 277 in this embodiment) and the tip end of the push rod 260 (the clamp-fitted portion 267 in this embodiment).

Note that, according to this embodiment, at the state in which the bendable piece 277 is positioned in the base-end cavity portion, the bendable piece 277 opens outward such that the protrusion 277*b* of the bendable piece 277 of the support member 270 is placed outer side of the step portion 267*c* of the clamp-fitted portion 267 of the push rod 260. Therefore, in a state in which the push rod 260 is positioned at the forward limit position, the clamp-fitted portion 267 and the bendable piece 277 are in a state in which the clamp-fitted portion 267 and the bendable piece 277 are not in contact with each other and can move in the axial direction relative to each other. Even if the push rod 260 is reversed from this state, the support member 270 is not reversed.

According to the second embodiment as described above, operational advantages similar to those in the first embodiment are achieved.

First Modification of Second Embodiment

In the above-mentioned second embodiment, although a description is given of an example in which the bendable piece 277 serving as the opening and closing portion is provided on the base end side of the support member 270, and the clamp-fitted portion 267 is provided on the tip end side of the push rod 260, the present invention is not limited to this configuration. The bendable piece 277 serving the opening and closing portion may be provided on the tip end side of the push rod 260, and the clamp-fitted portion 267 may be provided on the base end side of the support member 270.

Third Embodiment

A cartridge-type cosmetic container 300 according to a third embodiment of the present invention will be described below. Note that, in the figures, components that are the same as or similar to those in the second embodiment are assigned the same reference numerals, and the differences are mainly described.

Figure 22:
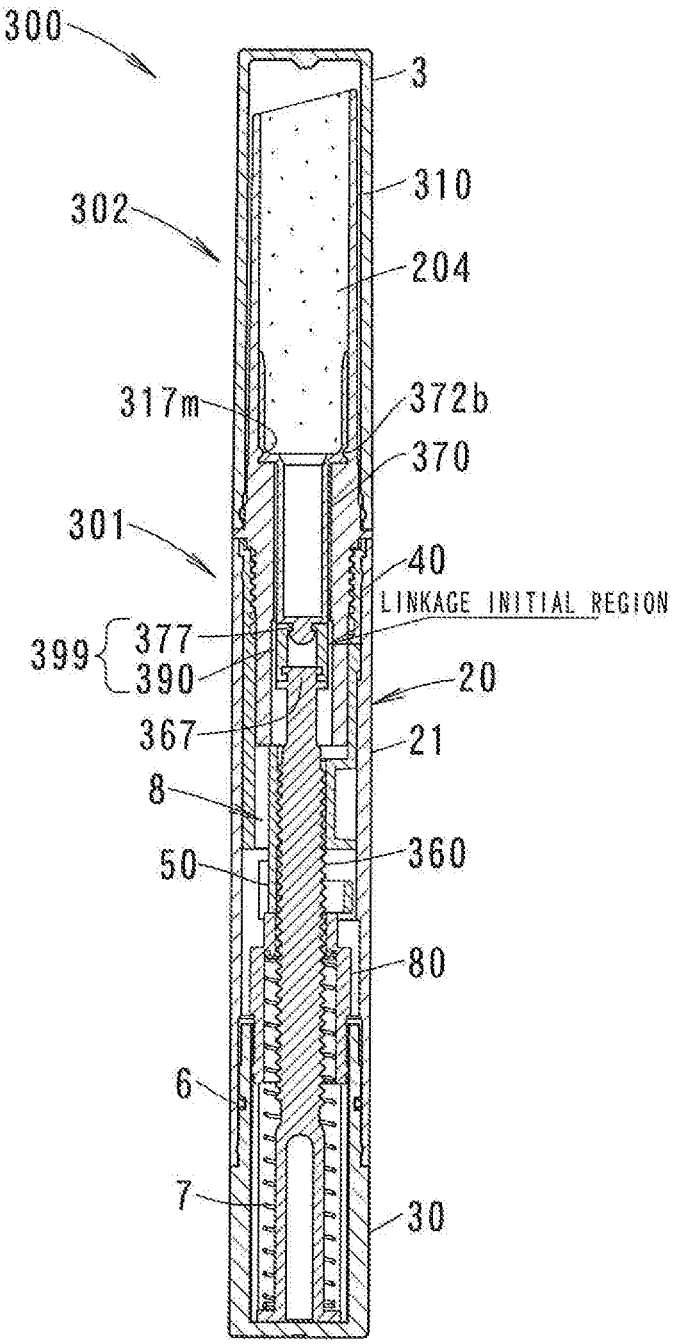
FIG. 22 is a front sectional view showing a state in which the push rod of the cartridge-type cosmetic container according to a third embodiment of the present invention is positioned at the rearward limit position.
Figure 23A:
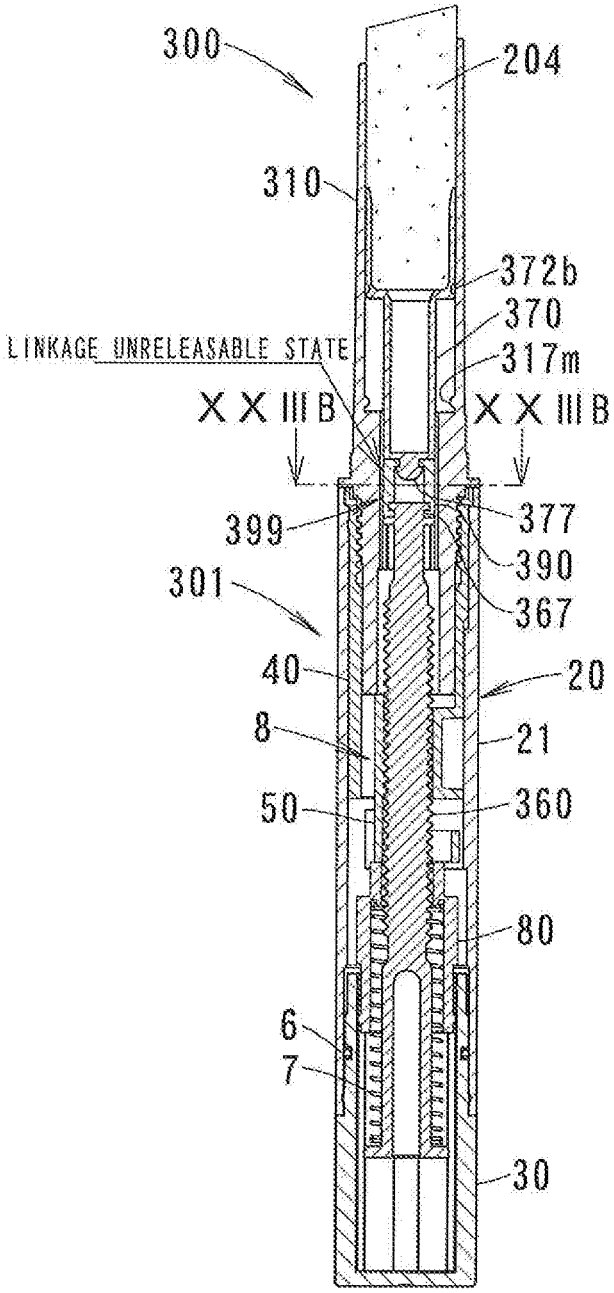
FIG. 23A is a front sectional view showing a state in which the push rod of the cartridge-type cosmetic container according to the third embodiment of the present invention is positioned between the rearward limit position and the forward limit position.
Figure 23B:
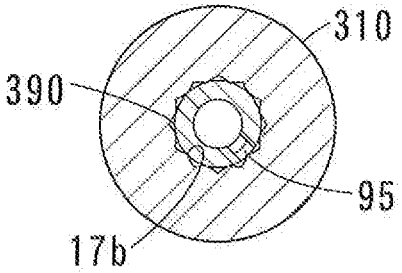
FIG. 23B is an enlarged sectional view taken along XXIIIB-XXIIIB in FIG. 23A.
Figure 24:
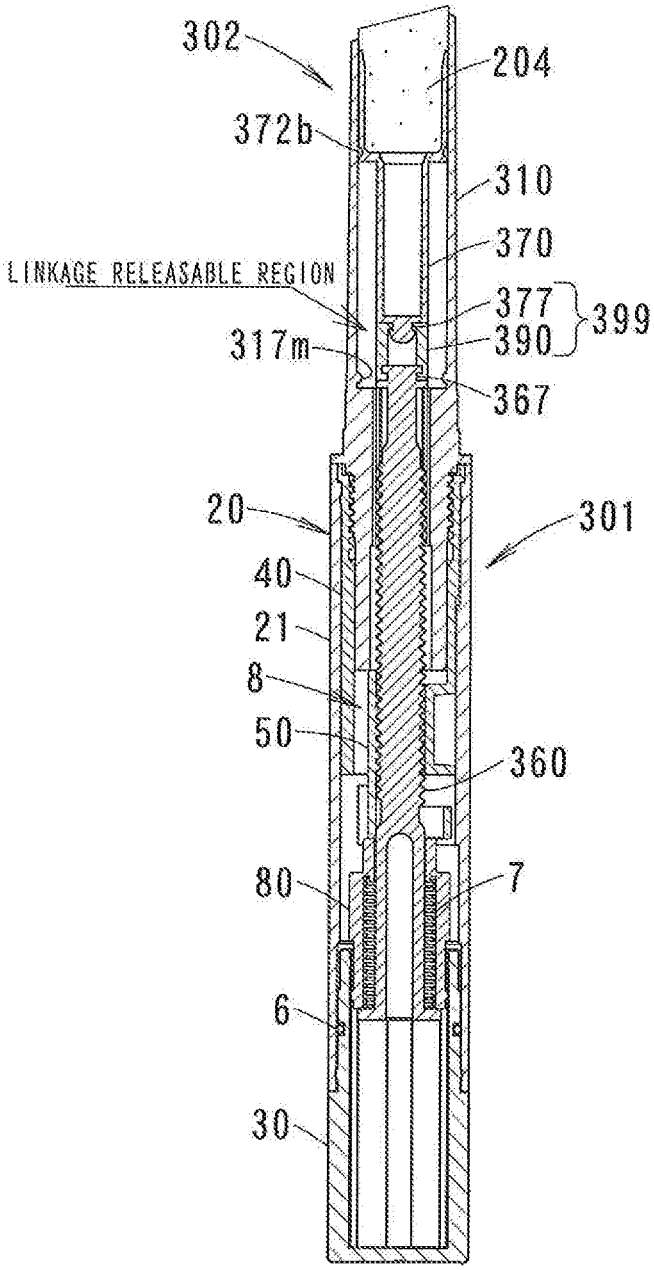
FIG. 24 is a front sectional view showing a state in which the push rod of the cartridge-type cosmetic container according to the third embodiment of the present invention is positioned at the forward limit position.
Figure 25D:
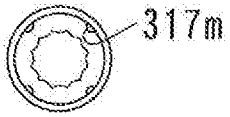
FIG. 25D is a plan view of the cartridge outer tube viewed from the front side.
Figure 25A:
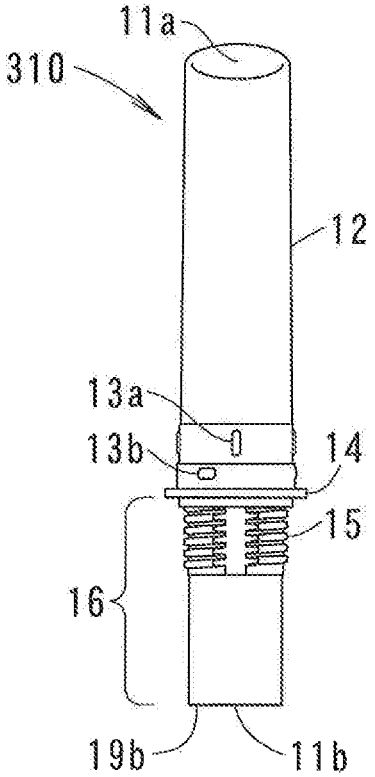
FIG. 25A is a side view of the cartridge outer tube.
Figure 25C:
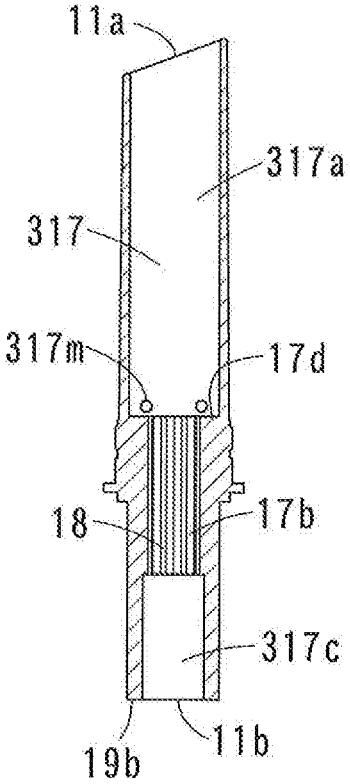
FIG. 25C is a front sectional view of the cartridge outer tube.
Figure 25B:
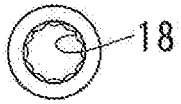
FIG. 25B is a bottom view of the cartridge outer tube.

As shown in FIGS. 22 to 24, the cartridge-type cosmetic container 300 is provided with a cartridge holder 301 and a cartridge 302.

The cartridge 302 according to the third embodiment will be described. In the second embodiment, the tip-end storing hole 217*a* of the through hole 217 has the tapered hole 217*e* (see FIGS. 19A and 19B), and the base end hole 217*c* of the through hole 217 has the tapered hole 217*f*. In contrast, in the third embodiment, as shown in FIGS. 25A to 25D, a tip-end storing hole 317*a* of a through hole 317 does not have the tapered hole 217*e*. In addition, a base end hole 317*c* of the through hole 317 does not have the tapered hole 217*f*.

As shown in FIGS. 25A to 25D, protrusions 317*m* are provided in the tip-end storing hole 317*a* storing the cosmetic 204 so as to protrude radially inward from the inner circumferential surface of the tip-end storing hole 317*a*. A plurality of protrusions 317*m* are provided at equal intervals in the in the circumferential direction (four in this embodiment). As the protrusions 317*m* are fitted into an annular recessed portion 372*b* (see FIGS. 26A to 26C) provided in a support tube (support portion) 372, a support member 370 is locked in the axial direction.

In the second embodiment, the bendable piece 277 serving as the opening and closing portion capable of being opened and closed through the elastic deformation is provided on the base end of the support member 270 (see FIGS. 20A to 20C). In contrast, in the third embodiment, as shown in FIGS. 27A to 27D, a linking member 390 serving as the opening and closing portion capable of being opened and closed through the elastic deformation is provided on a tip end of a push rod 360.

In the second embodiment, the clamp-fitted portion 267 to which the bendable piece 277 is clamp fitted is provided on the tip end of the push rod 260 (see FIGS. 21A and 21B). In contrast, in the third embodiment, as shown in FIGS. 26A to 26C, a clamp-fitted portion 377 to which the linking member 390 is clamp fitted is provided on a base end of the support member 370.

Figure 26A:
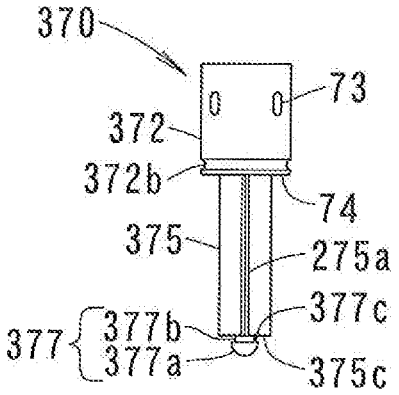
FIG. 26A is a front view of the support member.
Figure 26B:
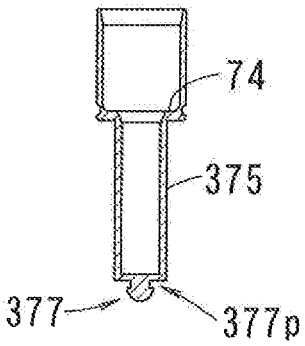
FIG. 26B is a front sectional view of the support member.
Figure 26C:
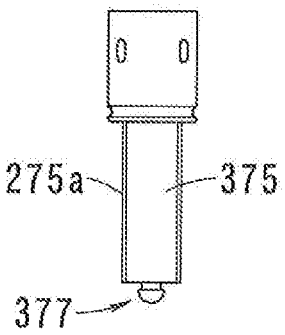
FIG. 26C is a side view of the support member.

As shown in FIGS. 26A to 26C, the clamp-fitted portion 377 has a cylindrical column portion 377*b* having a cylindrical column shape that is protruded outward in the axial direction from a bottom surface 375*c* of a rod shaft portion 375 having a bottomed cylindrical shape and a head portion 377*a* having a hemispherical shape that is provided on a tip end of the cylindrical column portion 377*b*. A diameter of the cylindrical column portion 377*b* is smaller than a diameter of the rod shaft portion 375 and is smaller than a diameter of the head portion 377*a*.

In the third embodiment, an outer circumferential surface of the cylindrical column portion 377*b*, a bottom surface 377*c* of the head portion 377*a*, and the bottom surface 375*c* of the rod shaft portion 375 form a recessed portion 377*p* to which a fitting projection 93 of the linking member 390, which will be described later, is clamp fitted (see FIGS. 27A to 27D).

An outer circumferential surface of the support tube 372 is provided with the annular recessed portion 372*b* that is formed so as to be recessed inwardly. The protrusions 317*m* that is provided in the through hole 317 of a cartridge outer tube 310 described above is fitted to the annular recessed portion 372*b*.

The push rod 360 that is built in the cartridge holder 301 according to the third embodiment will be described. As shown in FIGS. 27A to 27D, the linking member 390 is attached to the tip end of the push rod 360. A tip end of the rod shaft 61 is formed with an attachment portion 367 to which the linking member 390 is attached.

Figure 27B:
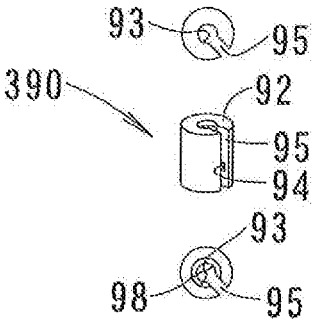
FIG. 27B is a diagram for explaining a linking member and shows a plan view from the front side, a perspective view, and a bottom view of the linking member.
Figure 27D:
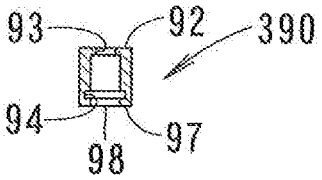
FIG. 27D is a sectional view of the linking member.
Figure 27A:
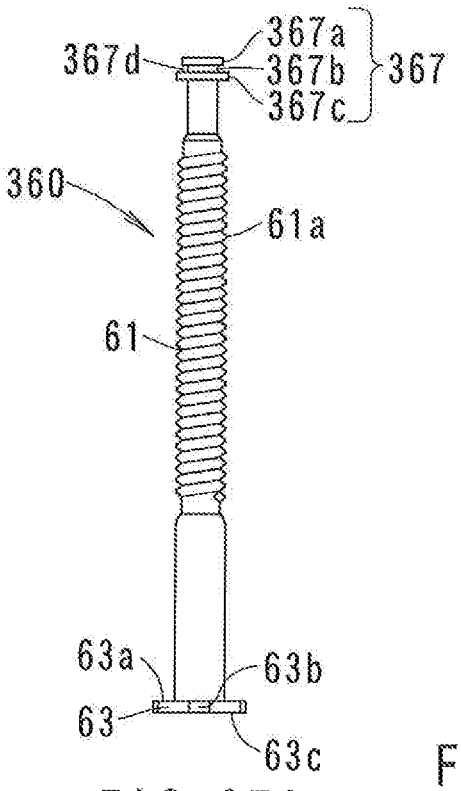
FIG. 27A is a front view of the push rod.
Figure 27C:
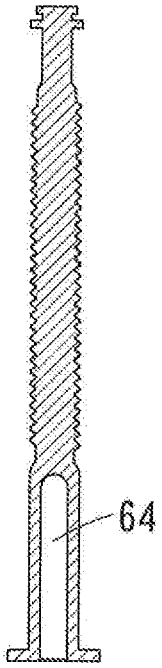
FIG. 27C is a front sectional view of the push rod.

As shown in FIGS. 27A and 27C, the attachment portion 367 is formed of the rod shaft 61 and concentric three circular plate portions. The three circular plate portions forming the attachment portion 367 are arranged such that a small-diameter circular plate portion 367*b* is sandwiched between a middle-diameter circular plate portion 367*a* that is positioned at the tip end (the front end) of the push rod 360 and a large-diameter circular plate portion 367*c*. A diameter of the middle-diameter circular plate portion 367*a* is larger than a diameter of the small-diameter circular plate portion 367*b*, and a diameter of the large-diameter circular plate portion 367*c* is larger than a diameter of the middle-diameter circular plate portion 367*a*.

On the attachment portion 367, an annular recessed portion 367*d* is formed by an outer circumferential side surface of the small-diameter circular plate portion 367*b*, a rear end surface of the middle-diameter circular plate portion 367*a*, and a front end surface of the large-diameter circular plate portion 367*c*.

As shown in FIGS. 27B and 27D, the linking member 390 is a bottomed cylindrical shape member having a bottom portion on a tip end surface 92 side and an opening portion 98 on a base end surface 97 side. A circular opening portion is formed in the bottom portion of the linking member 390. An inner circumferential surface of this circular opening portion forms a tip end surface of the fitting projection 93 that projects inward from a front end of a cylindrical portion of the linking member 390. An inner circumferential surface of the base end side of the linking member 390 is formed with an annular recessed portion 94 that is formed so as to be recessed radially outward.

A slit 95 is formed in the linking member 390 so as to extend in the axial direction from the tip end surface 92 to the base end surface 97. Because the slit 95 is formed, the linking member 390 has an appearance of C-shape in its cross-section.

The linking member 390 is formed of an elastic member capable of being opened and closed through elastic deformation. With the linking member 390, a state in which a dimension between a pair of end surfaces forming the slit 95 is shorter than a predetermined distance is defined as the closed state. As shown in FIG. 27B, when no external force is exerted, the linking member 390 is in the closed state. The linking member 390 is shifted to the opened state by being elastically deformed such that the dimension between the pair of end surfaces forming the slit 95 become equal to or longer than the predetermined distance.

In this embodiment, if a pulling force sufficiently strong to separate the linking member 390 and the clamp-fitted portion 377 from each other is applied when the linking member 390 is clamp fitted to the clamp-fitted portion 377, the linking member 390 is elastically deformed and shifted to the opened state. When the linking member 390 is in the opened state, the distance between the pair of end surfaces forming the slit 95 is increased compared with that in the closed state, and so, it is possible to separate the linking member 390 and the clamp-fitted portion 377. In other words, as the linking member 390 is shifted to the opened state, the linkage between the base end of the support member 370 and the tip end of the push rod 360 becomes releasable.

In addition, if a pushing force is applied such that the clamp-fitted portion 377 is inserted from the circular opening portion of the tip end surface 92 of the linking member 390 when the linking member 390 and the clamp-fitted portion 377 are separated, the linking member 390 is elastically deformed and shifted to the opened state. Therefore, by pushing the clamp-fitted portion 377 into the circular opening portion of the tip end surface 92 of the linking member 390, it is possible to attach the clamp-fitted portion 377 to the linking member 390.

The middle-diameter circular plate portion 367*a* provided on a tip end of the attachment portion 367 is fitted to the annular recessed portion 94 of the linking member 390, and a portion between the annular recessed portion 94 of the linking member 390 and the base end surface 97 is fitted to the annular recessed portion 367*d* of the attachment portion 367. With such a configuration, the linking member 390 is attached to the attachment portion 367.

Note that, the linking member 390 can easily be attached to the attachment portion 367 by elastically deforming the linking member 390 such that the base end side is opened.

A method of using the cartridge-type cosmetic container 300 will be described with main reference to FIGS. 22 to 24. FIG. 22 show a state before using the cartridge holder 301, and show the cartridge-type cosmetic container 300 in a state in which the push rod 360 is positioned at the rearward limit position. FIG. 24 shows the cartridge-type cosmetic container 300 in a state in which the push rod 360 is positioned at the forward limit position. FIG. 23A and FIG. 23B show the cartridge-type cosmetic container 300 in a state in which the push rod 360 is at the feed-out intermediate position.

In the third embodiment, the clamp-fitted portion 377 is inserted into the linking member 390 provided on the tip end of the push rod 360 by attaching the cartridge 302 to the cartridge holder 301. With such a configuration, the fitting projection 93 of the linking member 390 is clamp fitted to the recessed portion 377*p* that is formed by the cylindrical column portion 377*b* and the head portion 377*a* of the clamp-fitted portion 377, and the rod shaft portion 375. Note that, when the clamp-fitted portion 377 is inserted into the circular opening portion of the tip end surface 92 of the linking member 390, the linking member 390 is elastically deformed and shifted to the opened state.

As shown in FIG. 22, in a state in which the push rod 360 is positioned at the rearward limit position, a linking portion 399 of the tip end of the push rod 360 and the base end of the support member 370 is placed in the linkage initial region. The linkage initial region is the region in which the linkage between the tip end of the push rod 360 (the linking member 390 in this embodiment) and the base end of the support member 370 (the clamp-fitted portion 377 in this embodiment) can be released.

When the linking portion 399 is positioned at the linkage initial region, the linking member 390 is placed in the base end hole 317*c* in the through hole 317. As the user releases the threaded state between the external thread 15 of the cartridge 302 and the internal thread 43 of the cartridge holder 301 at this state, the clamp-fitted portion 377 is pulled out from the linking member 390, and thereby, the linkage between the linking member 390 and the clamp-fitted portion 377 is released. When the clamp-fitted portion 377 is pulled out, the linking member 390 is elastically deformed and shifted to the opened state.

As shown in FIG. 22, in a state in which the linking portion 399 is positioned in the linkage initial region, when the user rotates the driving body 30 in the first direction (in the normal direction) with respect to the body tube 20, the push rod 360 is rotated in the first direction together the driving body 30 with respect to the internal thread member 50. Because the internal thread 53 is threaded with the external thread 61*a*, as the push rod 360 is rotated in the first direction with respect to the internal thread member 50, the push rod 360 is advanced with respect to the body tube 20.

As the push rod 360 is advanced, the bottom surface 375*c* of the rod shaft portion 375 of the support member 370 of the cartridge 302 is pushed by the tip end surface 92 of the linking member 390, the support member 370 is advanced in the through hole 317 of the cartridge outer tube 310 together with the push rod 360, and then, the cosmetic 204 stored in the cartridge outer tube 310 is pushed out from the front end opening 11*a*.

As shown in FIGS. 23A and 23B, when the linking member 390 is inserted in the base-end sliding hole 17*b* of the through hole 317 as the push rod 360 is advanced by the feeding mechanism 8 and the support member 370 is pushed by the push rod 360, the linking member 390 is constrained such that the shift to the opened state is prohibited by the inner circumferential surface of the base-end sliding hole 17*b*.

Specifically, when the linking portion 399 is placed in the base-end sliding hole 17*b*, if the pushing force is applied from the attachment portion 367 to the linking member 390, or if the pulling force is applied from the clamp-fitted portion 377 to the linking member 390, the linking member 390 is elastically deformed so as to open outward. When the linking member 390 is elastically deformed so as to open outward, the pushing force directed inward from the inner circumferential surface of the base-end sliding hole 17*b* acts on an outer circumferential surface of the linking member 390. Because a constraint force is applied to the linking member 390 by the inner circumferential surface of the base-end sliding hole 17*b*, the amount of elastic deformation of the linking member 390 is suppressed such that the dimension between the pair of end surfaces forming the slit 95 of the linking member 390 is kept shorter than the predetermined distance, and thus, the closed state is maintained.

With such a configuration, the linking portion 399 formed of the clamp-fitted portion 377 provided on the base end of the support member 370 and the linking member 390 provided on the tip end of the push rod 360 slides in the base-end sliding hole 17*b* in the linkage unreleasable state.

In this embodiment, the linking portion 399 is formed of the linking member (the opening and closing portion) 390 that is provided on the tip end of the push rod 360 and that is capable of being opened and closed through the elastic deformation and the clamp-fitted portion 377 that is provided on the base end of the support member 370. When the linking portion 399 is placed in the base-end sliding hole 17*b*, the linking member 390 is constrained by the inner circumferential surface of the base-end sliding hole 17*b*, and thereby, the linking member 390 is maintained in the closed state.

In the linkage unreleasable state, the support member 370 is moved rearward and forward in the through hole 317 of the cartridge outer tube 310 along with the rearward and forward movement of the push rod 360. Therefore, the linking portion 399 of the base end of the support member 370 and the tip end of the push rod 360 is moved rearward and forward in the linkage unreleasable state through the base-end sliding hole 17*b* in conjunction with the stroke of the push rod 360.

From the state shown in FIG. 23A and FIG. 23B, as the push rod 360 is advanced by rotating the driving body 30 in the normal direction, the support member 370 is pushed by the push rod 360 along with the advancement, and the linking member 390 is inserted into the tip-end storing hole 317*a*.

As shown in FIG. 24, when the push rod 360 is advanced to the forward limit position by the feeding mechanism 8, the linking portion 399 of the tip end of the push rod 360 and the base end of the support member 370 is positioned in the linkage releasable region. The linkage releasable region is the region in which the linking portion 399 is moved out from the base-end sliding hole 17*b* and moved into the tip-end storing hole 317*a*, and the linkage between the tip end of the push rod 360 (the linking member 390 in this embodiment) and the base end of the support member 370 (the clamp-fitted portion 377 in this embodiment) can be released. When the linking member 390 is placed in the base-end cavity portion on the base end side of the tip-end storing hole 317*a* that is the linkage releasable region, the linking member 390 and an inner circumferential surface of the through hole 317 are no longer in contact with each other.

Note that, in a state in which the push rod 360 is positioned at the forward limit position, a state in which the support member 370 is also positioned at the forward limit position. In other words, the forward limit position of the support member 370 corresponds to the position of the support member 370 when the linking portion 399 is moved out from the base-end sliding hole 17*b* and positioned in the linkage releasable region.

As described above, the linking portion 399 is moved out from the base-end sliding hole 17*b* by the feeding mechanism 8 and moved into the base-end cavity portion that forms the linkage releasable region in the tip-end storing hole 317*a*. When the linking portion 399 is positioned inside the base-end cavity portion, the linking member 390 is released from the constraint by the inner circumferential surface of the through hole 317, and it becomes possible to release the linkage between the base end of the support member 370 (the clamp-fitted portion 377 in this embodiment) and the tip end of the push rod 360 (the linking member 390 in this embodiment).

A procedure of detaching the finished cartridge 302 from the cartridge holder 301 will be described with reference to FIG. 24.

In a case in which the push rod 360 is positioned at the forward limit position and the cartridge 302 has reached the usage-limited state, a state in which the linkage between the support member 370 and the push rod 360 can be released is established. Because the linking member 390 is in a state in which it is not constrained from the outer side, if the support member 370 is pulled out in the forward direction together with the cartridge outer tube 310, the linking member 390 is elastically deformed such that the slit 95 is opened, and the linking member 390 is shifted to the opened state, and so, it is possible to detach the clamp-fitted portion 377 of the support member 370 from the linking member 390. Therefore, the user can readily separate the cartridge 302 from the body tube 20 by relatively rotating the cartridge outer tube 310 and the body tube 20 such that the threaded state between the external thread 15 of the cartridge outer tube 310 and the internal thread 43 of the body inner tube 40 is released.

According to the third embodiment as described above, following operational advantages are achieved in addition to the operational advantages similar to those in (1) to (4), (6), (7), (10), and (11) described in the first embodiment.

(15) In the third embodiment, at the time when the cartridge 302 is attached to the cartridge holder 301, the push rod 360 is linked to the support member 370 by the linking portion 399 in the base end hole 317*c*. When the push rod 360 is to be linked to the support member 370, the linking member 390 is shifted to the opened state as the linking member 390 provided on the tip end of the push rod 360 is pressed against the clamp-fitted portion 377 of the support member 370, and therefore, the linking member 390 is linked to the clamp-fitted portion 377.

However, because the cosmetic 204 according to the third embodiment is a molded core and is of a hard type, unlike the cosmetic 4 of the soft type described in the first embodiment, the cosmetic 204 is not in close contact with the inner circumferential surface of the tip-end storing hole 317*a*. Therefore, during the procedure of attaching the cartridge 302 to the cartridge holder 301 and linking the push rod 360 to the support member 370, the support member 370 may be moved forward in the axial direction with respect to the cartridge outer tube 310 as the linking member 390 is pressed against the clamp-fitted portion 377, and therefore, there is a risk in that the push rod 360 cannot be linked to the support member 370.

Thus, the third embodiment employs a configuration in which the annular recessed portion 372*b* is provided in the support tube 372 and the protrusions 317*m* is provided in the through hole 317, and thereby, the annular recessed portion 372*b* is fitted to the protrusions 317*m* when the support member 370 is positioned at the rearward limit position. With such a configuration, during the procedure of attaching the cartridge 302 to the cartridge holder 301 to link the push rod 360 and the support member 370, the support member 370 is prevented from being moved forward in the axial direction with respect to the cartridge outer tube 310, and therefore, it is possible to reliably link the linking member 390 and the clamp-fitted portion 377.

(16) In addition, because the opening and closing of the linking member 390 is performed smoothly by the insertion of the clamp-fitted portion 377, even if the cartridge-type cosmetic container 300 is used over a long period of time, the linking member 390 is not damaged and the linking member 390 need not be replaced.

First Modification of Third Embodiment

In the above-mentioned third embodiment, although a description is given of an example in which the linking member 390 is detachably provided on the tip end of the push rod 360, the present invention is not limited to this configuration. The linking member 390 may be provided by welding to or integrally molding with the tip end of the push rod 360 so as not to be detachable.

Fourth Embodiment

A cartridge-type cosmetic container 400 according to a fourth embodiment of the present invention will be described below. Note that, in the figures, components that are the same as or similar to those in the second embodiment are assigned the same reference numerals, and the differences are mainly described.

Figure 28:
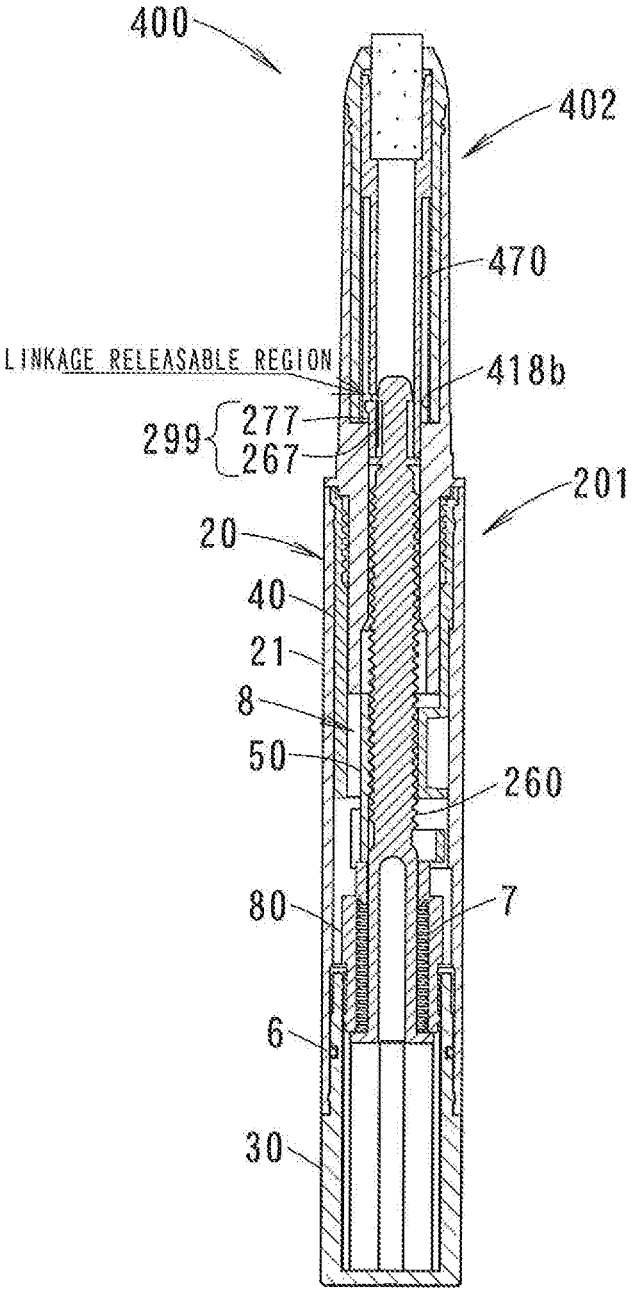
FIG. 28 is a front sectional view showing a state in which the push rod of the cartridge-type cosmetic container according to a fourth embodiment of the present invention is positioned at the forward limit position.

As shown in FIG. 28, the cartridge-type cosmetic container 400 is provided with the cartridge holder 201 and a cartridge 402. The configuration of the cartridge holder 201 is similar to that of the second embodiment, and a description thereof is omitted.

In the second embodiment, the cartridge outer tube 210 is formed of the single member. In contrast, in the fourth embodiment, as shown in FIGS. 29A to 30F, a cartridge outer tube 410 is formed by detachably linking two members, an outer tube body 410*a* and a cosmetic storing tube 410*b*.

In the outer tube body 410*a*, an attachment hole 410*c* in communication with the base-end sliding hole 417*b* is provided on the front side of a base-end sliding hole 417*b*. The attachment hole 410*c* is a through hole to which a fitting portion 410*h* of the cosmetic storing tube 410*b* is fitted, and a longitudinal groove 410*d* and a fitting recess 410*e* are formed in the attachment hole 410*c* in the vicinity of a tip end thereof.

The cosmetic storing tube 410*b* is provided with the fitting portion 410*h* that is fitted to the attachment hole 410*c* of the outer tube body 410*a* and a head portion 410*g* that forms the outer hull of the cartridge outer tube 410. In the head portion 410*g*, the base end side thereof is set to have an outer diameter larger than an outer diameter of the fitting portion 410*h*. Therefore, a bottom surface of the head portion 410*g* is formed to have a step portion.

An outer circumference of the fitting portion 410*h* is provided with ribs 410*i* and a fitting projection 410*j* that project radially outward. When the cosmetic storing tube 410*b* is fitted to the attachment hole 410*c*, the ribs 410*i* engage with the longitudinal groove 410*d* provided in an inner circumference of the attachment hole 410*c*, and thereby, the relative rotation of the cosmetic storing tube 410*b* with respect to the outer tube body 410*a* is restricted.

When the cosmetic storing tube 410*b* is fitted to the attachment hole 410*c*, the fitting projection 410*j* is fitted to the fitting recess 410*e* provided in the inner circumference of the attachment hole 410*c*, and thereby, the cosmetic storing tube 410*b* is prevented from being dismounted from the attachment hole 410*c*. As described above, the cosmetic storing tube 410*b* is fixed to the attachment hole 410*c* as the ribs 410*i* are fitted to the longitudinal groove 410*d* and as the fitting projection 410*j* is fitted to the fitting recess 410*e*.

Figures 29A, 29B, 29C, 29D:
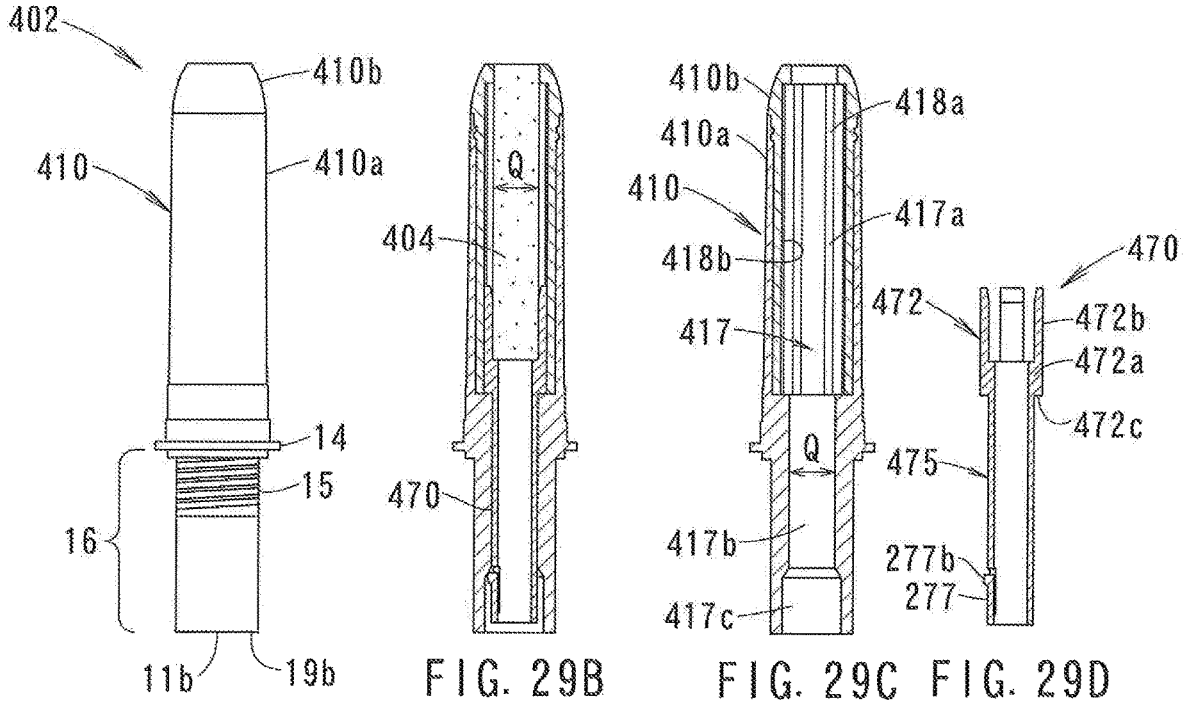
FIG. 29A is a front view of the cartridge.
FIG. 29B is a front sectional view of the cartridge.
FIG. 29C is a front sectional view of the cartridge outer tube.
FIG. 29D is a front sectional view of the support member.

As shown in FIG. 29C, as the cosmetic storing tube 410*b* is attached to the outer tube body 410*a*, a through hole 417 of the cartridge outer tube 410 is formed. The through hole 417 has a tip-end storing hole 417*a* that is formed in the cosmetic storing tube 410*b*, and the base-end sliding hole 417*b* and a base end hole 417*c* that are formed in the outer tube body 410*a*.

Figures 30A, 30B, 30C, 30D, 30E, 30F:
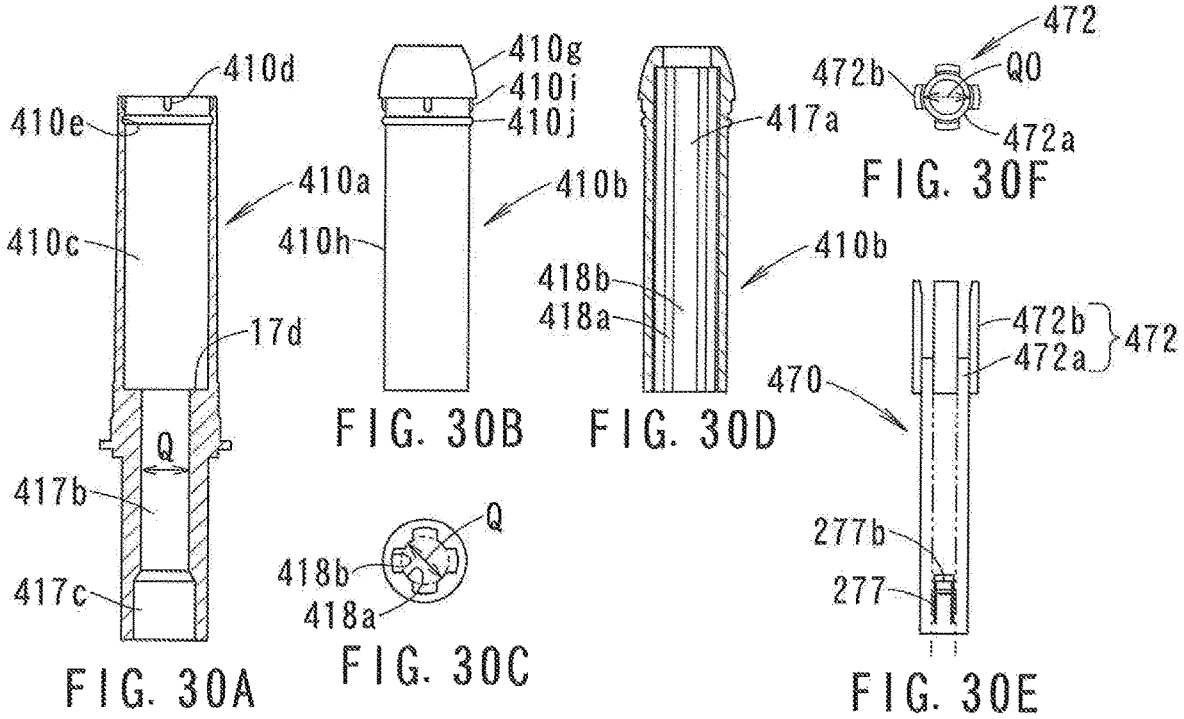
FIG. 30A is a front sectional view of an outer tube body.
FIG. 30B is a front view of a cosmetic storing tube.
FIG. 30C is a bottom view of the cosmetic storing tube.
FIG. 30D is a front sectional view of the cosmetic storing tube.
FIG. 30E is a front view of the support member.
FIG. 30F is a plan view of the support member.

The tip-end storing hole 417*a* is a through hole for storing a cosmetic 404. As shown in FIGS. 30C and 30D, the tip-end storing hole 417*a* is a circular through hole, and recessed sliding grooves 418*b* are provided in an inner circumferential surface 418*a* of the tip-end storing hole 417*a* so as to be recessed radially outward and to extend in the axial direction. Support catches 472*b* of a support portion 472 are respectively fitted to the sliding grooves 418*b*, and the support catches 472*b* slide along the sliding grooves 418*b*. When the support catches 472*b* slide along the sliding grooves 418*b*, the cosmetic 404 also slides along the inner circumferential surface 418*a*.

In the second embodiment, the bottomed cylindrical shaped support tube 72 is provided on a front end of the rod shaft portion 75 as a support portion for supporting the cosmetic 204. In contrast, in the fourth embodiment, as shown in FIGS. 29A to 30F, the support portion 472 supporting the cosmetic 404 is formed of a support base 472*a* having a circular plate shape and a plurality of (in this embodiment, four) support catches 472*b*. The support portion 472 is provided on a front end of a rod shaft portion 475.

The plurality of support catches 472*b* are provided on the support base 472*a* so as to extend forward in the axial direction from an outer circumferential side surface of the support base 472*a*. The plurality of support catches 472*b* are arranged at equal intervals in the in the circumferential direction along an outer circumferential edge of the support base 472*a*. The plurality of support catches 472*b* correspond to portions between slits that are adjacent to each other in the circumferential direction in a case in which the slits are formed in the tube portion of the bottomed cylindrical shape member so as to extend in the axial direction from the opening edge portion toward the bottom portion.

The cosmetic 404 is a cylindrical column shaped cosmetic core that is molded by using the cosmetic mold (not shown). An outer diameter Q of the cosmetic 4 is set to a dimension slightly larger than a minimum dimension Q0 between a pair of support catches 472*b* that oppose to each other. Therefore, the cosmetic 4 is held, at the outer circumferential side surface thereof, by being sandwiched by the plurality of support catches 472*b*. In addition, the cosmetic 4 is supported at a bottom surface thereof by the support base 472*a*. Note that, according to this embodiment, an inner diameter of the tip-end storing hole 417*a* and an inner diameter of the base-end sliding hole 417*b* are set to have substantially the same dimension as the outer diameter Q of the cosmetic 4.

In the second embodiment, the rib 275*a* provided on the outer circumferential surface of the rod shaft portion 275 is fitted to the valley portion of the corrugated portion 18 of the base-end sliding hole 17*b*, and thereby, the movement of the support member 270 in the circumferential direction with respect to the cartridge outer tube 210, in other words the relative rotation of the support member 270 is prohibited. In contrast, in the fourth embodiment, the rib 275*a* serving as the engaging protrusion is not provided on the rod shaft portion 475. In the fourth embodiment, as the plurality of support catches 472*b* are fitted to the sliding grooves 418*b* of the tip-end storing hole 417*a* and as the support catches 472*b* engage with, as the engaging protrusions, the sliding grooves 418*b* of the cartridge outer tube 410, the movement of a support member 470 in the circumferential direction with respect to the cartridge outer tube 410, in other words the relative rotation of the support member 470 is prohibited.

Because the rotation is restricted as the support catches 472*b* are fitted to the sliding grooves 418*b*, according to this embodiment, the base-end sliding hole 417*b* is not subjected to the knurling processing.

As shown in FIG. 30E, an arc length or width dimension of the bendable piece 277 is set so as to be equal to or less than an arc length or width dimension of the support catches 472*b*. In addition, the bendable piece 277 is provided so as to correspond to one of the plurality of support catches 472*b*, and the center of the one of the support catches 472*b* in the circumferential direction matches with the center of the bendable piece 277 in the circumferential direction. In other words, the bendable piece 277 is provided such that when imaginary lines (see two-dot chain lines in the figure) are extended in the axial direction from side surfaces of the one of the support catches 472*b*, the entire bendable piece 277 fits within a range between the pair of imaginary lines. In other words, it is possible to fit the bendable piece 277 to the sliding grooves 418*b*.

The release of the linkage for the cartridge-type cosmetic container 400 according to the fourth embodiment will be described with reference to FIG. 28. FIG. 28 shows the cartridge-type cosmetic container 400 in a state in which the push rod 260 is positioned at the forward limit position.

As shown in FIG. 28, when the push rod 260 is advanced to the forward limit position by the feeding mechanism 8, the linking portion 299 of the tip end of the push rod 260 and a base end of the support member 470 is positioned in the linkage releasable region. The linkage releasable region is the region in which the linking portion 299 is moved out from the base-end sliding hole 17*b* and moved into the tip-end storing hole 417*a*, and the linkage between the tip end of the push rod 260 (the clamp-fitted portion 267 in this embodiment) and the base end of the support member 470 (the bendable piece 277 in this embodiment) can be released. When the protrusion 277*b* of the tip end of the bendable piece 277 is placed in the sliding grooves 418*b* in the base-end cavity portion on the base end side of the tip-end storing hole 417*a* that is the linkage releasable region, the protrusion 277*b* of the bendable piece 277 and an inner circumferential surface of the through hole 417 are no longer in contact with each other.

As described above, the linking portion 299 is moved out from the base-end sliding hole 17*b* by the feeding mechanism 8 and moved into the base-end cavity portion that forms the linkage releasable region in the tip-end storing hole 417*a*. When the linking portion 299 is placed in the sliding grooves 418*b* in the base-end cavity portion, the bendable piece 277 is shifted to the opened state, and therefore, it becomes possible to release the linkage between the base end of the support member 470 (the bendable piece 277 in this embodiment) and the tip end of the push rod 260 (the clamp-fitted portion 267 in this embodiment).

Note that, when the cartridge 402 and the cartridge holder 201 are to be separated, the step portion 17*d* that is an opening edge portion of the base-end sliding hole 417*b* comes to contact with a rear end surface 472*c* of the support catches 472*b*, and thereby, the movement of the support portion 472 toward the base end side of the cartridge outer tube 410 is restricted. The support portion 472 is formed to have a substantially cylindrical shape with the plurality of support catches 472*b*, and the support portion 472 is formed to have the diameter larger than that of the rod shaft portion 475, and thereby, the support member 470 is prevented from being dismounted from the rear end opening 11*b* of the cartridge outer tube 410.

According to the fourth embodiment described above, following operational advantages are achieved in addition to the operational advantages in the first embodiment.

(17) Because the cartridge 402 is configured such that a core diameter (outer diameter) of the cosmetic 404 and an inner diameter of the base-end sliding hole 417*b* can be set to have substantially the same dimension, it is possible to use a bar-shaped cosmetic with a small diameter. The bar-shaped cosmetics with the small diameter tend to be hard and less volatile. Therefore, it is possible to omit the cap 3.

First Modification of Fourth Embodiment

In the above-mentioned fourth embodiment, although a description is given of an example in which the opened state is established when the support catches 472*b* are fitted to the sliding grooves 418*b*, the present invention is not limited to this configuration. As shown in FIGS. 31A to 31F, the base-end cavity portion 517*h* may be provided on the base end side of a tip-end storing hole 517*a*. In this modification, a cartridge outer tube 510 is formed of an outer tube body 510*a* and a cosmetic storing tube 510*b*. The tip-end storing hole 517*a* is formed of the base-end cavity portion 517*h* and a sliding opening portion 517*g* through which the cosmetic 404 and the support catches 472*b* slide.

Figure 32:
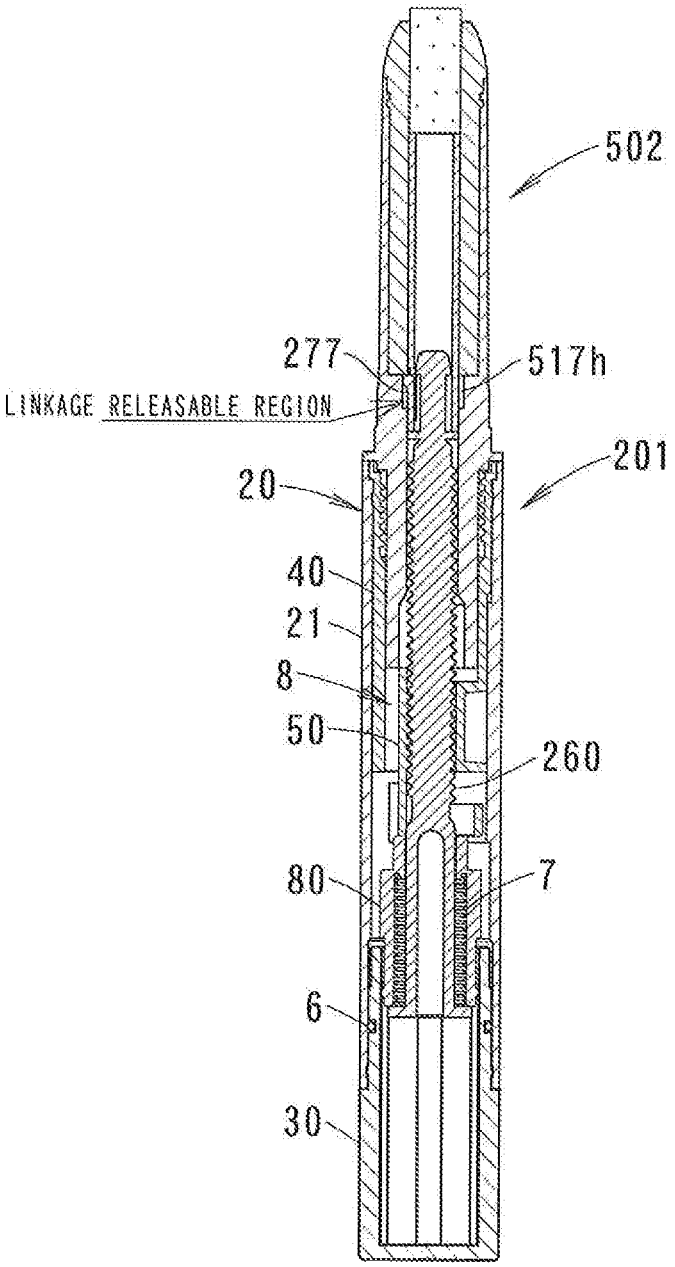
FIG. 32 is a front sectional view showing a state in which the push rod of the cartridge-type cosmetic container according to the modification of the fourth embodiment of the present invention is positioned at the forward limit position.

The base-end cavity portion 517*h* is provided in the outer tube body 510*a*. An inner diameter of the base-end cavity portion 517*h* is larger then the inner diameter of the base-end sliding hole 417*b*, and as shown in FIG. 32, when the base-end cavity portion 517*h* is positioned in the bendable piece 277, the bendable piece 277 is shifted to the opened state. Because it is not required to fit the bendable piece 277 to the sliding grooves 418*b*, as shown in FIG. 31E, a phase between the support catches 472*b* formed on a support member 570 and the bendable piece 277 may be deviated.

Note that, a cartridge 502 and the cartridge holder 201 are to be separated, the step portion 17*d* that is an opening edge portion of the base-end cavity portion 517*h* comes to contact with the rear end surface 472*c* of the support catches 472*b*, and thereby, the movement of the support portion 472 toward the base end side of the cartridge outer tube 510 is restricted. The support portion 472 is formed to have a substantially cylindrical shape with the plurality of support catches 472*b*, and the support portion 472 is formed to have the diameter larger than that of the rod shaft portion 475, and thereby, the support member 570 is prevented from being dismounted from the rear end opening 11*b* of the cartridge outer tube 510.

Modifications as described below also fall within the scope of the present invention, and it may possible to combine the configurations shown in the modifications with the configurations described in the above-described embodiments with each other, to combine the configurations described in the above-described different embodiments, and to combine the configurations described in the following different modifications with each other.

First Modification

In the above-mentioned embodiment, although a description is given of an example in which the cosmetic (4, 204, 404) is of a solid type, the present invention is not limited to this configuration. A cartridge 602 storing a liquid cosmetic 604 may be employed. As shown in FIGS. 33A to 33E, the cartridge 602 according to the present modification is provided with a cartridge outer tube 610, a support member 670 that is inserted into the cartridge outer tube 610, a brush member 609 attached to a tip end of the cartridge outer tube 610, and the cap 3. The cartridge 602 is used by being attached to the cartridge holder 1 according to the first embodiment, for example. The cartridge outer tube 610 is formed by detachably linking two members, an outer tube body 610*a* and a tip end tube 610*b*.

Figure 34B:
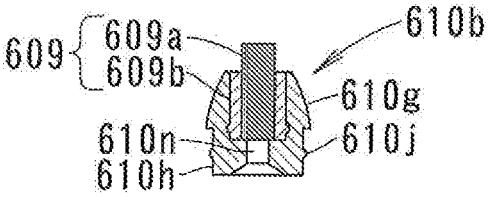
FIG. 34B is a front sectional view of the tip end tube of the cartridge.
Figure 34A:
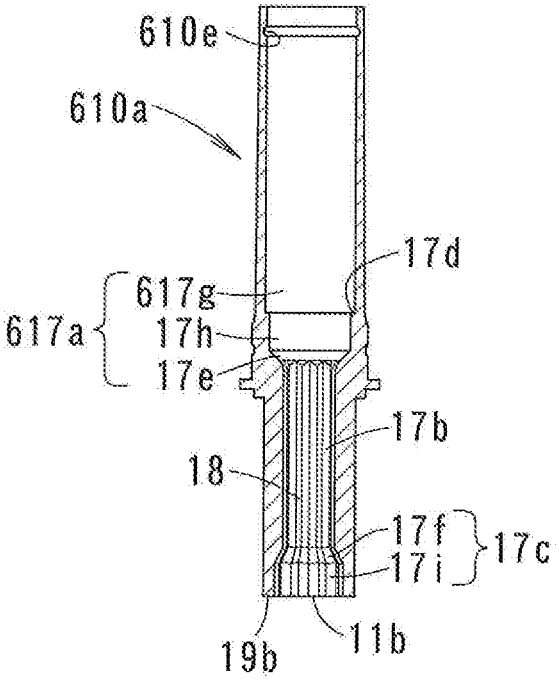
FIG. 34A is a front sectional view of the outer tube body of the cartridge according to the first modification of the present invention.

As shown in FIGS. 34A and 34B, the outer tube body 610*a* is formed with a tip-end storing hole 617*a*. The tip-end storing hole 617*a* has a sliding opening portion 617*g*, the base-end cavity portion 17*h*, and the tapered hole 17*e*. A fitting recess 610*e* is formed along the circumferential direction in an inner circumferential surface of the sliding opening portion 617*g* in the vicinity of a tip end.

The tip end tube 610*b* is provided with a fitting portion 610*h* that is fitted to the tip-end storing hole 617*a* of the outer tube body 610*a* and a head portion 610*g* that forms an outer hull of the cartridge outer tube 610. In the head portion 610*g*, the base end side thereof is set to have an outer diameter larger than an outer diameter of the fitting portion 610*h*. Therefore, a bottom surface of the head portion 610*g* is formed to have a step portion.

On an outer circumference of the fitting portion 610*h*, a fitting projection 610*j* is provided along the circumferential direction so as to protrude radially outward. When the tip end tube 610*b* is fitted to the sliding opening portion 617*g*, the fitting projection 610*j* is fitted to the fitting recess 610*e* provided in an inner circumference of the sliding opening portion 617*g*, and thereby, the tip end tube 610*b* is prevented from being dismounted from the sliding opening portion 617*g*.

As shown in FIGS. 33A to 33E, the liquid cosmetic 604 is stored in the cartridge outer tube 610. As shown in FIGS. 33A to 34B, in this modification, a storage chamber 610*q* for storing the cosmetic 604 is defined by a support portion 672 that supports the liquid cosmetic 604, an inner circumferential surface of the sliding opening portion 617*g*, and the tip end tube 610*b*. The support portion 672 is formed to have a circular plate shape, and a rod shaft portion 675 having a cylindrical column shape is provided so as to extend from the support portion 672.

The brush member 609 is attached to the tip end tube 610*b*. The brush member 609 has a bristle part 609*a* formed by binding a plurality of filamentous hair materials and a holding tube 609*b* having a cylindrical shape for holding the bristle part 609*a*. The holding tube 609*b* is fitted to a through hole of the tip end tube 610*b*.

The tip end tube 610*b* is provided with a communication hole 610*n* through which the storage chamber 610*q* is communicated with a through hole of the holding tube 609*b* (a space for holding the bristle part 609*a*). The communication hole 610*n* is a through hole for guiding the liquid cosmetic 604 from the storage chamber 610*q* to the bristle part 609*a*. The support member 670 is advanced as the push rod 60 is advanced, and a volume of the storage chamber 610*q* is reduced. The cosmetic 604 is compressed by the support member 670, and the cosmetic 604 stored in the storage chamber 610*q* is supplied to the bristle part 609*a* on the front side of the storage chamber 610*q* through the communication hole 610*n*.

As the push rod 60 is reversed, the support member 670 is also reversed. As the support member 670 is reversed, the cosmetic 604 supported by the support portion 672 is also reversed in the storage chamber 610*q*. Note that, the cosmetic 604 held by the bristle part 609*a* does not return to the storage chamber 610*q*.

Here, if the storage chamber 610*q* is fully filled with the cosmetic 604 during a storage, there is a risk in that the cosmetic 604 leaks out from the cartridge outer tube 610 due to a temperature increase in the cartridge 602, which causes expansion of residual air dispersed in the cosmetic 604 in the storage chamber 610*q*.

In this modification, after the cartridge 602 is used, the support member 670 is reversed by a little amount to store the cartridge 602. By reversing the support member 670, the volume of the storage chamber 610*q* is increased as compared to the volume at the time of use. By increasing the volume, the thermal expansion of the residual air can be compensated, and therefore, it is possible to prevent the cosmetic 604 from leaking out from the cartridge outer tube 610 due to the temperature increase of the cartridge 602 during the storage.

According to the modification as described above, operational advantages similar to those in the first embodiment are achieved.

Second Modification

Figure 35A:
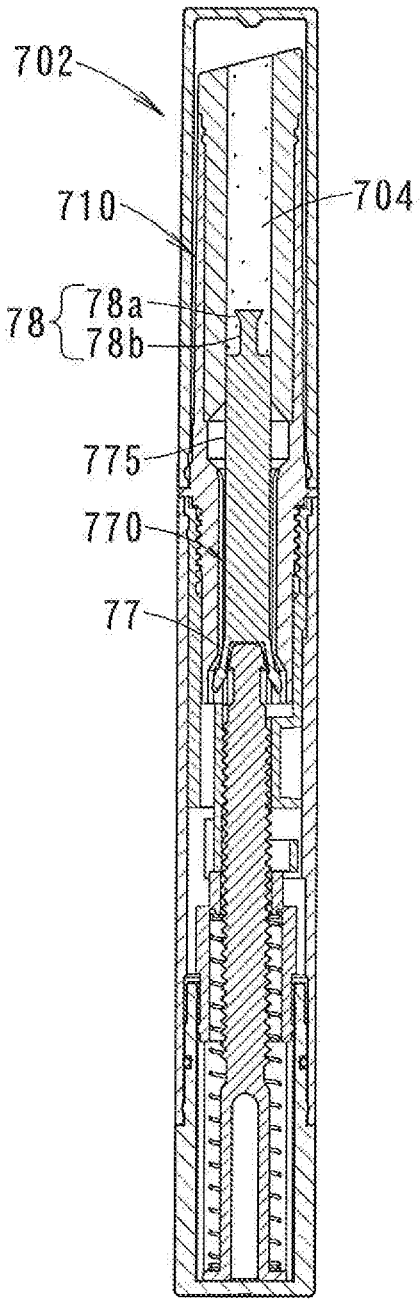
FIG. 35A is a front sectional view showing a state in which the push rod of the cartridge-type cosmetic container according to a second modification of the present invention is positioned at the rearward limit position.
Figure 35B:
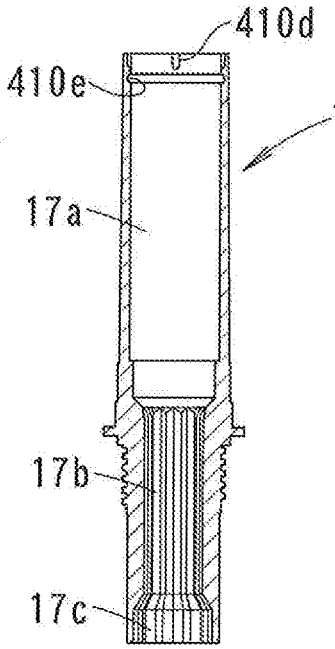
FIG. 35B is a front sectional view of the outer tube body.
Figure 35C:
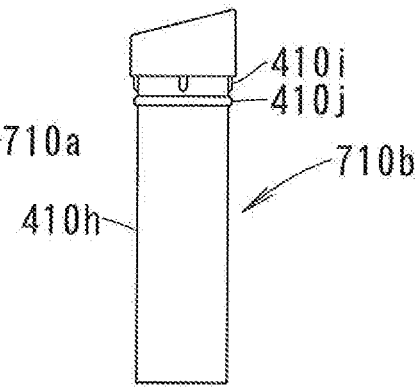
FIG. 35C is a front view of the cosmetic storing tube.

In the above-mentioned embodiments, although a description is given of an example in which means for preventing the support member (70, 270, 370, 470) from being dismounted from the cartridge outer tube (10, 210, 310, 410) is provided, the present invention is not limited to this configuration. In the modification shown in FIGS. 35A to 35C, the support tube 72 described in the first embodiment is not provided, and there is no means to define the rearward limit position of a support member 770.

The support member 770 has a rod shaft portion 775 having a cylindrical column shape, the shaft body portion 78 that is provided on the one end of the rod shaft portion 775 so as to extend in the axial direction, and the plurality of bendable pieces 77 that are provided on the other end of the rod shaft portion 775. The shaft body portion 78 is provided so as to extend forward in the axial direction from a tip end of the rod shaft portion 775. The shaft body portion 78 has the cylindrical column portion 78*b* having a cylindrical column shape and the head portion 78*a* that is provided on the tip end of the cylindrical column portion 78*b*. The head portion 78*a* has the truncated cone shape in which a diameter is increased from the tip end of the cylindrical column portion 78*b* toward the tip end of the head portion 78*a*. A solid cosmetic 704 having cylindrical column shape is fixedly adhered to the shaft body portion 78. In a cartridge 702 according to the present modification, similarly to the fourth embodiment, a cartridge outer tube 710 is formed by detachably linking two members, an outer tube body 710*a* and a cosmetic storing tube 710*b*.

According to the modification as described above, the operational advantages similar to those in (1), (3), and (5) to (11) described in the first embodiment are achieved.

Third Modification

In the above-mentioned embodiment, although a description is given of an example in which the base end hole (17*c*, 217*c*, 317*c*, 417*c*) is provided in the cartridge outer tube (10, 210, 310, 410), the present invention is not limited to this configuration. For example, in the first embodiment, the base end hole 17*c* may not be provided, and the base-end sliding hole 17*b* may be directly connected to the rear end opening 11*b* of the cartridge outer tube 10.

Fourth Modification

In the above-mentioned embodiment, although a description is given of an example in which the rearward limit position of the support member (70, 170, 270, 370, 470) is defined as the support portion (72, 372, 472) comes to contact with the step portion 17*d* provided in the through hole (17, 217, 317, 417), and thereby, the support member is prevented from being dismounted from the cartridge outer tube (10, 210, 310, 410), the present invention is not limited to this configuration. For example, the rearward limit position of the support member 370 may be defined only by the annular recessed portion 372*b* (see FIGS. 26A to 26C) and the protrusions 317*m* (see FIGS. 25A to 25D) described in the third embodiment.

Fifth Modification

In the above-mentioned embodiment, although a description is given of an example in which the bendable pieces (77, 277) serving as the opening and closing portion capable of being opened and closed through the elastic deformation and the linking member 390 are provided, the present invention is not limited to this configuration. For example, in the first embodiment, a plurality of bar-shaped members may be provided instead of the plurality of bendable pieces 77. The bar-shaped members are not opened and closed through the elastic deformation, but are attached by pins at the base end side so as to be rotatable and opened and closed about the pins. Similarly to the bendable pieces 77, tip end portions of the bar-shaped members are provided with the ribs 77*a* and the protrusions 77*b*. As described above, various configurations may be employed for the opening and closing portion. Note that, as described above, by employing a configuration in which the base end of the support member (70, 170, 270, 370, 470) and the tip end of the push rod (60, 260, 360) are linked by the opening and closing portion (77, 277, 390) that is capable of undergoing the elastic deformation, the configuration of the linking portion can be made simple, and so, it is preferred even more.

Sixth Modification

In the above-mentioned embodiment, although a description is given of an example in which the inner diameter of the tip-end storing hole (17*a*, 217*a*, 317*a*, 417*a*) is larger than the inner diameter of the base-end sliding hole (17*b*, 417*b*), the present invention is not limited to this configuration. For example, in the second embodiment, a recessed portion that is slightly larger than the bendable piece 277 may be provided in the inner circumferential surface of the tip-end storing hole 217*a*, and the bendable piece 277 may be shifted to the opened state within the recessed portion. In this case, it is possible to set the inner diameter of the tip-end storing hole 217*a* to be the same as the inner diameter of the base-end sliding hole 17*b*.

Seventh Modification

In the above-mentioned embodiment, although a description is given of an example in which the cosmetic 4 and the support tube (72, 372) and the support portion 472 slide along the inner circumferential surface of the tip-end storing hole (17*a*, 217*a*, 317*a*, 417*a*), the present invention is not limited to this configuration. For example, in the first embodiment, it may be possible to employ a configuration in which the protrusions 73 of the support tube 72 are omitted, the outer diameter of the support tube 72 is set to be slightly smaller compared with the core diameter of the cosmetic 4, and only the cosmetic 4 slides along the inner circumferential surface of the tip-end storing hole 17*a*.

Eighth Modification

The configuration of the feeding mechanism 8, and the configurations of the opening and closing portion (the bendable pieces 77, 277, the linking member 390) and the clamp-fitted portion (67, 267, 377) are not limited to those described above, and it may be possible to employ various configurations.

Embodiments of this invention were described above, but the above embodiments are merely examples of applications of this invention, and the technical scope of this invention is not limited to the specific constitutions of the above embodiments.

This application claims priority based on Japanese Patent Application No. 2017-037037 filed with the Japan Patent Office on Feb. 28, 2017, the entire contents of which are incorporated into this specification by reference.

The invention claimed is:

1. A cartridge configured such that a feeding mechanism is operated as the cartridge is used by being attached to a cartridge holder having a built-in push rod and a cosmetic stored in the cartridge is moved rearward and forward in conjunction with rearward and forward movement of the push rod, comprising:

a cartridge outer tube having a through hole through which a tip end side opening is communicated with a base end side opening; and a support member received in the cartridge outer tube so as to be movable in an axial direction, the support member being configured to support the cosmetic; wherein the support member has:

a rod shaft portion configured to be linked at a base end to a tip end of the push rod; and a support portion provided on a tip end of the rod shaft portion, the support portion being configured to support the cosmetic, the through hole has:

a tip-end storing hole provided on the tip end side of the cartridge outer tube, the tip-end storing hole being configured to store the cosmetic; and a base-end sliding hole provided on the base end side of the cartridge outer tube so as to communicate with the tip-end storing hole, the base-end sliding hole is configured such that a linking portion of the tip end of the push rod and a base end of the support member slides in a linkage unreleasable state, and the linking portion is configured to move out from the base-end sliding hole by the feeding mechanism and to move to a linkage releasable region in the tip-end storing hole.

2. The cartridge according to claim 1, wherein when a position of the support portion is defined in the tip-end storing hole by making an outer diameter of the support portion supporting the cosmetic larger than an outer diameter of the rod shaft portion provided so as to extend from the support portion, the position of the support member is defined as a rearward limit position of the support member, the linking portion is configured to be moved rearward and forward in the base-end sliding hole in a linkage unreleasable state in conjunction with stroke of the push rod, and when the linking portion is moved out from the base-end sliding hole and the linking portion is positioned in the linkage releasable region, the position of the support member is defined as a forward limit position of the support member.

3. The cartridge according to claim 1, wherein the cartridge outer tube has a groove portion configured to engage with an engaging protrusion to prohibit relative rotation with respect to the support member, the engaging protrusion being provided on the support member.

4. The cartridge according to claim 1, wherein the linking portion is formed of an opening and closing portion and a clamp-fitted portion, the opening and closing portion being provided on one of the base end of the support member and the tip end of the push rod, the opening and closing portion being configured to be capable of being opened and closed through elastic deformation, and the clamp-fitted portion being provided on other of the base end of the support member and the tip end of the push rod, the base end of the support member and the tip end of the push rod are configured to be linked as the opening and closing portion is shifted to a closed state and the opening and closing portion is clamp fitted to the clamp-fitted portion, and the support member and the push rod are configured such that the linkage between the base end of the support member and the tip end of the push rod becomes releasable as the opening and closing portion is shifted to an opened state, the opening and closing portion is configured such that the closed state of the opening and closing portion is maintained as the opening and closing portion is constrained by an inner circumferential surface of the base-end sliding hole when the linking portion is placed in the base-end sliding hole, and the opening and closing portion is configured so as to be released from the constraint when the linking portion is moved out from the base-end sliding hole and the linking portion is positioned in the linkage releasable region.

5. The cartridge according to claim 4, wherein the linking portion is configured so as to be shifted to the linkage unreleasable state, when the linking portion is placed in the base-end sliding hole, and the opening and closing portion is shifted to the closed state and clamp fitted to the clamp-fitted portion, and the linking portion is configured such that, as the linking portion is moved out from the base-end sliding hole and the linking portion is positioned in the linkage releasable region, the opening and closing portion is shifted to the opened state, and the linkage between the push rod and the support member becomes releasable.

6. The cartridge according to claim 5, wherein the through hole further has a base end hole through which the base-end sliding hole is communicated with an opening on the base end side, the base end hole is formed to have an inner diameter larger than an inner diameter of the base-end sliding hole, and when the linking portion is placed in the base end hole, the opening and closing portion is shifted to the opened state, and the linkage between the push rod and the support member becomes releasable.

7. The cartridge according to claim 1, wherein the linking portion is configured so as to be positioned in the linkage releasable region when the push rod is advanced to the forward limit position.

8. The cartridge according to claim 1, wherein an inner diameter of the tip-end storing hole is set to be greater than the inner diameter of the base-end sliding hole, and a base-end cavity portion on the base end side of the tip-end storing hole corresponding to a position of the linking portion that has been moved out from the base-end sliding hole and moved to the tip-end storing hole is defined as the linkage releasable region.

9. The cartridge according to claim 1, wherein the support member has a tip-end-side support member and a base-end-side support member, the base-end-side support member being configured to link with the tip-end-side support member, the tip-end-side support member has the support portion configured to support the cosmetic, the base-end-side support member has a shaft body portion, the shaft body portion having a column portion configured to protrude from the support portion toward an opening on the tip end side of the cartridge outer tube, and a head portion provided on a tip end of the column portion, the head portion having a diameter larger than a diameter of the column portion, and the shaft body portion is buried in the cosmetic.

10. A cartridge-type cosmetic container comprising:

the cartridge according to claim 1; and the cartridge holder, wherein the cartridge holder is provided with:

a body tube configured such that the cartridge outer tube is detachably attached to a front-end portion of the body tube; and a driving body provided on a rear-end portion of the body tube so as to be relatively rotatable with respect to the body tube, and the feeding mechanism has:

an internal thread member provided in the body tube, the internal thread member being formed with an internal thread on an inner circumference of the internal thread member; and the push rod provided on the driving body, the push rod being formed with an external thread on an outer circumference of the push rod so as to be threaded with the internal thread of the internal thread member, and the push rod being configured to be moved rearward and forward by relative rotation between the body tube and the driving body.

11. A cartridge holder used by being attached to the cartridge according to claim 1, comprising:

a body tube configured such that the cartridge outer tube is detachably attached to a front-end portion of the body tube; and a driving body provided on a rear-end portion of the body tube so as to be relatively rotatable with respect to the body tube, wherein the feeding mechanism has:

an internal thread member provided in the body tube, the internal thread member being formed with an internal thread on an inner circumference of the internal thread member; and the push rod provided on the driving body, the push rod being formed with an external thread on an outer circumference of the push rod so as to be threaded with the internal thread of the internal thread member, and the push rod being configured to be moved rearward and forward by relative rotation between the body tube and the driving body, the linking portion is formed of an opening and closing portion provided on the tip end of the push rod and a clamp-fitted portion provided on the base end of the support member, the opening and closing portion being configured to be capable of being opened and closed through the elastic deformation, the base end of the support member and the tip end of the push rod are configured to be linked as the opening and closing portion is shifted to a closed state and the opening and closing portion is clamp fitted to the clamp-fitted portion, and the support member and the push rod are configured such that the linkage between the base end of the support member and the tip end of the push rod becomes releasable as the opening and closing portion is shifted to an opened state, the opening and closing portion is configured such that the closed state of the opening and closing portion is maintained as the opening and closing portion is constrained by an inner circumferential surface of the base-end sliding hole when the linking portion is placed in the base-end sliding hole, and the opening and closing portion is configured so as to be released from the constraint when the linking portion is moved out from the base-end sliding hole and the linking portion is positioned in the linkage releasable region.

12. A cartridge holder used by being attached to the cartridge according to claim 1, comprising:

a body tube configured such that the cartridge outer tube is detachably attached to a front-end portion of the body tube; and a driving body provided on a rear-end portion of the body tube so as to be relatively rotatable with respect to the body tube, wherein the feeding mechanism has:

an internal thread member provided in the body tube, the internal thread member being formed with an internal thread on an inner circumference of the internal thread member; and the push rod provided on the driving body, the push rod being formed with an external thread on an outer circumference of the push rod so as to be threaded with the internal thread of the internal thread member, and the push rod being configured to be moved rearward and forward by relative rotation between the body tube and the driving body, the linking portion is formed of an opening and closing portion provided on the base end of the support member and a clamp-fitted portion provided on the tip end of the push rod, the opening and closing portion being configured to be capable of being opened and closed through the elastic deformation, the base end of the support member and the tip end of the push rod are configured to be linked as the opening and closing portion is shifted to a closed state and the opening and closing portion is clamp fitted to the clamp-fitted portion, and the support member and the push rod are configured such that the linkage between the base end of the support member and the tip end of the push rod becomes releasable as the opening and closing portion is shifted to an opened state, the opening and closing portion is configured such that the closed state of the opening and closing portion is maintained as the opening and closing portion is constrained by an inner circumferential surface of the base-end sliding hole when the linking portion is placed in the base-end sliding hole, and the opening and closing portion is configured so as to be released from the constraint when the linking portion is moved out from the base-end sliding hole and the linking portion is positioned in the linkage releasable region.

* * * * *